US007305963B2

(12) United States Patent
Zak

(10) Patent No.: US 7,305,963 B2
(45) Date of Patent: Dec. 11, 2007

(54) BLADE-THRU-SLOT COMBUSTION ENGINE, COMPRESSOR, PUMP AND MOTOR

(76) Inventor: Juan Zak, Frederiksborgvej 388, Roskilde (DK) 4000

( * ) Notice: Subject to any disclaimer, the term of this patent is extended or adjusted under 35 U.S.C. 154(b) by 92 days.

(21) Appl. No.: 10/908,476

(22) Filed: May 13, 2005

(65) Prior Publication Data

US 2006/0257278 A1 Nov. 16, 2006

(51) Int. Cl.

| | |
|---|---|
| ***F02B 53/04*** | (2006.01) |
| ***F02B 53/02*** | (2006.01) |
| ***F01C 3/02*** | (2006.01) |
| ***F01C 21/08*** | (2006.01) |
| ***F01C 3/06*** | (2006.01) |
| ***F16J 15/447*** | (2006.01) |
| ***F16J 15/16*** | (2006.01) |
| ***E21B 33/06*** | (2006.01) |

(52) U.S. Cl. ..... 123/228; 123/233; 418/195; 418/196; 277/303; 277/326; 277/345; 277/390; 277/FOR. 211

(58) Field of Classification Search ..... 123/228–229, 123/233, 238, 80 R, 80 BA; 418/195, 196; 137/625.47; 277/390, 345, 326, 303, FOR. 211; *F01C 3/02, 21/08*

See application file for complete search history.

(56) References Cited

U.S. PATENT DOCUMENTS

| | | | | | |
|---|---|---|---|---|---|
| 889,439 | A | * | 6/1908 | Carter | 418/195 |
| 1,106,666 | A | * | 8/1914 | Miller | 418/195 |
| 1,305,133 | A | * | 5/1919 | Little | 418/195 |
| 1,697,004 | A | * | 1/1929 | Gutermuth | 137/857 |
| 3,203,409 | A | * | 8/1965 | Allen | 123/80 BA |
| 3,277,832 | A | * | 10/1966 | Panie-Dujac | 418/195 |
| 3,481,313 | A | * | 12/1969 | Isstas | 418/195 |
| 3,502,054 | A | * | 3/1970 | Hambric | 123/221 |
| 3,726,616 | A | * | 4/1973 | Powers | 418/195 |
| 3,739,754 | A | * | 6/1973 | Nutku | 418/195 |
| 3,867,912 | A | * | 2/1975 | Parr et al. | 123/238 |
| 4,013,046 | A | * | 3/1977 | Kemp | 418/195 |
| 4,683,852 | A | * | 8/1987 | Kypreos-Pantazis | 123/228 |
| 5,138,994 | A | * | 8/1992 | Maday | 123/248 |
| 5,203,297 | A | | 4/1993 | Iversen | |
| 5,645,027 | A | | 7/1997 | Esmailzadeh | |
| 6,119,649 | A | * | 9/2000 | Raab | 123/233 |

(Continued)

FOREIGN PATENT DOCUMENTS

| | | | | |
|---|---|---|---|---|
| CH | 564146 | A | * | 7/1975 |

(Continued)

*Primary Examiner*—Thai-Ba Trieu

(57) ABSTRACT

This is simple and efficient rotary machine that can be implemented as compressor, pump, motor and mainly as internal combustion engine. The engine comprises a housing, a rotor(s) with a radial blade(s), a chamber(s) swept by the blade(s), an intersecting planar valve(s) with slot, and a combustion chamber. Blades and slots have matching shapes that allow the traversal of the blades through the slots with negligible loss of air/gases. After traversing the slot, the blade aspires air into one side of the chamber while compresses air on the other side. Fuel is injected in the compressed stream in its way to the combustion chamber, where it is ignited. In a double-rotor implementation, combustion gases are then introduced in the second rotor chamber, just after its blade has traversed the corresponding slot. One side of this blade is pushed by the expansion while the other expels gases from the previous stroke.

22 Claims, 39 Drawing Sheets

U.S. PATENT DOCUMENTS

| | | | | |
|---|---|---|---|---|
| 6,276,329 | B1 | 8/2001 | Archer | 123/228 |
| 6,321,699 | B1 * | 11/2001 | Britton | 123/80 R |
| 6,431,551 | B1 * | 8/2002 | Fuse et al. | 277/390 |
| 6,546,908 | B1 | 4/2003 | Pekau | 123/206 |
| 6,588,395 | B2 * | 7/2003 | DeFazio | 123/224 |
| 7,059,294 | B2 * | 6/2006 | Wright | 418/195 |
| 2006/0162794 | A1 * | 7/2006 | Mueller et al. | 137/625.47 |

FOREIGN PATENT DOCUMENTS

| | | | | |
|---|---|---|---|---|
| DE | 2827211 | A | * | 1/1980 |
| DE | 2909561 | A | * | 9/1980 |
| DE | 3041606 | A | * | 6/1982 |
| DE | 3301726 | A1 | * | 7/1984 |
| DE | 4127870 | A1 | * | 1/1992 |
| DE | 4226063 | A1 | * | 1/1994 |
| DE | 4319896 | A1 | * | 12/1994 |
| DE | 4405311 | A1 | * | 8/1995 |
| DE | 19509913 | A1 | * | 9/1996 |
| DE | 10354621 | A1 | * | 6/2005 |
| EP | 933500 | A1 | * | 8/1999 |
| FR | 2531744 | A | * | 2/1984 |
| GB | 2356896 | A | * | 6/2001 |
| GB | 2374903 | A | * | 10/2002 |
| JP | 54087911 | A | * | 7/1979 |
| JP | 57097021 | A | * | 6/1982 |
| JP | 63227901 | A | * | 9/1988 |
| JP | 63295818 | A | * | 12/1988 |
| JP | 03100328 | A | * | 4/1991 |
| JP | 04101021 | A | * | 4/1992 |
| RU | 2044893 | C1 | * | 9/1995 |
| WO | WO 9314299 | A1 | * | 7/1993 |
| WO | WO 9743519 | A1 | * | 11/1997 |
| WO | WO 0012867 | A1 | * | 3/2000 |

* cited by examiner

BLADE-THRU-SLOT COMBUSTION ENGINE, COMPRESSOR, PUMP AND MOTOR

BACKGROUND OF THE INVENTION

1. Field of the Invention

This invention relates to a rotary machine that can be implemented as a compressor, pump, motor or combustion engine. This machine is mainly intended for use as an internal combustion engine.

2. Description of the Prior Art

Most internal combustion engines nowadays use reciprocating pistons. This design has severe inherent limitations: pressure and torque arm out of phase, high "inertial" forces between components due to acceleration/deceleration of pistons and change of trajectory of connecting rods, and expansion ratio tied to the compression ratio. Such limitations reduce performance, increase friction and wear, and reduce energy efficiency.

Many rotary designs have been proposed to overcome the inherent limitations of reciprocating engines. Although relegated to niche markets, the Wankel engine has probably been the most successful in commercial terms. Technically speaking, the Wankel engine has not completely solved old problems like friction and wear, and has problems of its own, especially low torque and troublesome sealing.

My invention is more related to toroidal engines, recent examples of which are found in U.S. Pat. No. 5,645,027 (Esmailzadeh); U.S. Pat. No. 6,276,329 (Archer); and U.S. Pat. No. 6,546,908 (Pekau).

Toroidal engines use pistons revolving in a toroidal chamber intersected by walls or valves. Generally speaking, compression is achieved by advancing the pistons against said walls/valves while deviating the compressed fluid to a separate chamber. At the end of the compression stroke, the intersecting wall/valve briefly retracts/opens to allow the piston pass by/through. In the meantime, combustion is started in the separate chamber. Combustion gases are then released behind the piston.

A key problem in prior art toroidal engines is the loss of compressed fluid during the opening and closing of the walls/valves. Such loss has an important toll on power output and energy efficiency, as it reduces the fuel-burning capacity of the engine, and at the same time increases the pumping power requirements for the compression and exhaust strokes.

Recent designs, disclosed in the already mentioned patents to Archer and to Pekau, have seemingly reduced compression losses to manageable levels. Archer's approach consists of very short pistons and an intersecting valve made of two counter-rotating discs. Pekau has instead modified the shape of the pistons in order to better match the intersecting valve, which is a single rotating disc.

The starting point of my approach has been to develop a simple method for "seamlessly" traversing one body through another moving in an intercepting trajectory. The result is the "blade-thru-slot" (BTS) concept. The application of this concept in a rotary machine leads to blades that orbit circularly inside a chamber and traverse intersecting planar valves through small slots. This approach virtually eliminates compression losses in a mechanically simple way; the slots are not only small in area but also remain "plugged" by the traversing blades while said slots are inside the chamber.

Although the Archer and Pekau engines have lower compression losses than previous toroidal designs, reduced fuel-burning capacity and excessive pumping power requirements are still present. Design limitations do no allow for positive removal of exhaust gases; instead, these remain in the toroidal chamber, between the revolving pistons, and are carried along until they get mixed with the intake charge. Similarly, there is no positive intake of air; an external charger is required to provide fresh air for the compression stroke. Consequences of these limitations are reduced intake of fresh air, excessive amount of exhaust gases in the intake charge, increased pumping losses, and ultimately lower power output.

The BTS engine provides complete removal of exhaust gases from the chamber, and positive intake of air, thus no external charger is required. This comprehensive "breathing" allows the BTS engine to achieve its full power potential.

Generally speaking, the BTS engine has the following advantages over prior art rotary engines: mechanical simplicity, very low friction (as no contact sealing is used), internal lubrication not needed, reduced pumping losses, comprehensive breathing and increased power output.

The above discussion is by extension applicable to other implementations of the BTS machine. Regarding compressors and pumps, main advantages of the BTS machine over reciprocating piston machines are lower friction and wear, no internal lubrication required and reduced power demand. In the case of prior art rotary compressors and pumps, the BTS machine is generally superior in terms of mechanical simplicity, reduced internal friction and no internal lubrication. Regarding pneumatic motors and similar compressed-fluid motors, the general advantages of the BTS machine over conventional and prior art machines are again mechanical simplicity, reduced internal friction, and no internal lubrication.

BRIEF SUMMARY OF THE INVENTION

This invention provides a rotary machine that can be used as a compressor, pump, motor or combustion engine; however, it is mainly intended for use as an internal combustion engine.

The principal object of the present invention is a rotary internal combustion engine that overcomes the reduced performance, high internal friction, excessive wear and low energy efficiency of conventional reciprocating engines. It is a further object of this invention to overcome shortcomings of prior art toroidal engines which generally include sealing problems, insufficient compression, mechanical complexity and excessive pumping power requirements. It is a further object of this invention to provide a mechanically simple engine that can also be constructed with ceramic materials and thus reduced cooling requirements.

The BTS engine can work either as an Otto or Diesel engine (only the first is explained below). The engine consists of a static housing, a rotor(s) with a radial blade(s) on its perimeter, a chamber(s) swept by the blade(s), and a planar valve(s) with slot intersecting the chamber(s). Blades and slot valves move synchronously in a way that blades traverse the valves through the slot. Blades and slots have matching shapes that allow such traversal with negligible loss of working fluid through the slots.

In the double-rotor implementation, a compression rotor and an expansion rotor are mounted on the same main shaft, and share the same slot valve. After traversing the slot valve, the blade on the compression rotor aspires air into the chamber; at the same time, the other side of the blade compresses air against the slot valve and drives it out towards a combustion chamber. An injector on the inlet pipe of the combustion chamber sprays fuel into the air stream. At the end of the compression stroke, the air-fuel mixture in the combustion chamber is ignited by a spark plug. Combustion gases are introduced in the expansion rotor, between the slot valve and the blade. The expanding gases push the blade forward and produce power on the main shaft. The other side of the blade expels from the chamber the exhaust gases left by the previous expansion stroke.

In the single-rotor implementation, the rotor alternatively performs an intake/exhaust stroke and a compression/expansion stroke.

The compression ratio of the double-rotor engine may be regulated by changing the effective volume of the combustion chamber, either manually off operation, or on-demand through a piston-rod mechanism. The above also applies for the single-rotor engine, with the only difference that the volume change is made on the storage chamber.

It is a further object of this invention to provide a compressor/pump with lower friction and wear, and lower power demand than conventional reciprocating compressors and pumps. It is also object of the invention to provide a rotary compressor/pump superior to prior art machines in terms of mechanical simplicity, low internal friction, and no internal lubrication requirements. The BTS compressor/pump is very similar to the compressor side of the double-rotor BTS engine, described above.

It is a further object of this invention to provide a compressed-fluid motor superior to conventional and prior art machines in terms of mechanical simplicity, low internal friction and no internal lubrication requirements. The BTS motor is very similar to the already described expansion side of the BTS double-rotor engine.

DETAILED DESCRIPTION OF PREFERRED EMBODIMENTS

The blade-thru-slot (BTS) rotary machine can be implemented as a compressor, pump, motor or combustion engine. The following description will sequentially describe each of these implementations.

Figure 1:
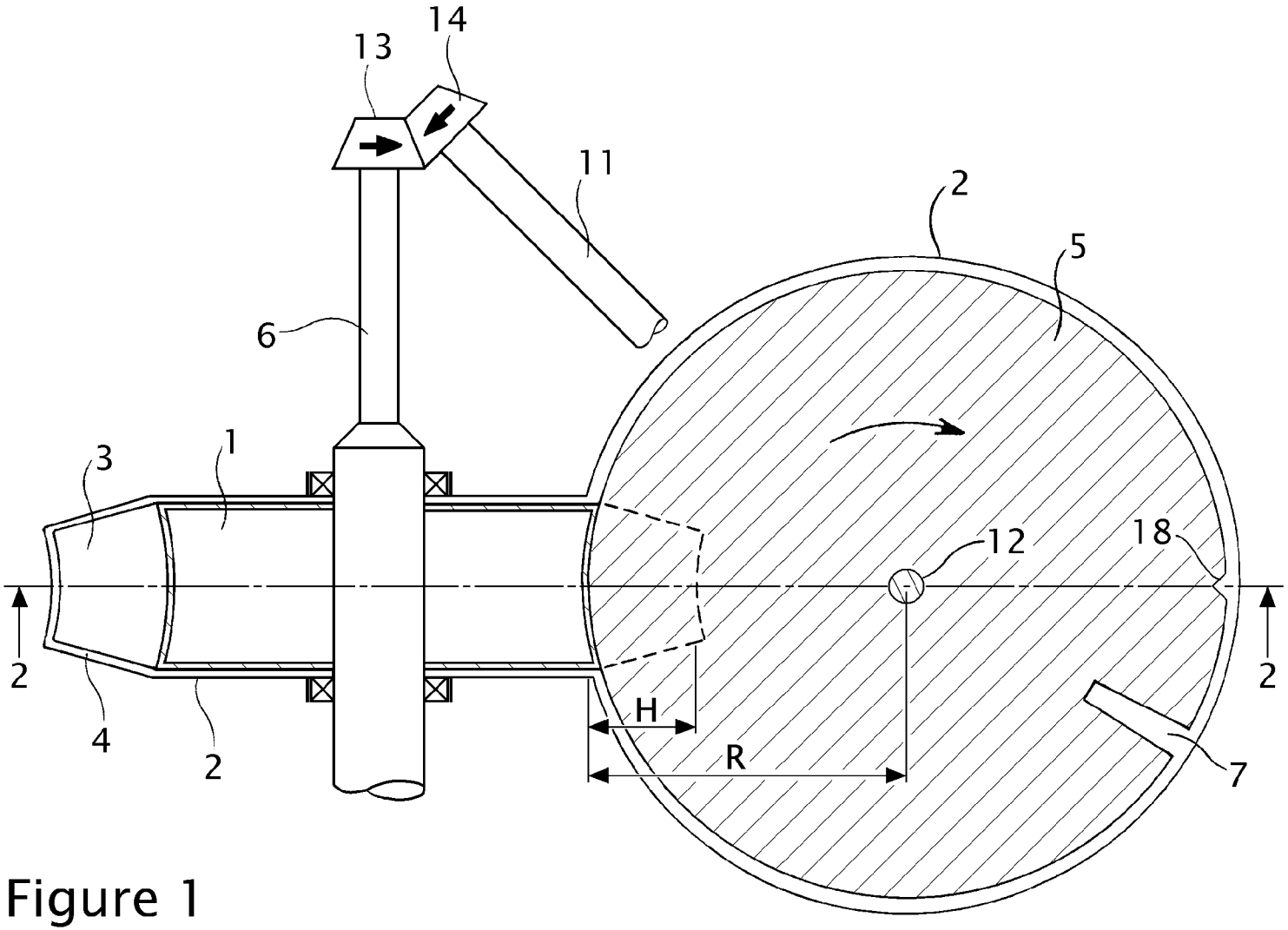
FIG. 1: Sectional plan view of the BTS compressor using rotary slot valve, as seen along line 1-1 of FIG. 2
Figure 2:
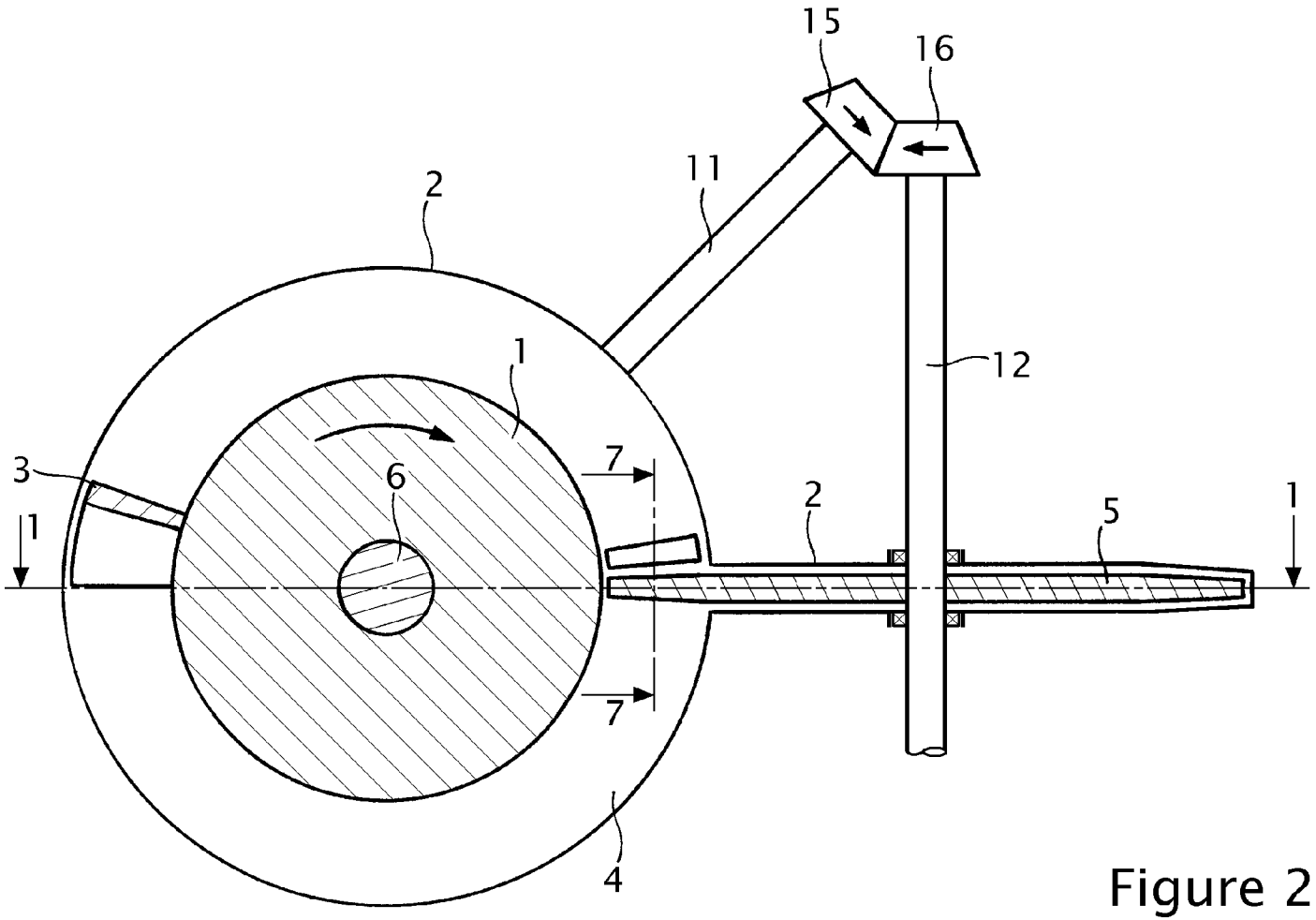
FIG. 2: Sectional front elevation view of the BTS compressor using rotary slot valve, as seen along line 2-2 of FIG. 1.
Figure 3:
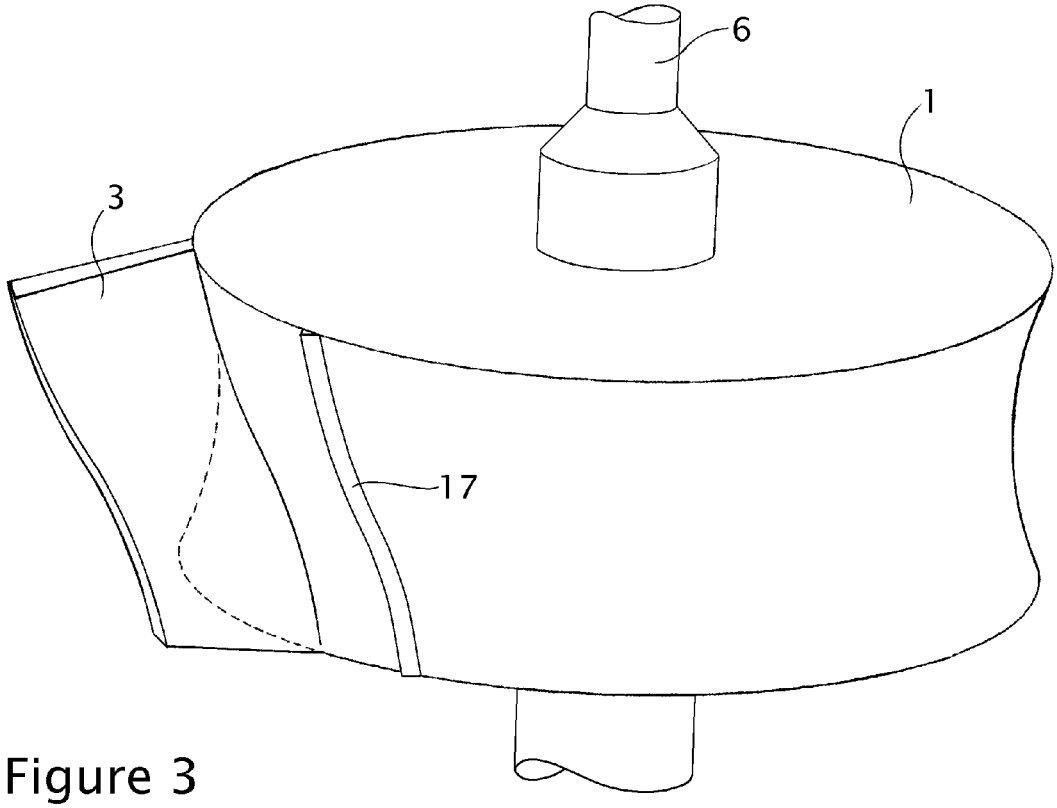
FIG. 3: Perspective view of the rotor showing one radial blade and one synchronization blade (BTS compressor using rotary slot valve)

FIGS. 1 and 2 present schematic views of a BTS compressor or pump. The basic elements are a rotor 1, contained in a static housing 2, with one or more radial blades 3 arranged equiangularly; a chamber 4 swept by the blade(s); and one or more planar slot valves 5, one per blade, also placed radially and equiangularly in the chamber. Rotor 1 (FIG. 3) is mounted and secured on main shaft 6, which receives the driving torque at one of its ends. Blades and slot valves move synchronously to each other in a way that blades 3 timely reach and traverse slots 7. Blades and slots have special matching shapes that allow such traversal with negligible loss of working fluid through the slots; this is further explained below.

Figure 4:
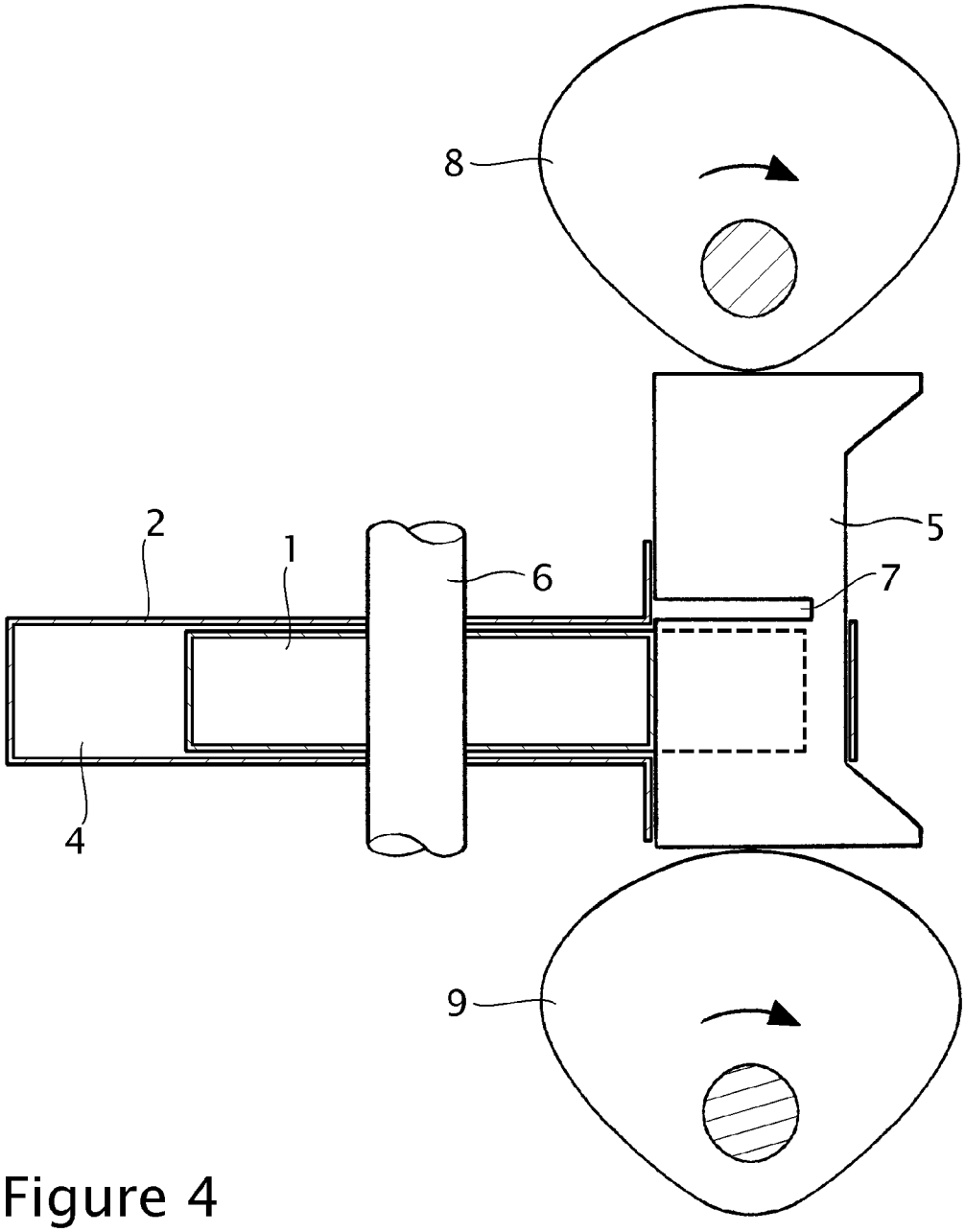
FIG. 4: Sectional plan view of the rotor, slot valve and double-cam (BTS compressor using sliding slot valve)
Figure 5:
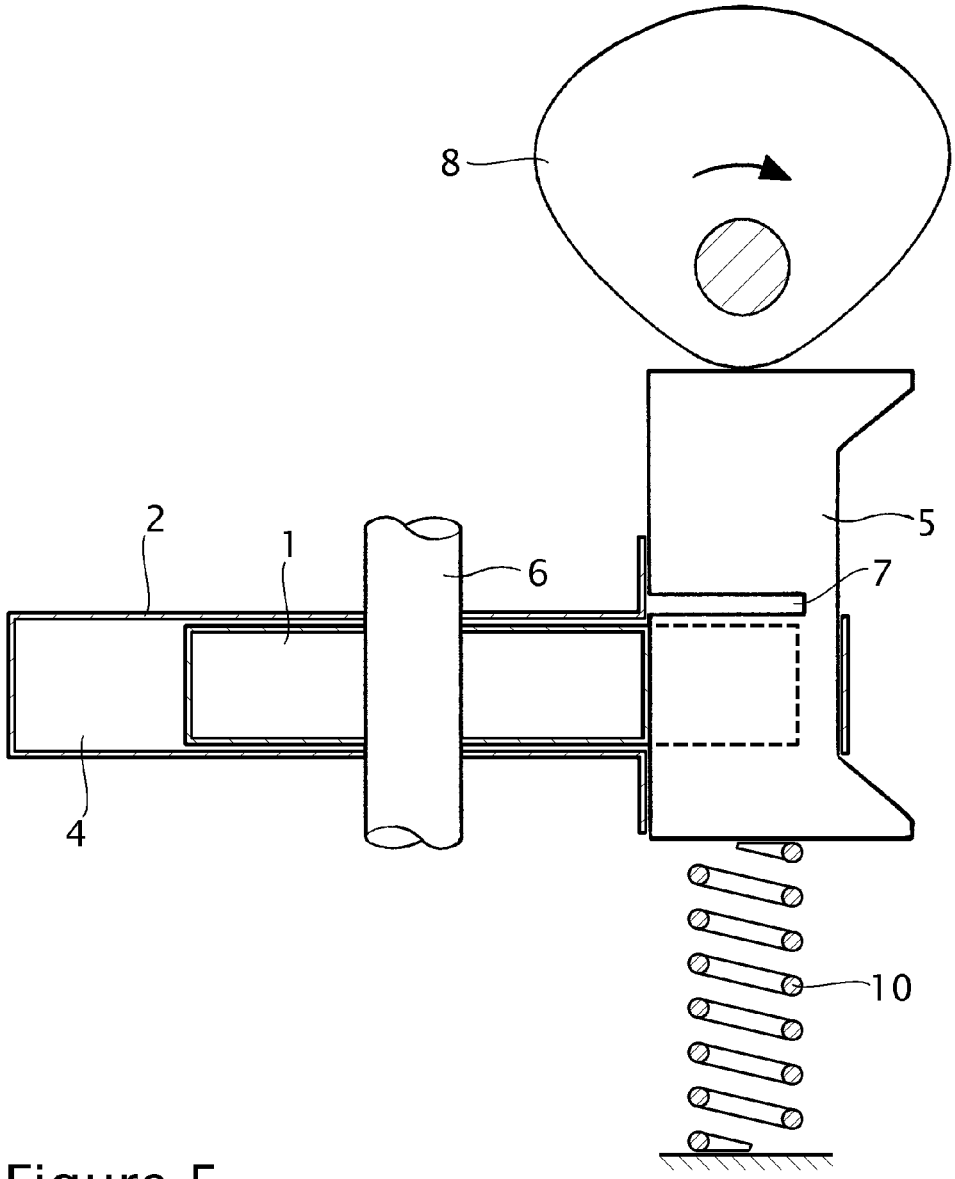
FIG. 5: Sectional plan view of the rotor, slot valve, cam and helical spring (BTS compressor using sliding slot valve)

Referring to FIG. 4, the best match between blade 3 (not show) and slot 7 is obtained when slot valve 5 slides at constant speed and in a linear trajectory, parallel to the axis of rotation of the blade and along a plane that radially intersects such axis. Said speed and trajectory may be provided by two identical cams 8 and 9, with the exact profile shown in FIG. 4, rotating synchronously to each other and at the same speed that the main shaft. One of the cams can be replaced by helical spring 10 that maintains the slot valve pressed against the remaining cam (FIG. 5).

A mechanically simpler approach is to use rotary slot valves 5, as shown in FIGS. 1 and 2. The larger the radius R of the slot valves relative to the height H of the blades, the closer is the approach to the best match mentioned above.

Rotary slot valve 5 is driven by shafts 111 and 12, and pinions 13 to 16; a toothed belt can be used instead of said shafts and pinions. A more sophisticated alternative is to directly drive the rotary slot valve with a special computer-controlled servomotor (not shown).

A synchronization protection for rotor 1 and rotary slot valve 5 may be required in machines (especially combustion engines) subject to high acceleration; this can be achieved by providing small synchronization blades 17 (only one shown in FIG. 3) and matching slots 18 (one shown in FIG. 1). Such blades and slots will keep the rotor and slot valve synchronized by direct physical contact in case any excessive slack or even failure occurs in the normal synchronization mechanism. The number of synchronization blades and matching slots depends on the machine specific design. For example, the machine shown in FIG. 1 would require eleven pairs of synchronization blades and matching slots.

For an easier understanding, the rest of this description considers the simplest BTS machine implementation, i.e. one blade and one rotary slot valve.

Figure 6:
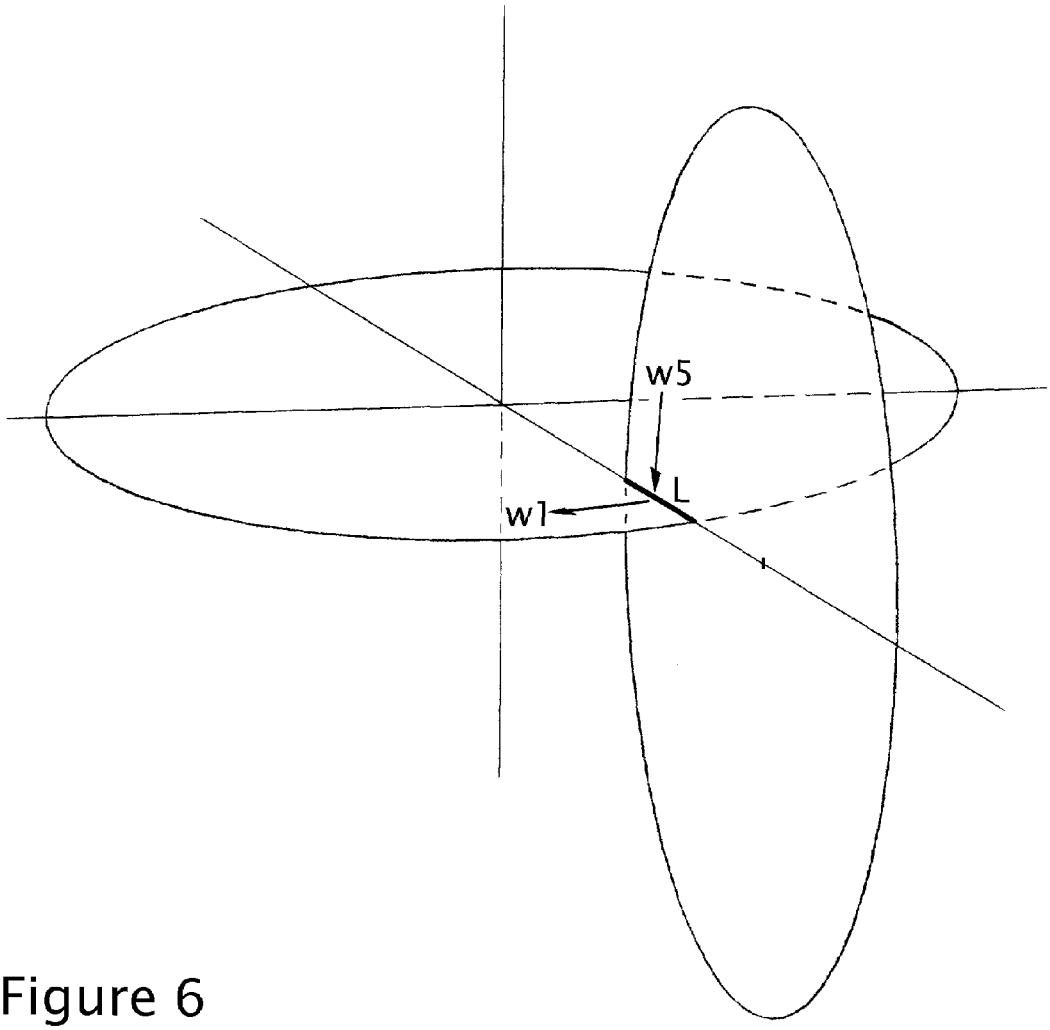
FIG. 6: Perspective view of line segment L defining the shape of the blade (BTS compressor using rotary slot valve)

The shape of blade 3 (FIG. 3) can be defined by the trajectory of a line segment (L in FIG. 6) when simultaneously rotating at angular speed w1 of the rotor and angular speed w5 of the slot valve.

Figure 7:
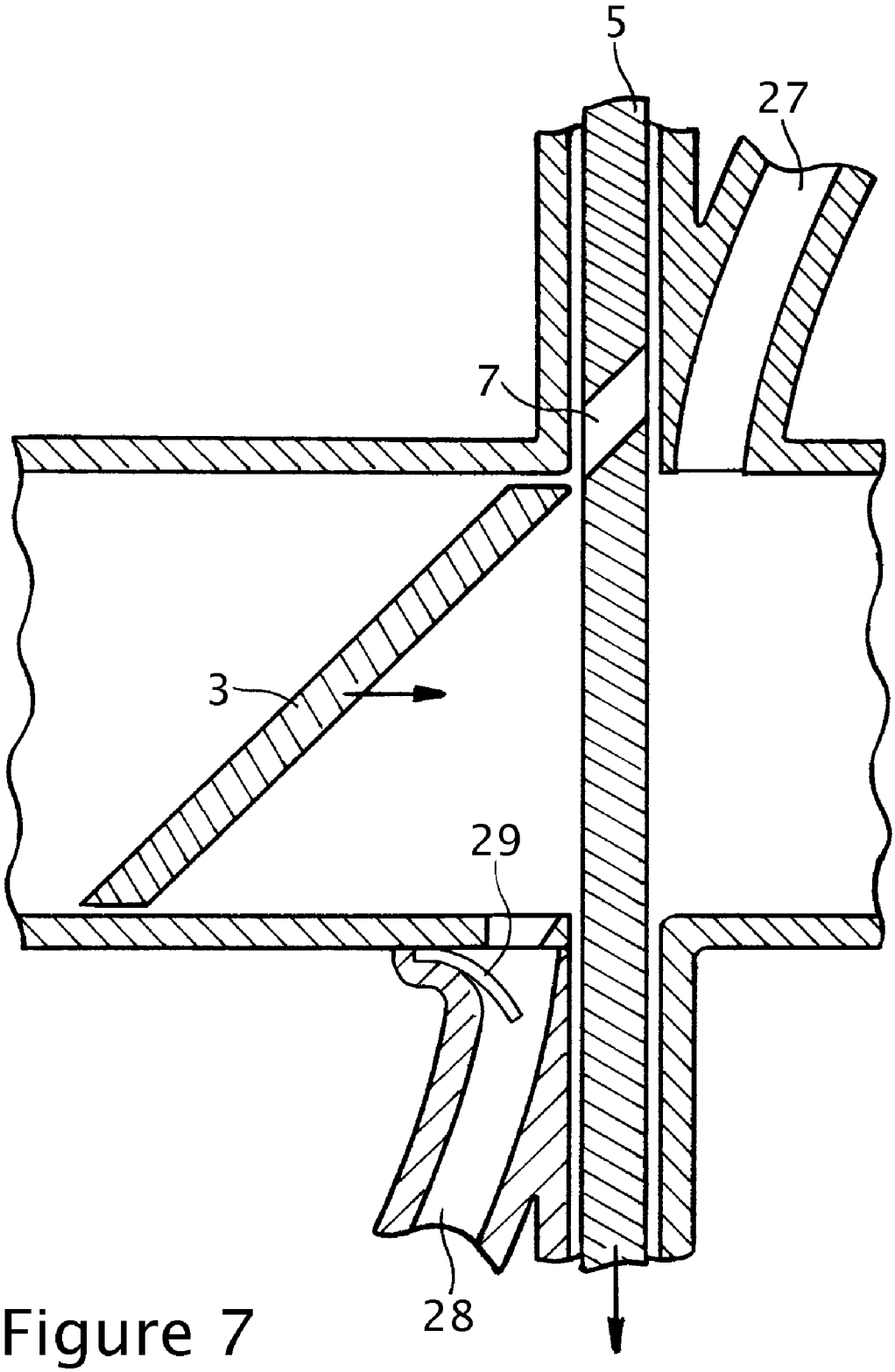
FIG. 7: Sectional view of the blade shortly before traversing the slot valve, as seen along line 7-7 of FIG. 2.
Figure 8:
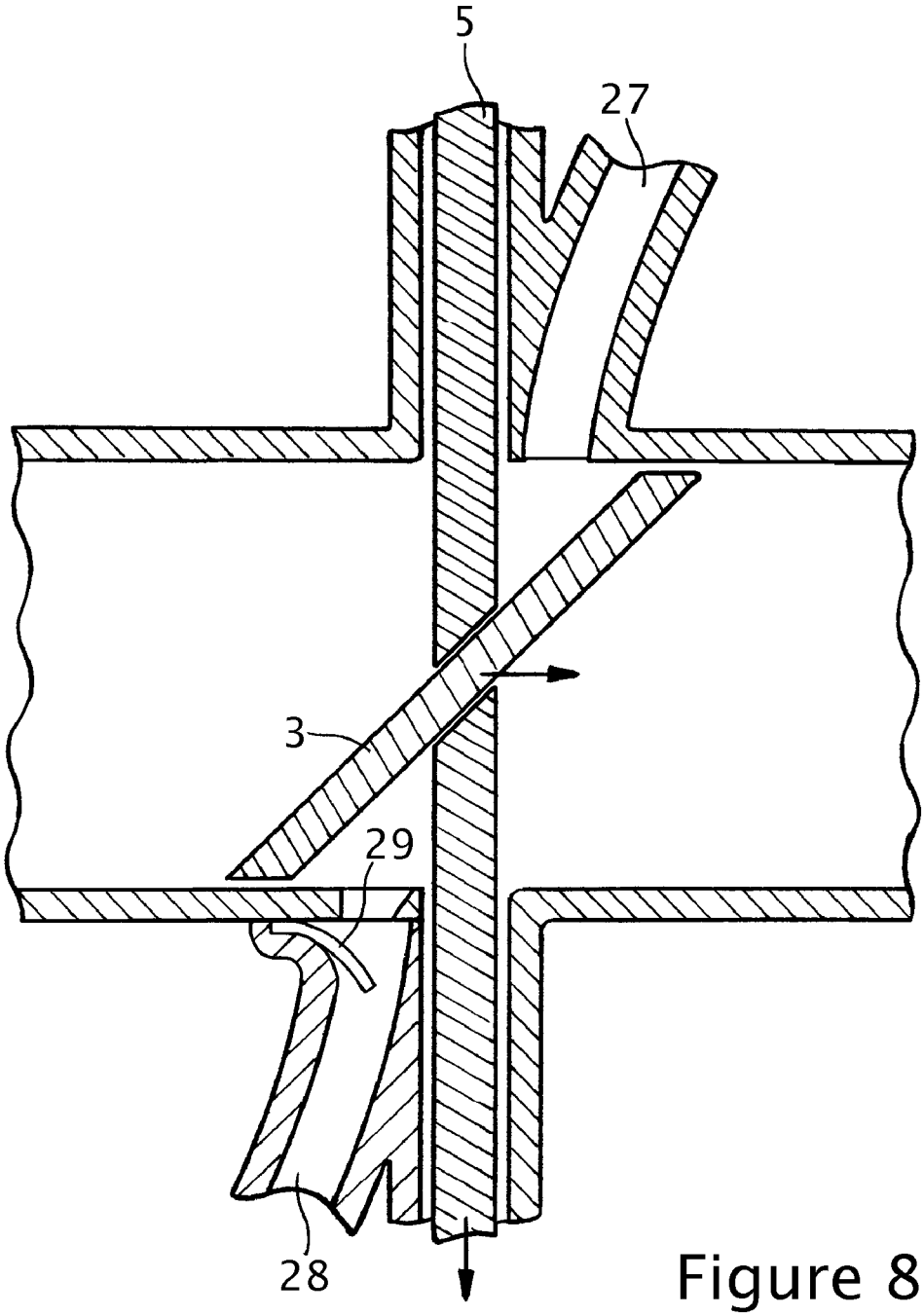
FIG. 8: Sectional view of the blade traversing the slot valve, as seen along line 7-7 of FIG. 2.
Figure 9:
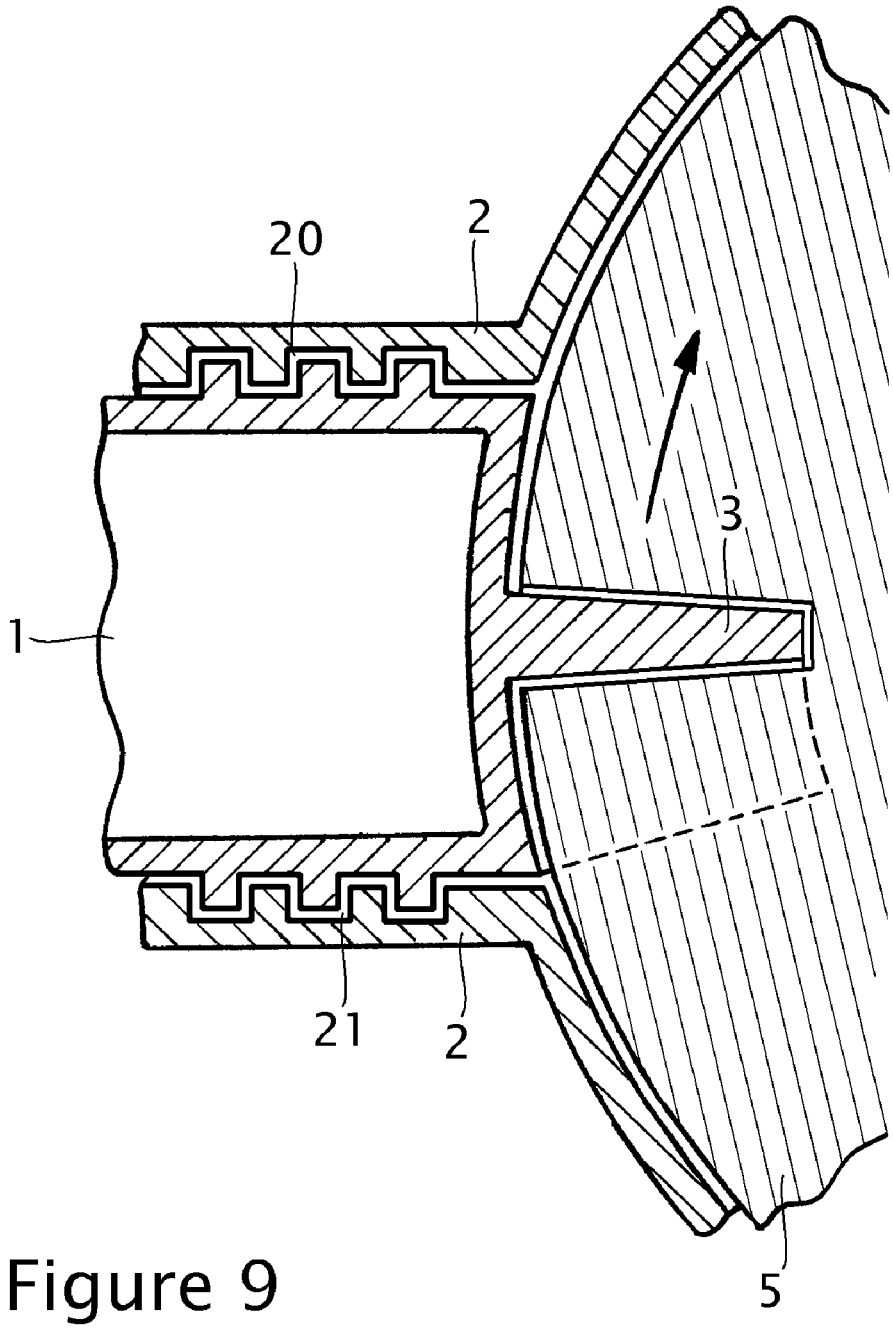
FIG. 9: Sectional view of the blade traversing the slot valve, and of the labyrinth seals between the rotor and the housing, as seen along line 1-1 of FIG. 2.
Figure 10:
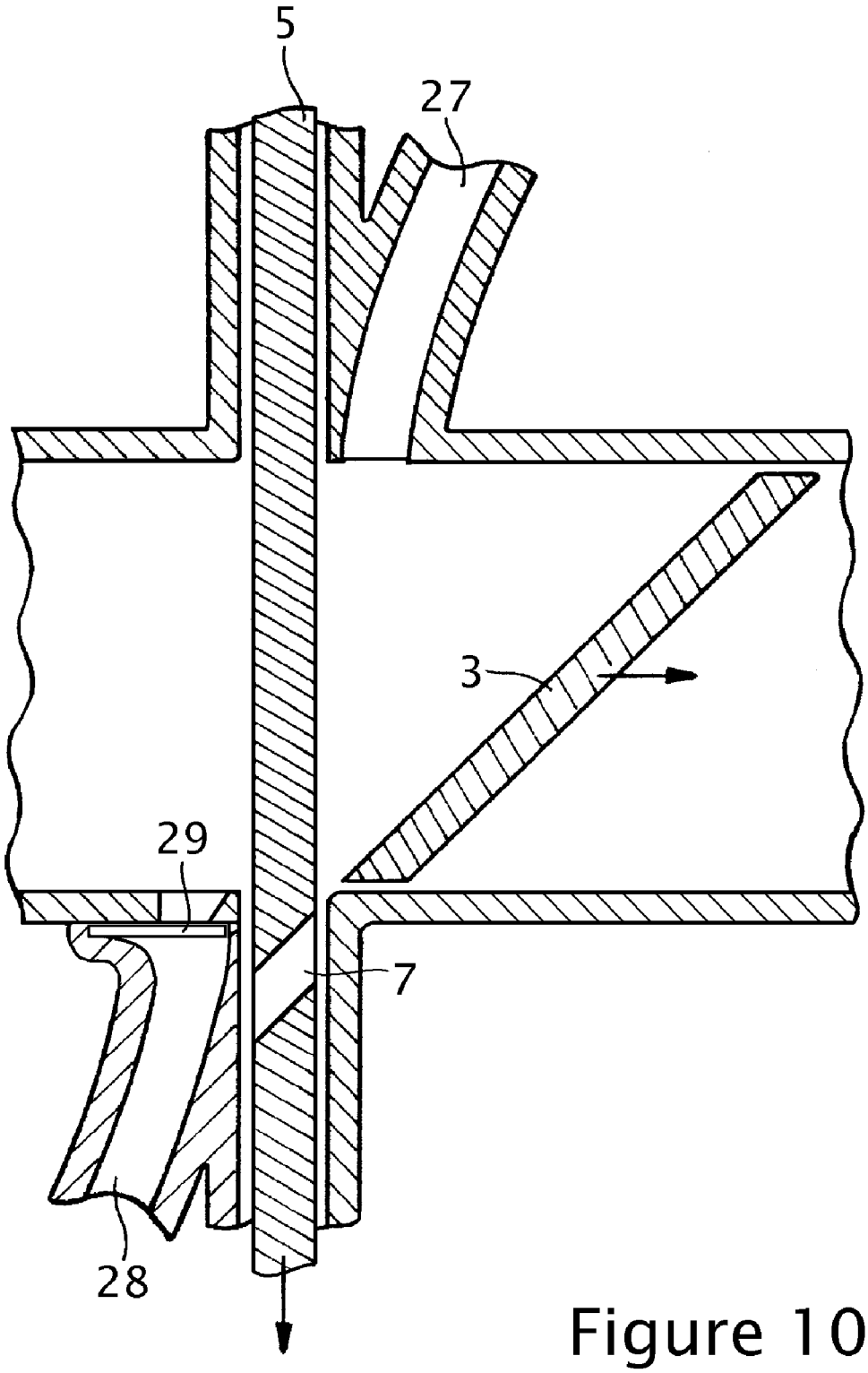
FIG. 10: Sectional view of the blade shortly after traversing the slot valve, as seen along line 7-7 of FIG. 2.

As schematically shown in FIGS. 7 to 10, the BTS design allows blade 3 to traverse slot 7 with a negligible loss of working fluid. Said loss is desirable to a certain extent as it provides a fluid cushion between the traversing blade and the slot valve. FIGS. 8 and 9 show from different angles the blade traversing the slot on the valve.

Rotor, blade and chamber are manufactured to close tolerance, in order to reduce as practically possible the gaps between the blade and the chamber walls. The small amount of leaks of working fluid through these gaps is largely offset by the important benefits of avoided contact seals, i.e. no wear, no lubrication needed, no heat generated by friction and thus no related energy losses. Moreover, the leaking fluid may help cool the blade edges when it expands through the gaps, following the cooling principle applied in refrigeration systems.

Figure 11:
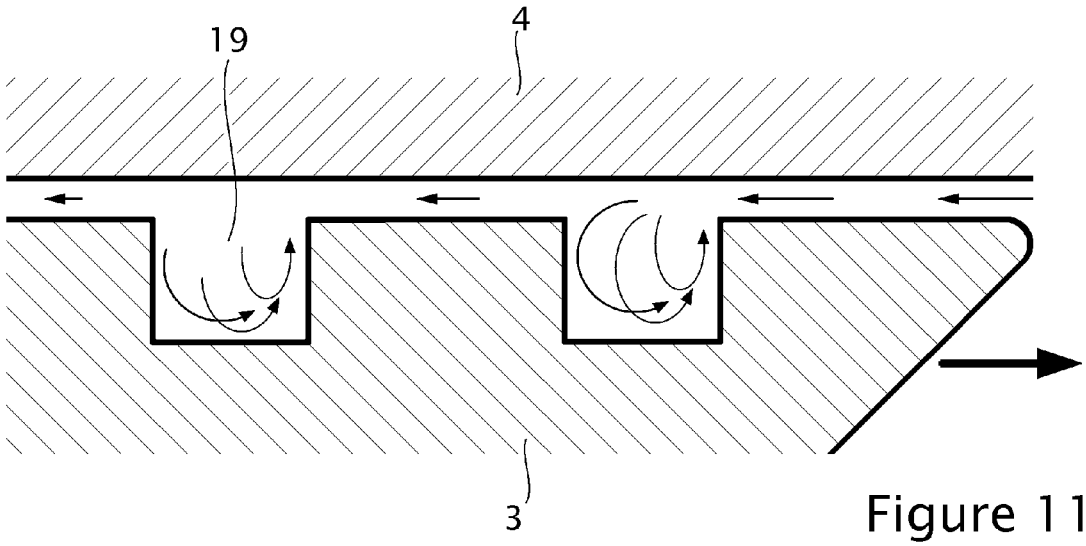
FIG. 11: Sectional view of the grooves cut along the edge of the blade, as seen from line 7-7 in FIG. 2.

Small grooves 19 can be cut along the edge of blade 3, as shown in FIG. 11, to further reduce the leaks between the blade and the walls of chamber 4. The grooves are intended to disrupt the flow by forcing the leaking fluid to consecutively expand and compress when passing from one groove to the next.

Figure 12:
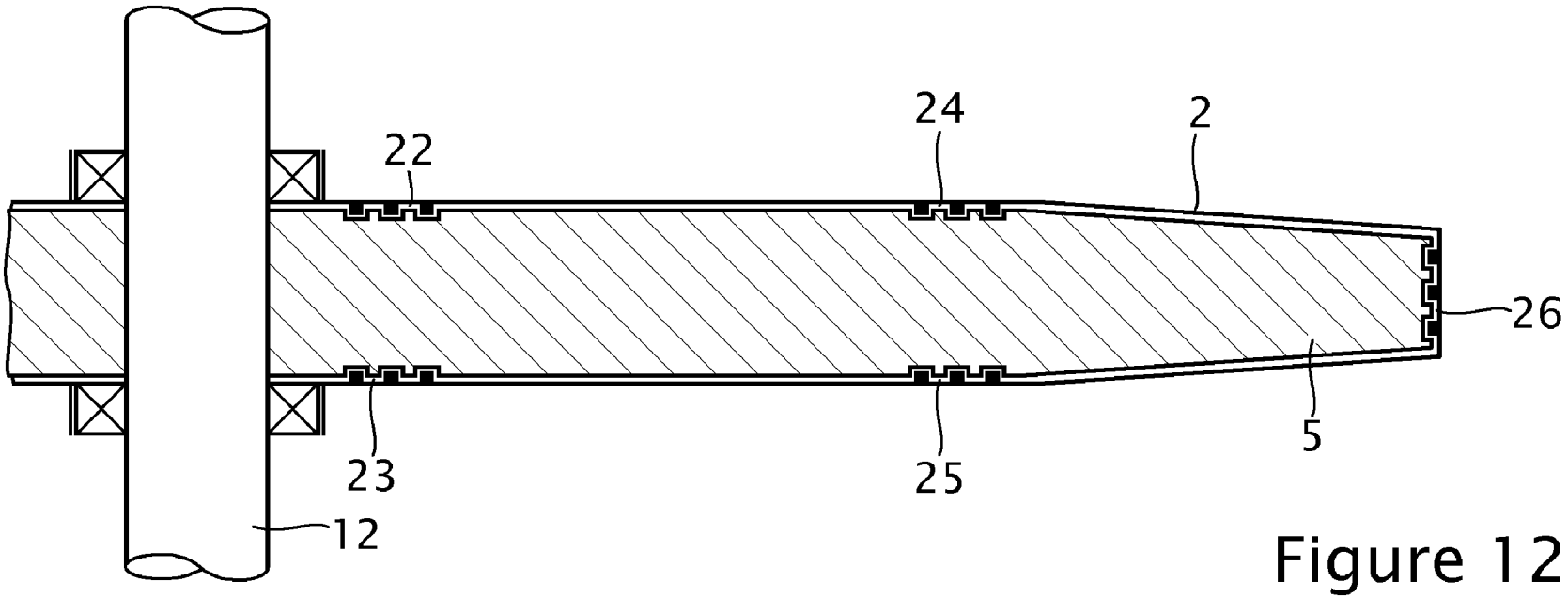
FIG. 12: Sectional view of the labyrinth seals between the rotary slot valve and the housing.

As indicated in FIG. 9, labyrinth seals 20 and 21 are used between rotor 1 and housing 2. Similarly, FIG. 12 shows labyrinth seals 22 to 26 placed between slot valve 5 and housing 2. Slot valve 5 is also manufactured to close tolerance, as to minimize the gap and thus the leaks between its perimeter and rotor 1. The grooves from seal 26 cut on the valve's perimeter further reduce said leaks.

The above mentioned labyrinth seals and grooves are only two possible means to seal the rotor, blade and slot valve against the housing walls. Contact seals may be used instead of or as an aid to said labyrinths and grooves.

Figure 13:
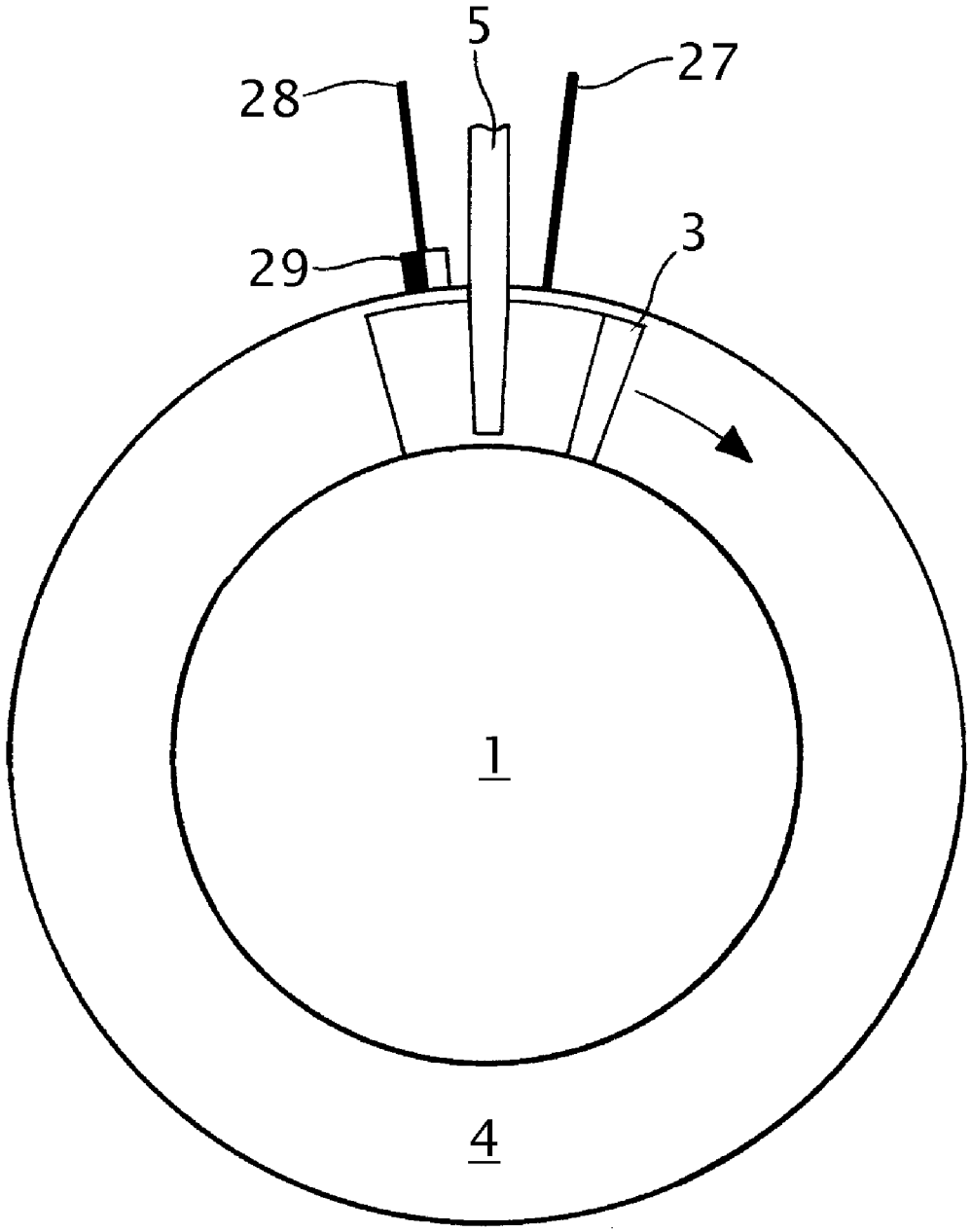
FIGS. 13 to 15: Sectional front view of three different stages of the intake/compression stroke (BTS compressor)
Figure 14:
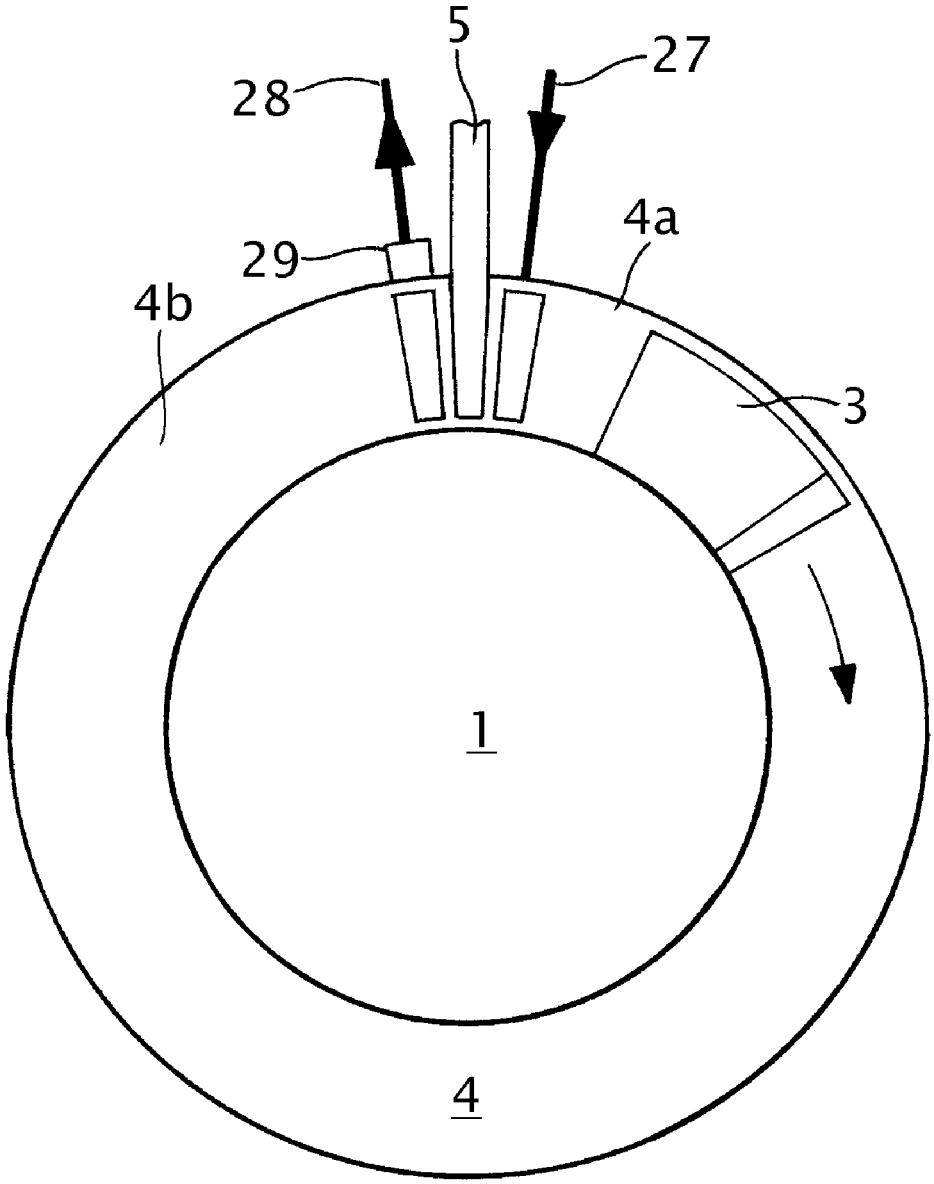
Figure 15:
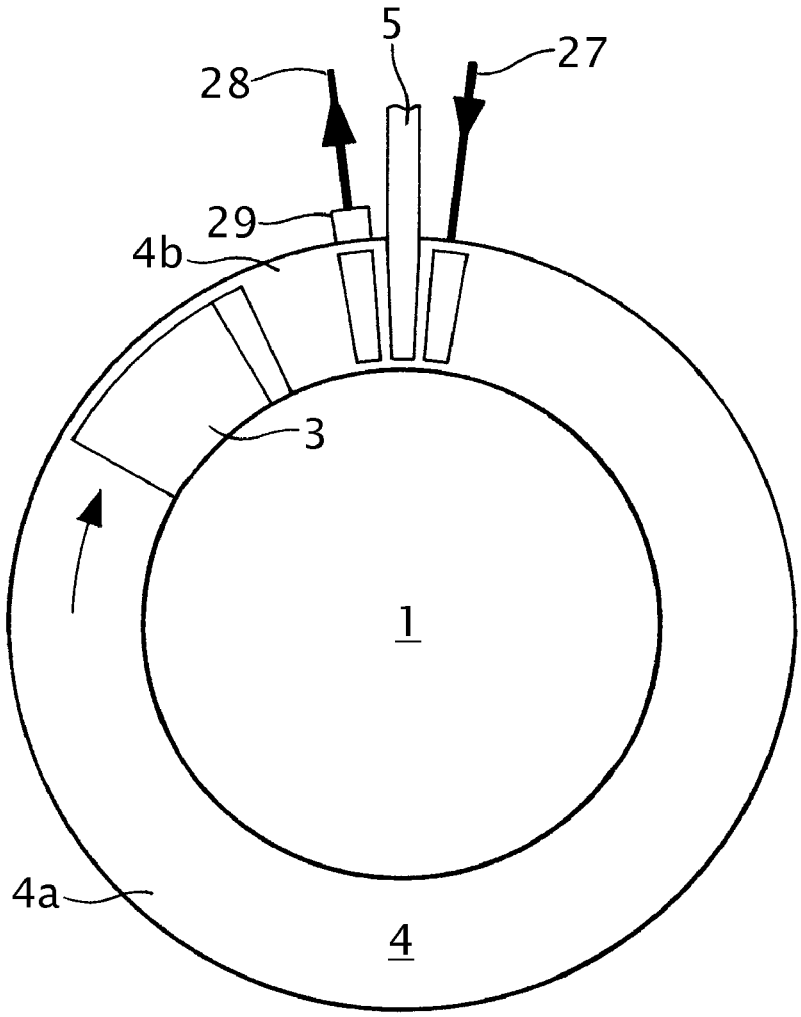

FIGS. 13 to 15 schematically show the operation of the BTS compressor or pump. After traversing slot valve 5, advancing blade 3 generates suction on its back side and compression on its front side. Thus, working fluid is aspired through inlet port 27 into sub-chamber 4*a*; at the same time the fluid in sub-chamber 4*b* is compressed by the blade against the other side of slot valve 5, and finally pumped out through outlet port 28.

Figure 16:
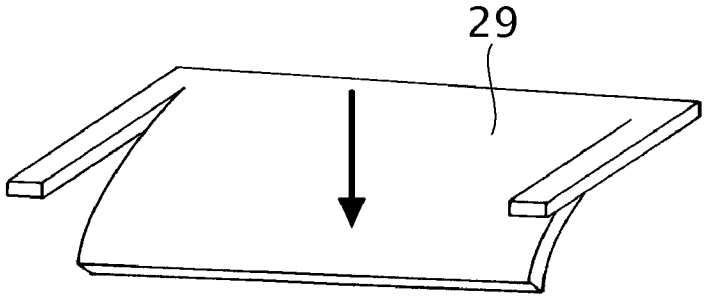
FIG. 16: Perspective view of the flap valve deflected by the fluid exiting the compression sub-chamber.

As indicated in FIG. 7, inlet port 27 and outlet port 28 are situated very close to the slot valve; in addition, as suggested in FIG. 14, the ports' shape follows that of the blade edge but is slightly smaller. Such design enables the traversing blade to temporally block these ports during the transition to the next compression cycle, thus preventing the return of working fluid from the intake sub-chamber to the inlet port; furthermore, blocking the outlet will prevent the return of compressed working fluid through the outlet port while flap valve 29 closes. This flap valve is a thin sheet spring made of steel plate, hardened and tempered. FIG. 16 shows how the flap valve deflects when the fluid is pumped out of the compression sub-chamber.

The implementation of the BTS machine as a motor is quite similar to that of the compressor already described. All elements are the same, except for the flap valve, which is not necessary, and a new control valve described below.

Figure 17:
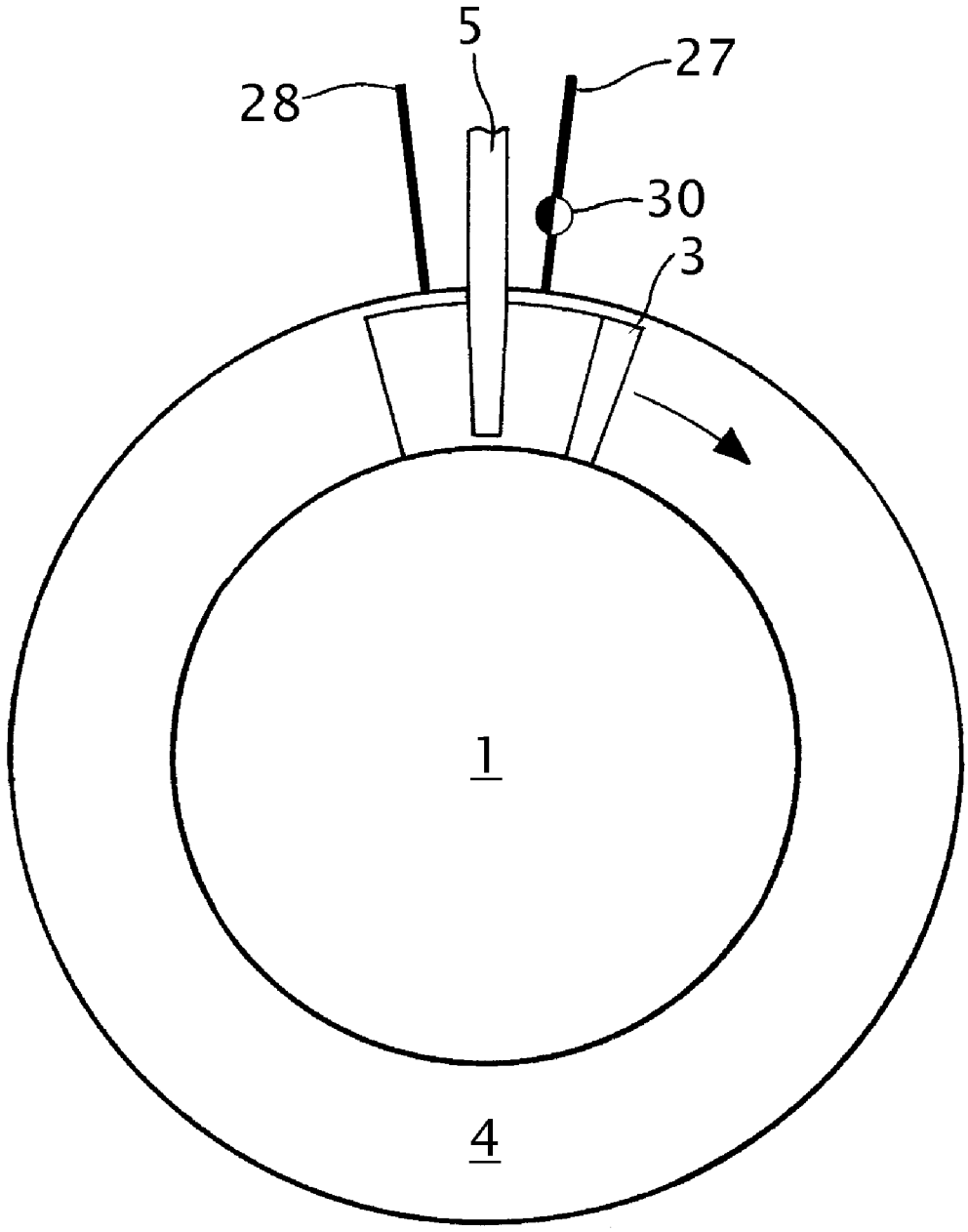
FIGS. 17 to 19: Sectional front view of three different stages of the intake/expansion strokes (BTS motor)
Figure 18:
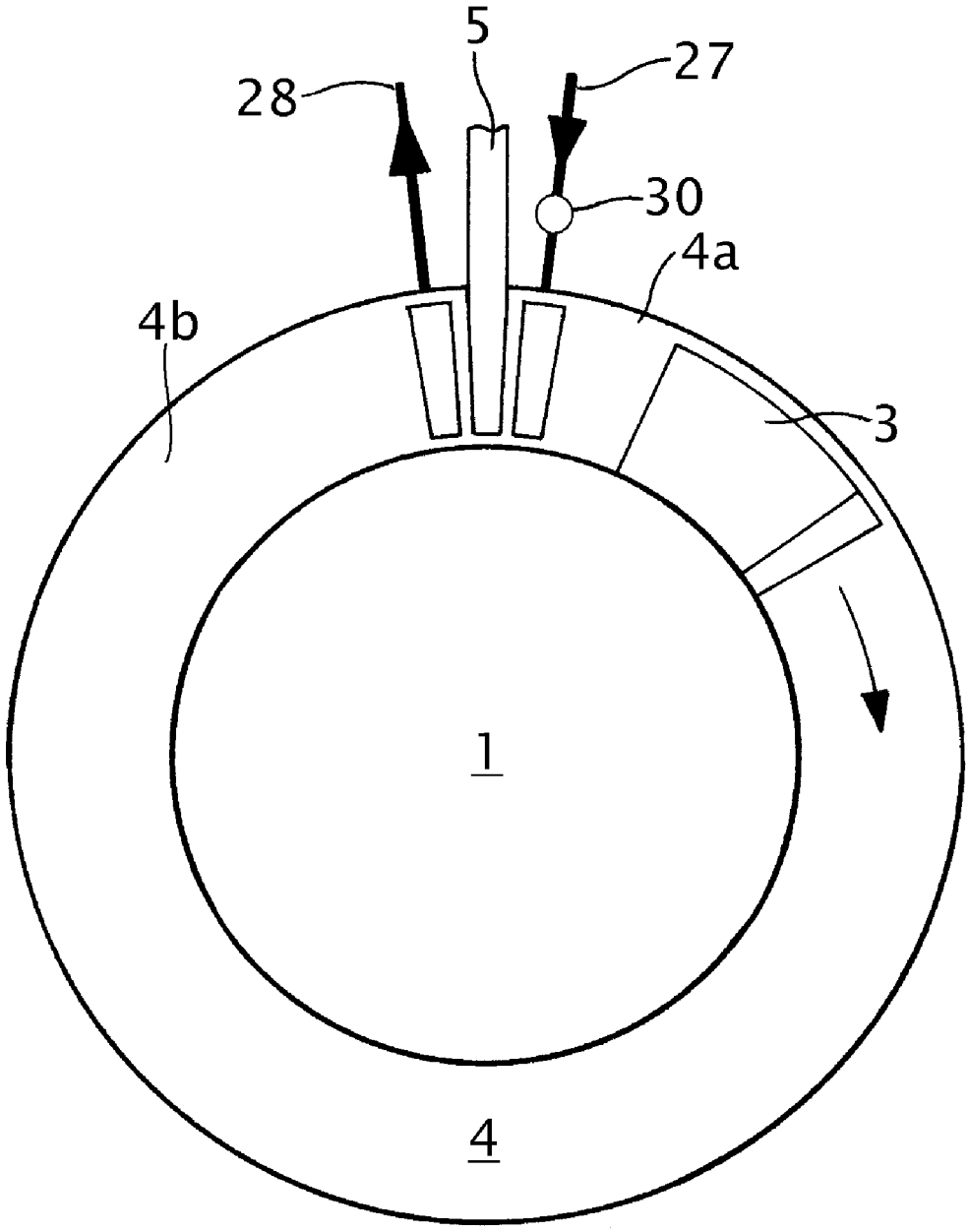
Figure 19:
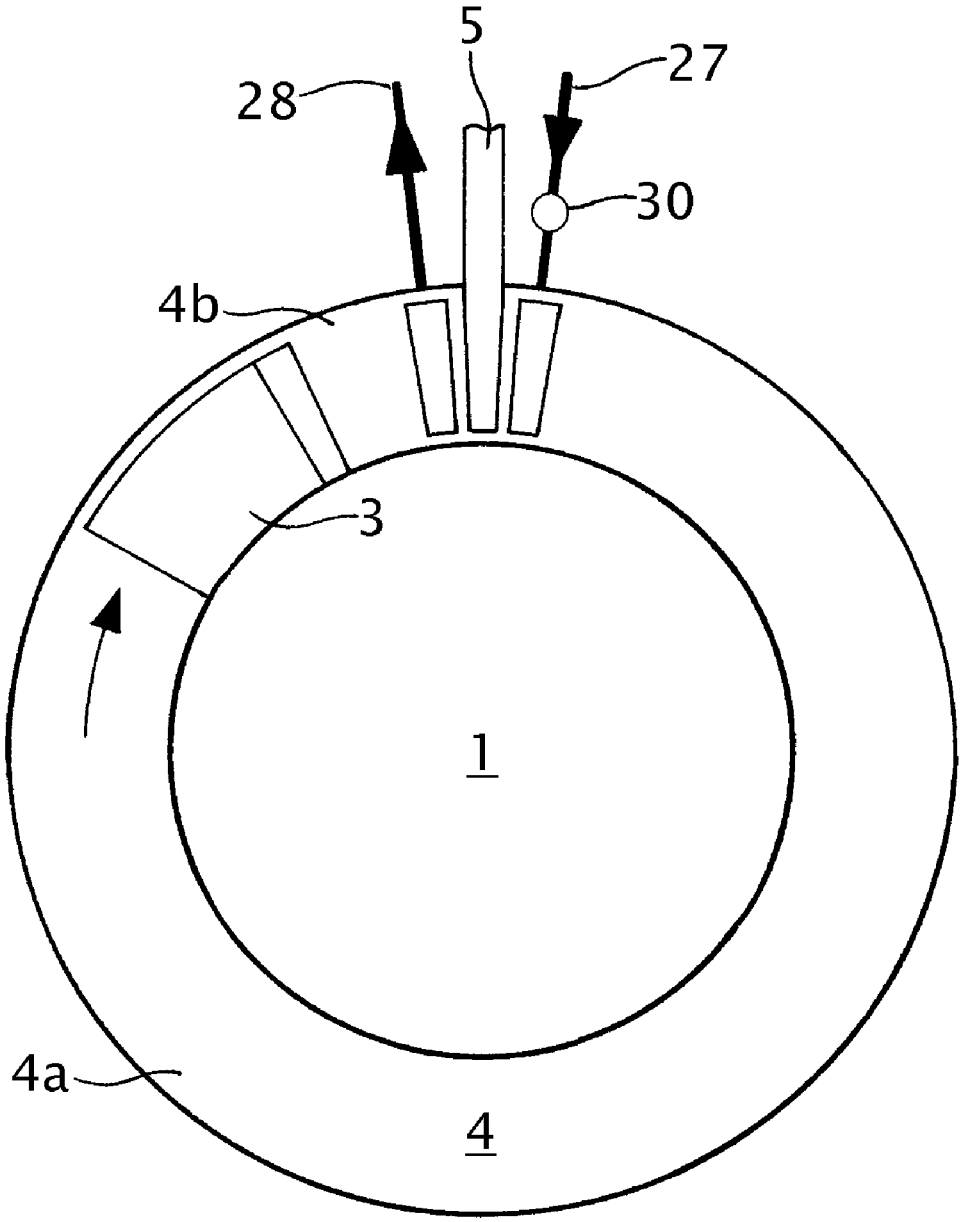

The basic operation of the BTS motor is represented in FIGS. 17 to 19. After traversing slot valve 5, blade 3 is pushed forward by the working fluid flowing into sub-chamber 4*a* through inlet port 27. At the same time, the advancing blade pumps the fluid used by the previous stroke out of sub-chamber 4*b* through outlet port 28. The flap valve on the outlet port is of course not required; instead, a control valve 30 is needed to regulate the flow and (or) pressure of the fluid entering sub-chamber 4*a*, according to the power output required from the BTS motor. The design of the control valve depends on the working fluid used to feed the motor, and on the type of controller used for regulating its power output. The rotary control valve presented in FIGS. 29 and 30 may be adapted for said purpose.

The BTS machine can also be implemented as an internal or external combustion engine. When implemented as internal combustion engine, the BTS machine can follow the conventional Otto or Diesel cycles. For the Diesel cycle, the machine may require closer manufacturing tolerance and/or enhanced sealing for the housing, rotors and slot valves.

For the sake of simplicity, the following description corresponds to an Otto-cycle combustion engine in two basic variants: double-rotor with shared rotary slot valve, and single-rotor. Other variants are possible, e.g. by changing the number and location of the slot valves, and the number of blades and rotors.

Contrary to conventional engines and many alternative designs, in the BTS double-rotor variant the expansion ratio can be increased above the compression ratio, which allows to extract more power from the combustion gases.

Figure 20:
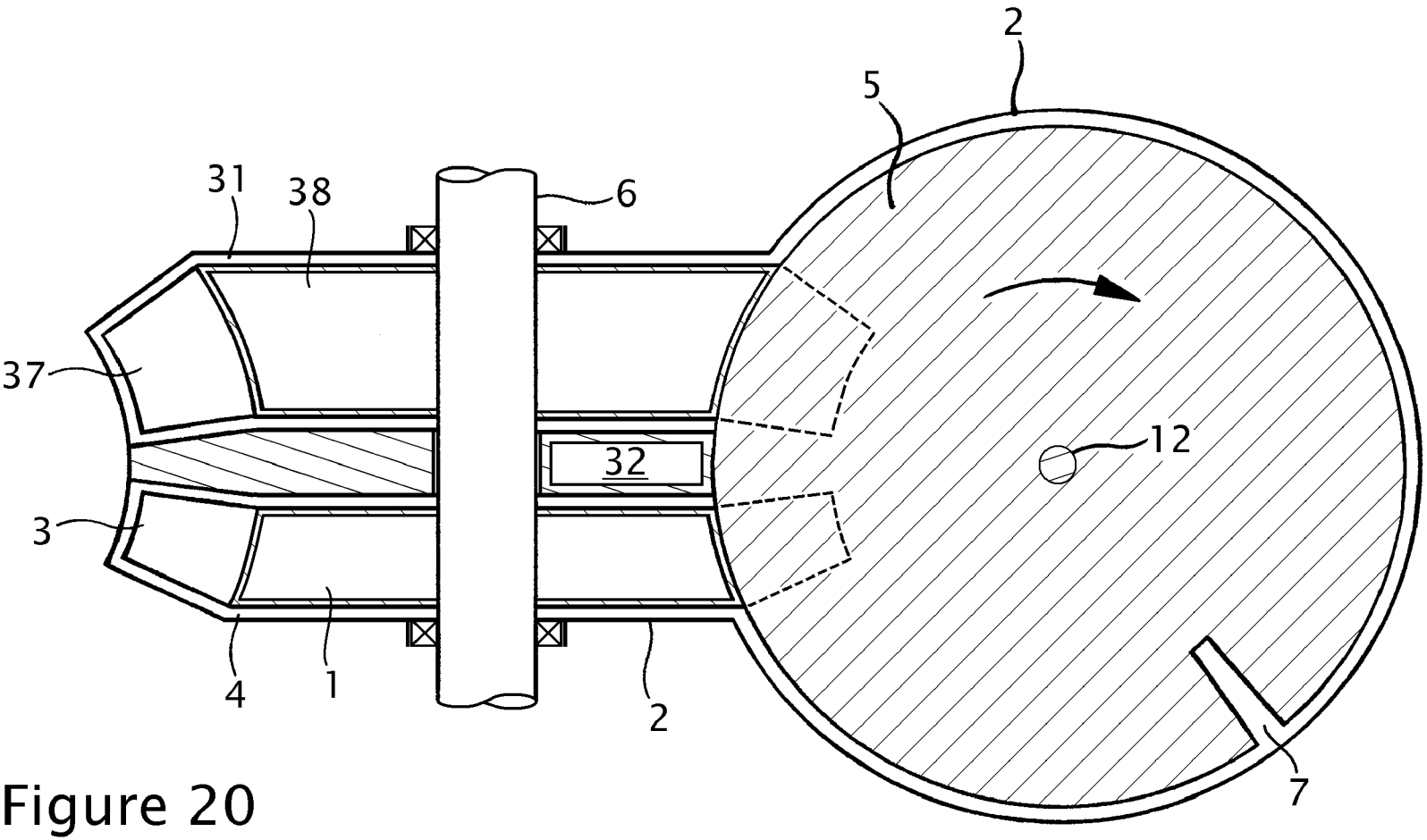
FIG. 20: Sectional plan view of the dual-rotor BTS internal combustion engine.

In the double-rotor implementation (FIG. 20), a BTS compressor and a BTS motor are mounted on the same main shaft and share a rotary slot valve. All elements of the compressor and motor implementations described above are present, but some modifications are necessary as explained below. New elements are also required, i.e. a combustion chamber, a fuel injector and a spark plug.

As already mentioned, the volume of expansion chamber 31 can be made higher than the volume of compression chamber 4; the purpose is to allow the combustion gases to expand more and thus produce more power than in conventional piston engines.

The axial separation between chambers 4 and 31 provides the delay necessary for the ignition and combustion of the air-fuel mixture; such separation also provides space for slot 7 to recede from compression chamber 4 and emerge in expansion chamber 31.

Figure 31:
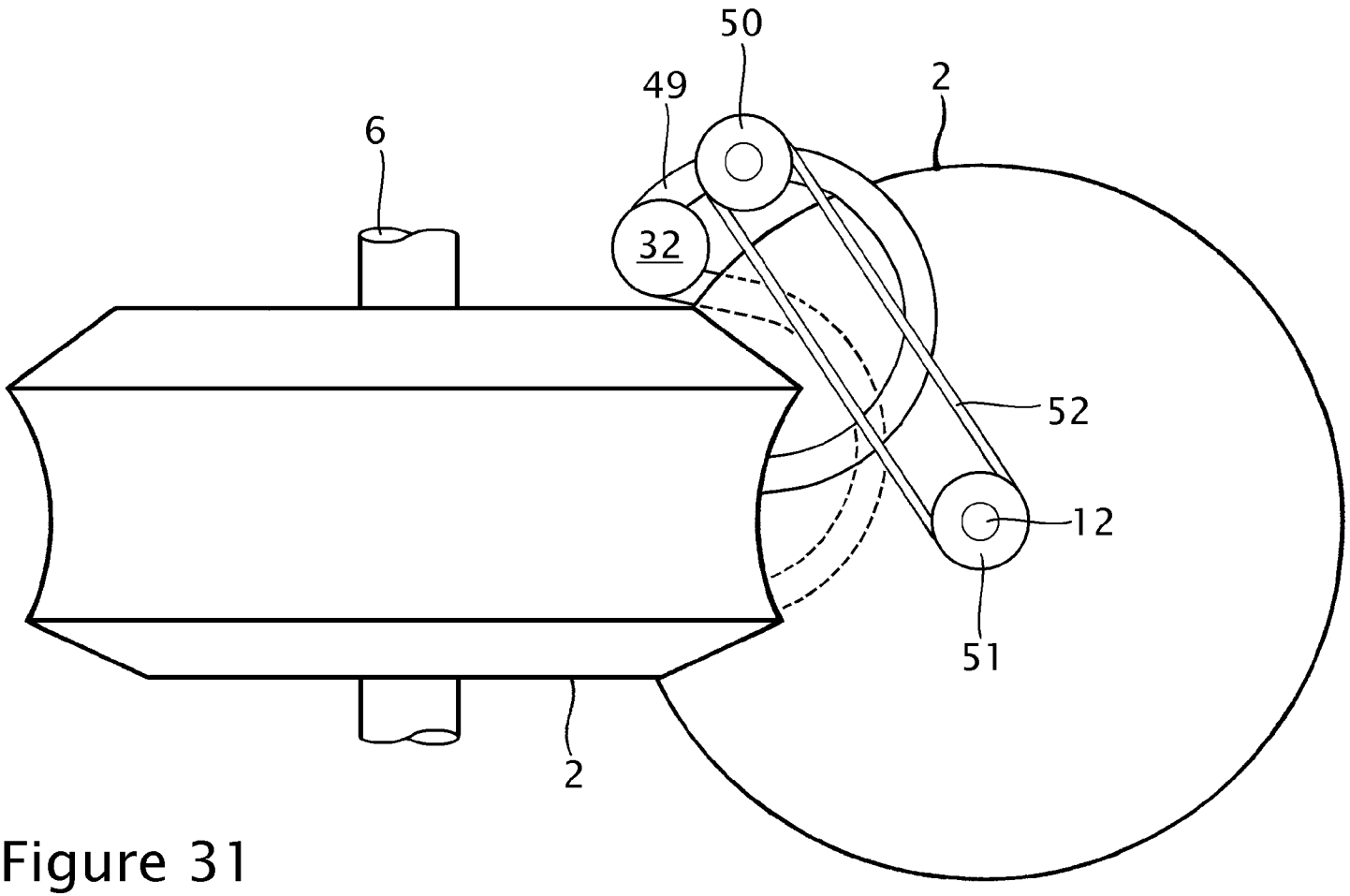
FIG. 31: Plan view of the BTS dual-rotor engine, showing the combustion chamber, its inlet and outlet pipes, and control valve.
Figure 32:
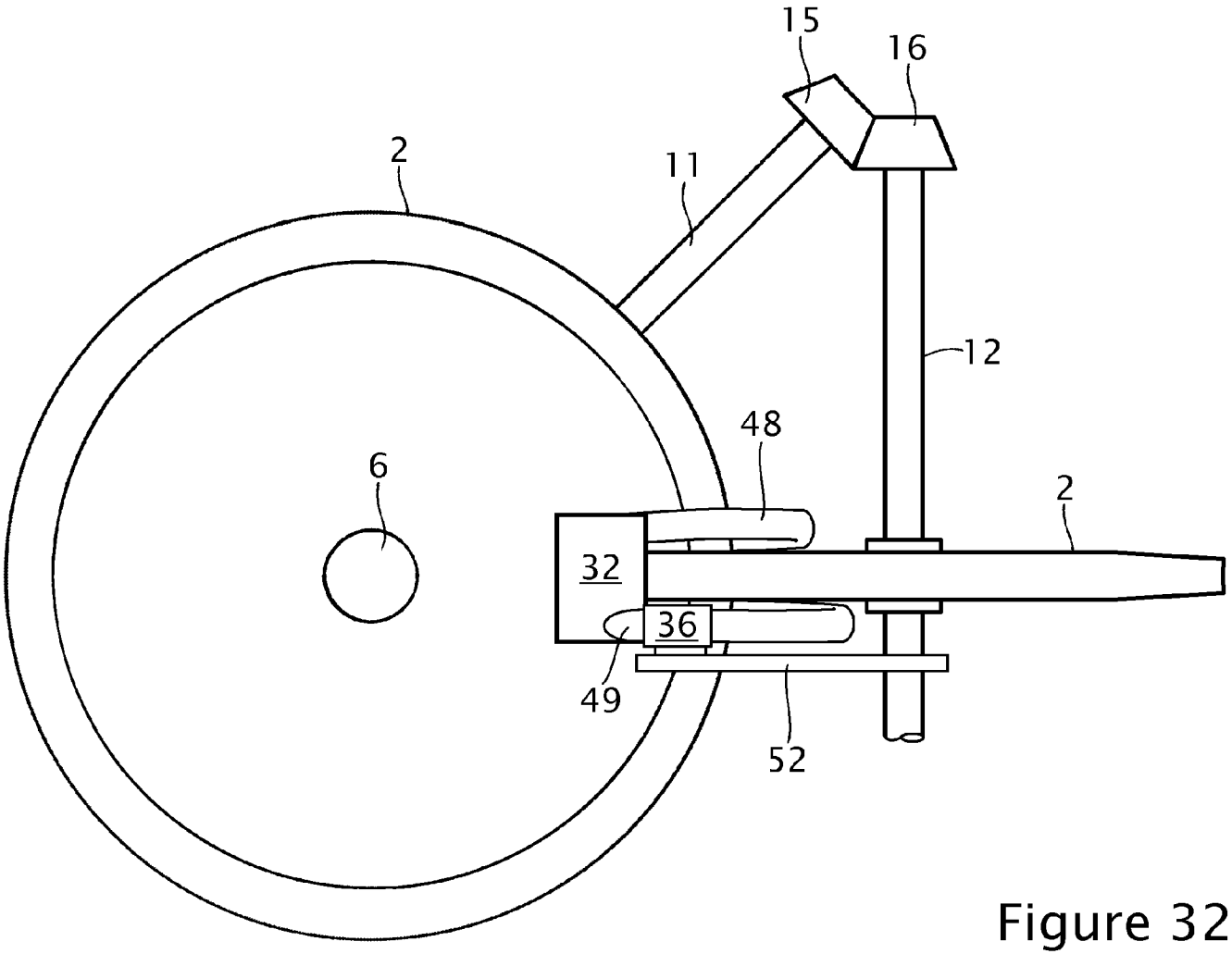
FIG. 32: Front elevation view of the BTS dual-rotor engine, showing the combustion chamber, its inlet and outlet pipes, and control valve.

Combustion chamber 32 can be integrated into the housing, between the rotors (FIG. 20), or kept as an external unit (FIGS. 31 and 32). The following description only considers the case of an external combustion chamber.

Figure 21:
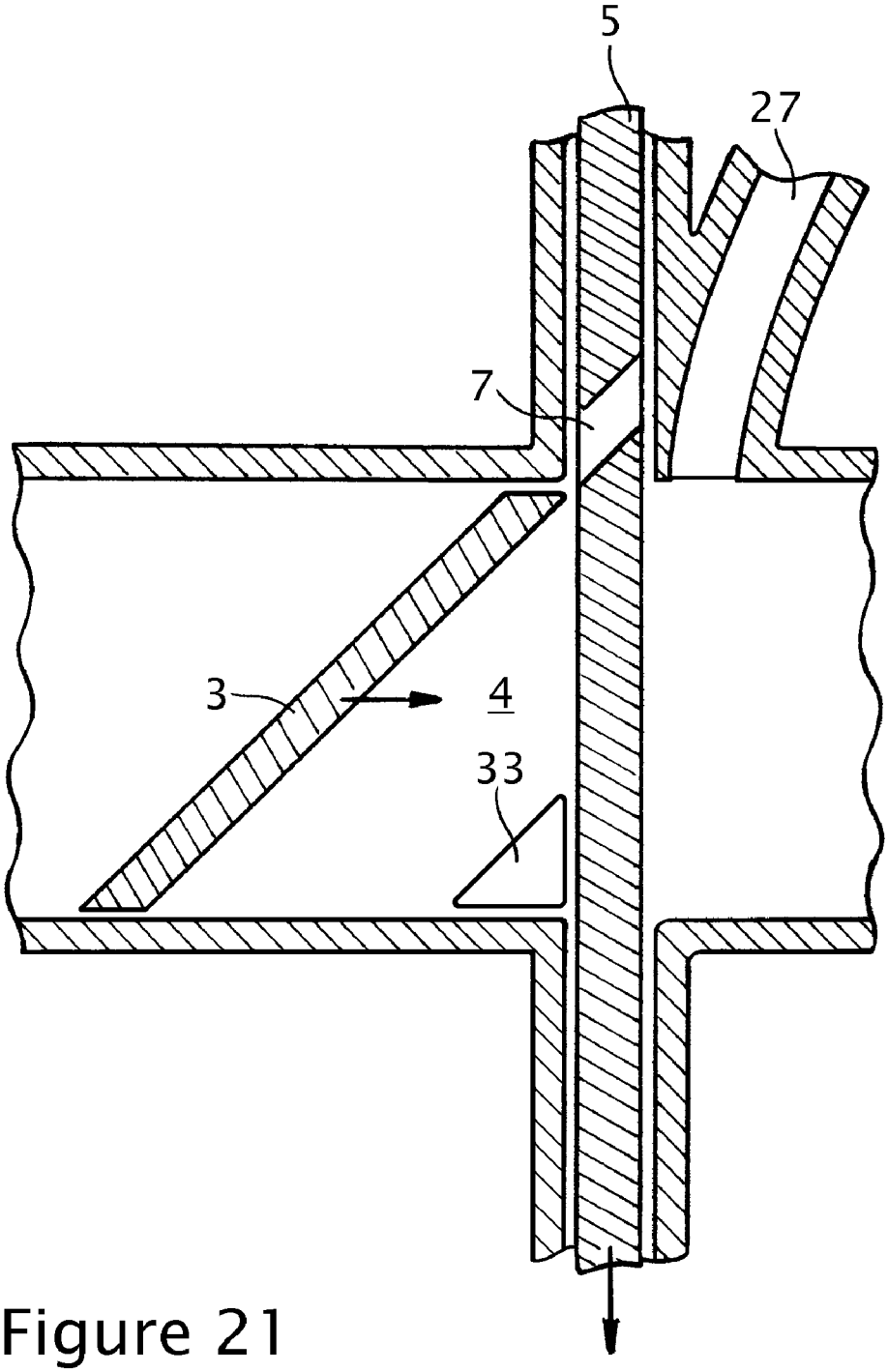
FIG. 21: Sectional view of the blade, slot valve, inlet and outlet ports (compression side of the BTS dual-rotor engine)
Figure 22:
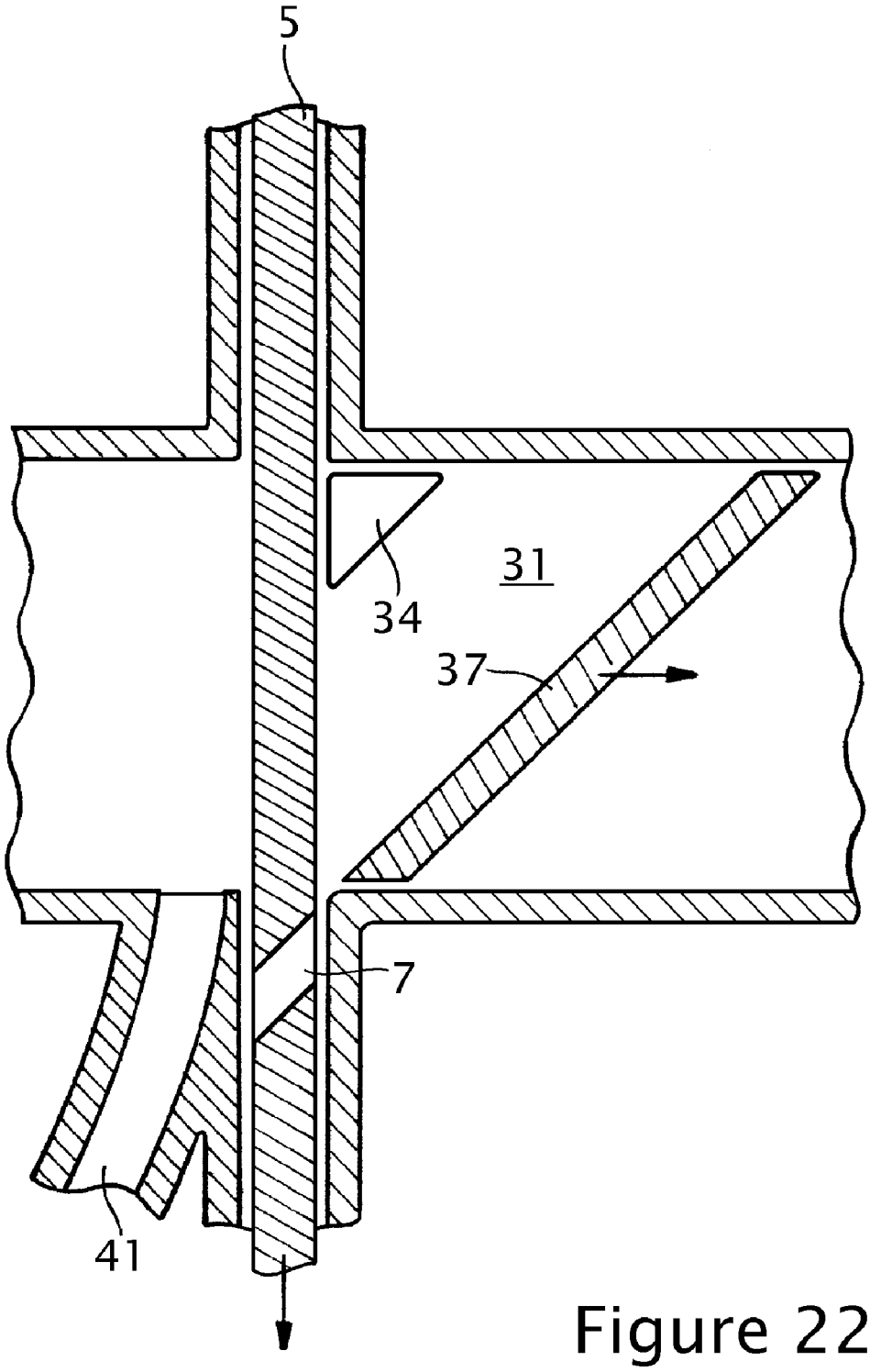
FIG. 22: Sectional view of the blade, slot valve, inlet and outlet ports (expansion side of the BTS dual-rotor engine)

As indicated in FIG. 21, the compressor's outlet port 33 and flap valve (not shown) are now located on the outer wall of compression chamber 4, and have a triangular cross section. The same applies to inlet port 34 of expansion chamber 31, as shown in FIG. 22.

Figure 23:
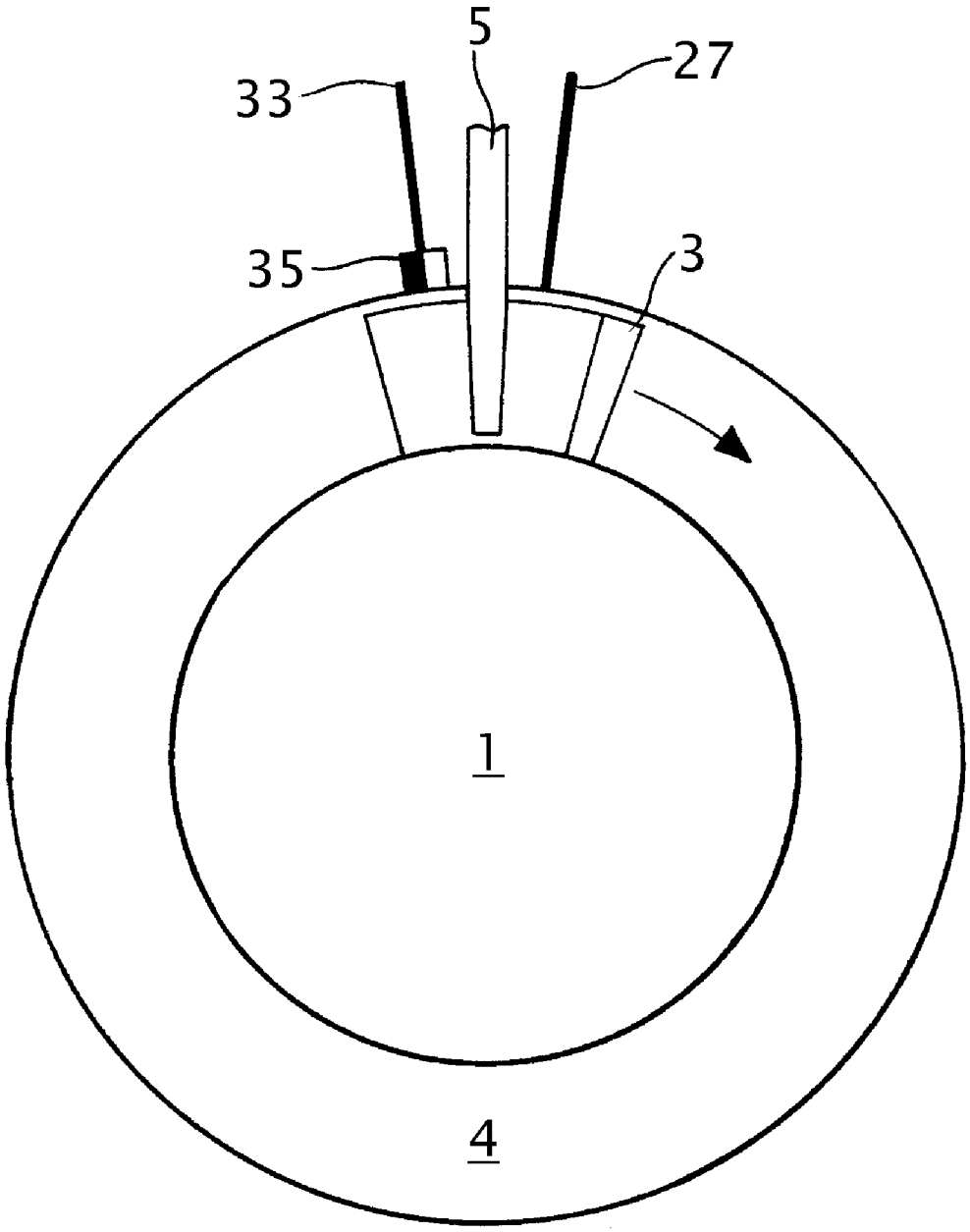
FIG. 23 to 25: Sectional front view of three different stages of the intake/compression stroke (BTS dual-rotor engine)
Figure 24:
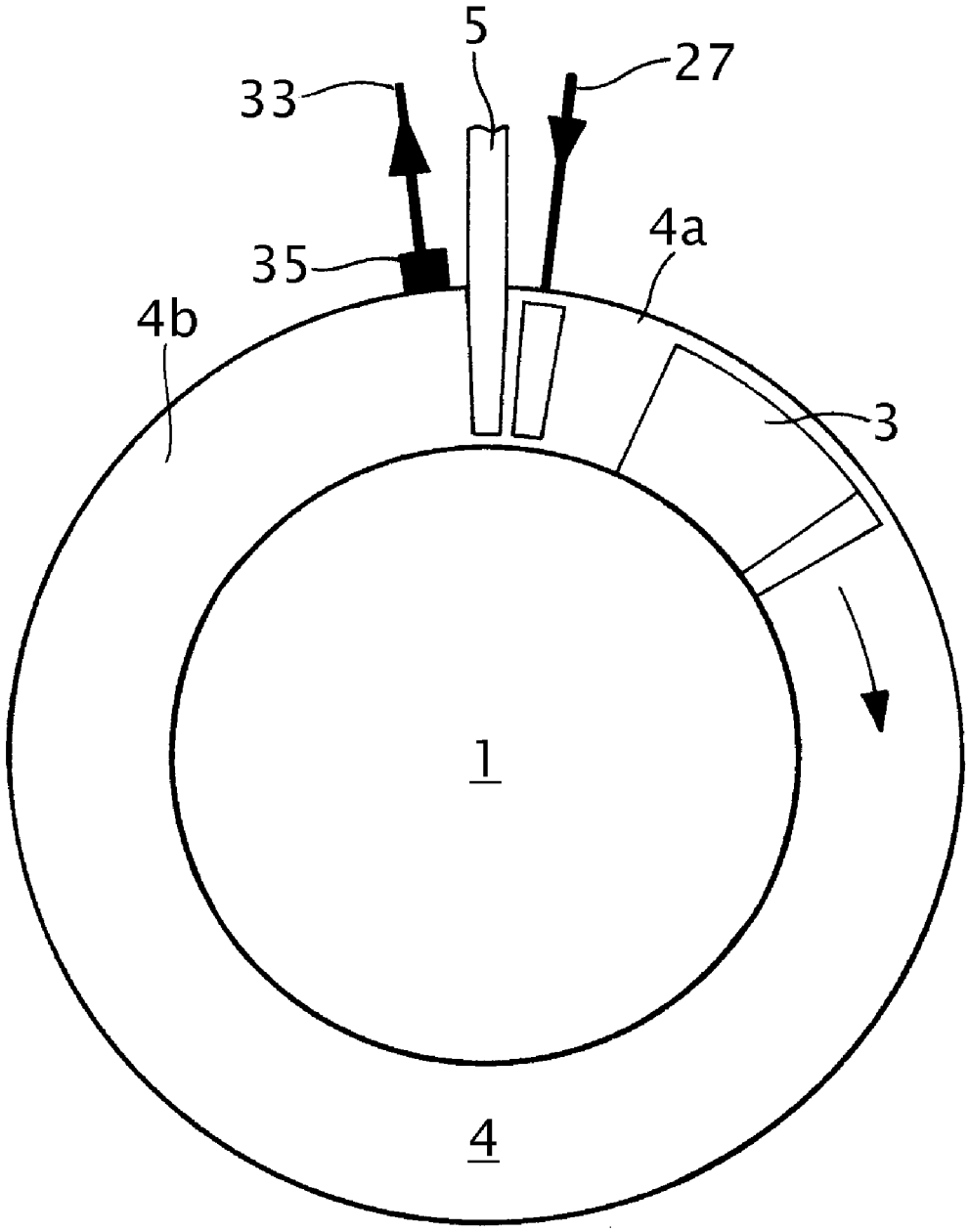
Figure 25:
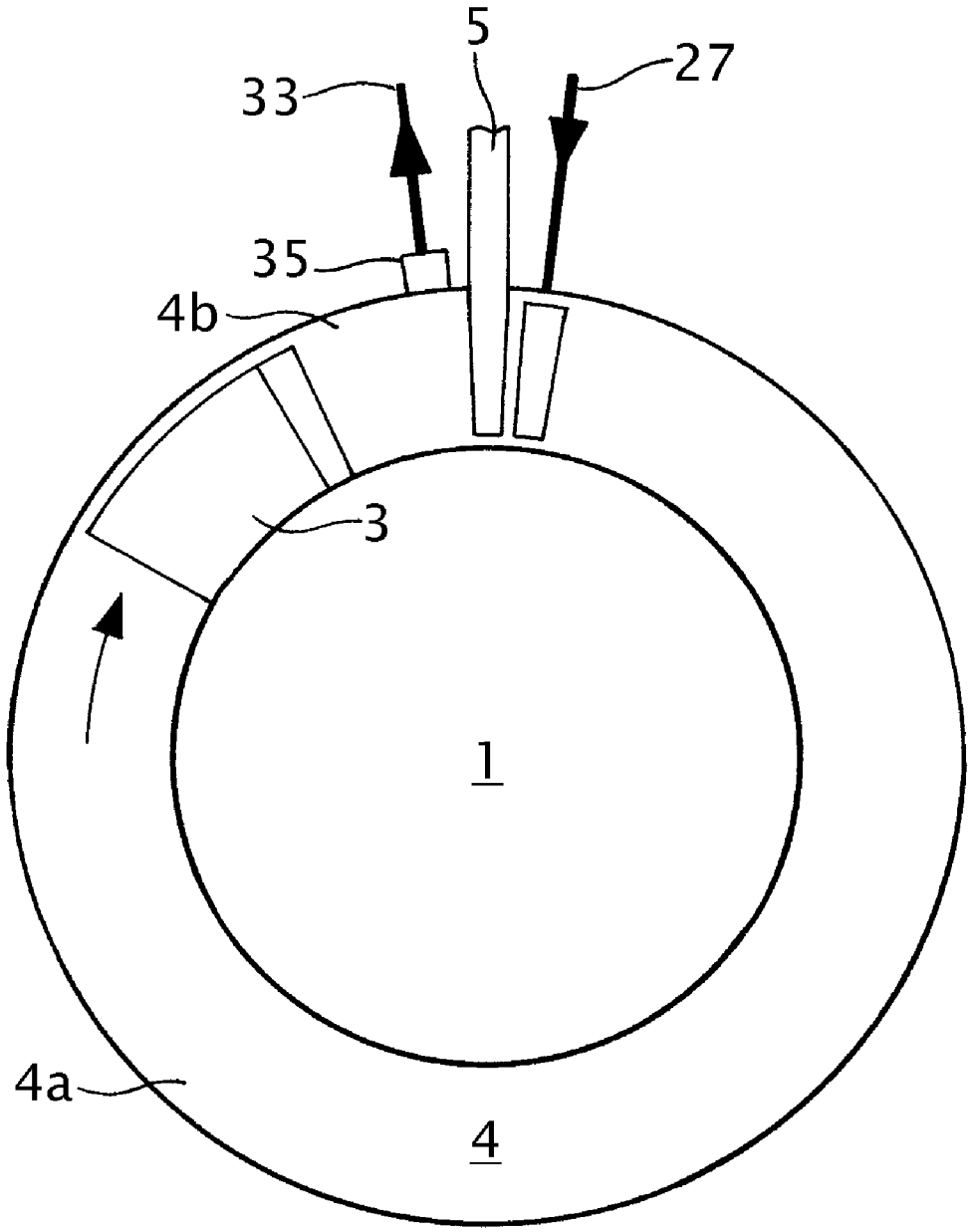

The operation of the compression side of the engine is presented in FIGS. 23 to 25. After traversing slot valve 5, the advancing blade 3 aspires air into sub-chamber 4*a* through inlet port 27; at the same time the blade compresses air in sub-chamber 4*b* and pumps it out through outlet port 33. Flap valve 35 closes when the blade passes by.

FIG. 25 to 28 illustrate the interaction between flap valve 35, control valve 36, and blade 37 on expansion rotor 38. Since the flap valve is merely a non-return valve, it remains closed until the pressure in the compression sub-chamber (4*b* in FIG. 25) is the same as the pressure in combustion chamber (32 in FIG. 26). Thus, control valve 36 should remain open until the above condition is just to be met; a simple design to achieve this functionality is explained later on.

Figure 26:
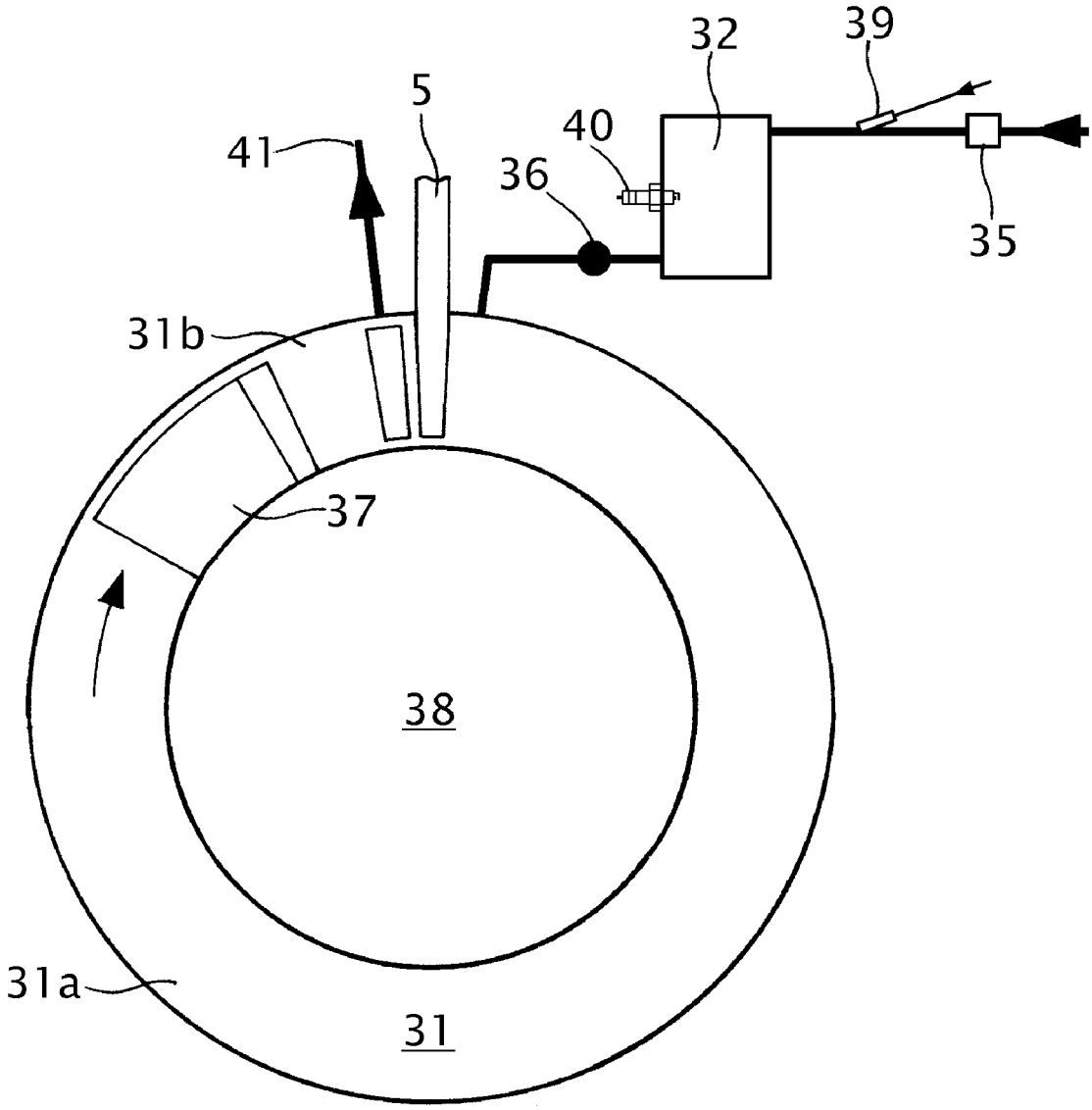
FIG. 26 TO 28: Sectional front view of three different stages of the expansion/exhaust stroke (BTS dual-rotor engine)

In FIG. 26 control valve 36 has already closed and flap valve 35 has just opened; compressed air is being pumped out from the compression sub-chamber (4*b* in FIG. 25) and squeezed into combustion chamber 32; injector 39 has started spraying fuel into the air stream. Air flow from the compression sub-chamber continues until blade 3 just covers outlet port 33 (FIG. 21) and flap valve 35 closes. At this point the fuel injector closes and spark plug 40 ignites the air-fuel mixture trapped in the combustion chamber.

Figure 27:
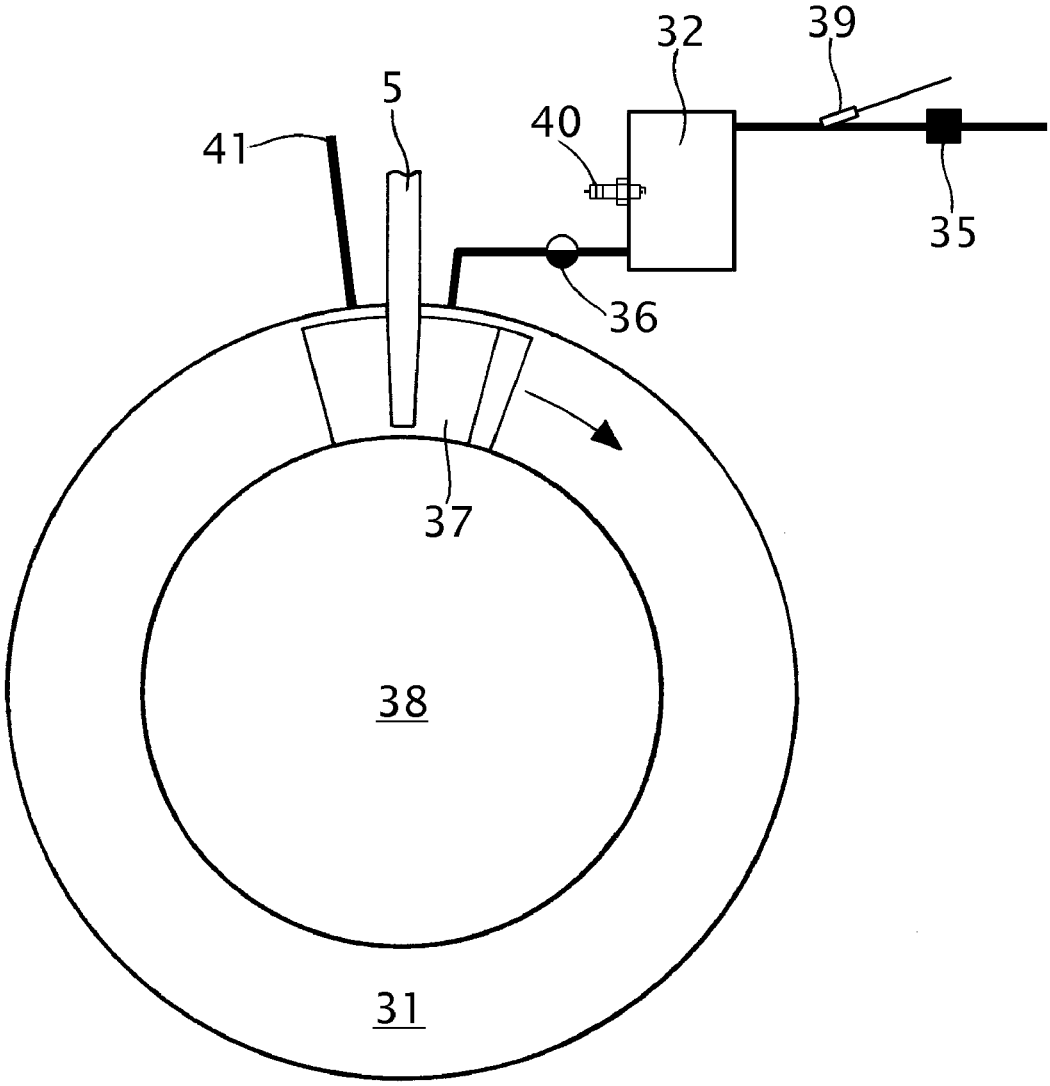

In FIG. 27, the combustion is well advanced, blade 37 on the expansion rotor is traversing slot valve 5 and control valve 36 is opening.

Figure 28:
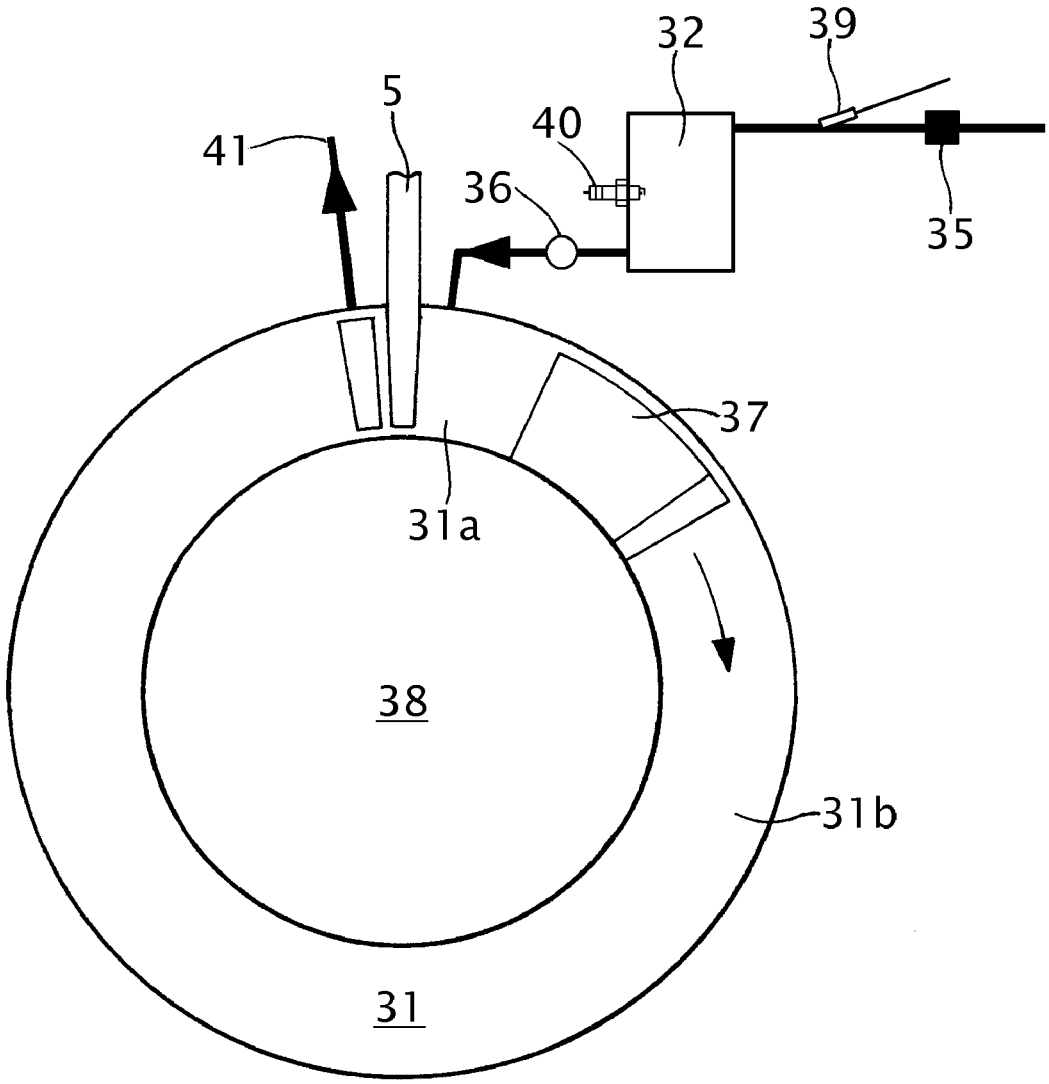

In FIG. 28 the combustion gases are expanding in sub-chamber 31*a* pushing blade 37 forward. The other side of the blade expels the exhaust gases, left in sub-chamber 31*b* by the previous stroke, through outlet port 41.

Figure 29:
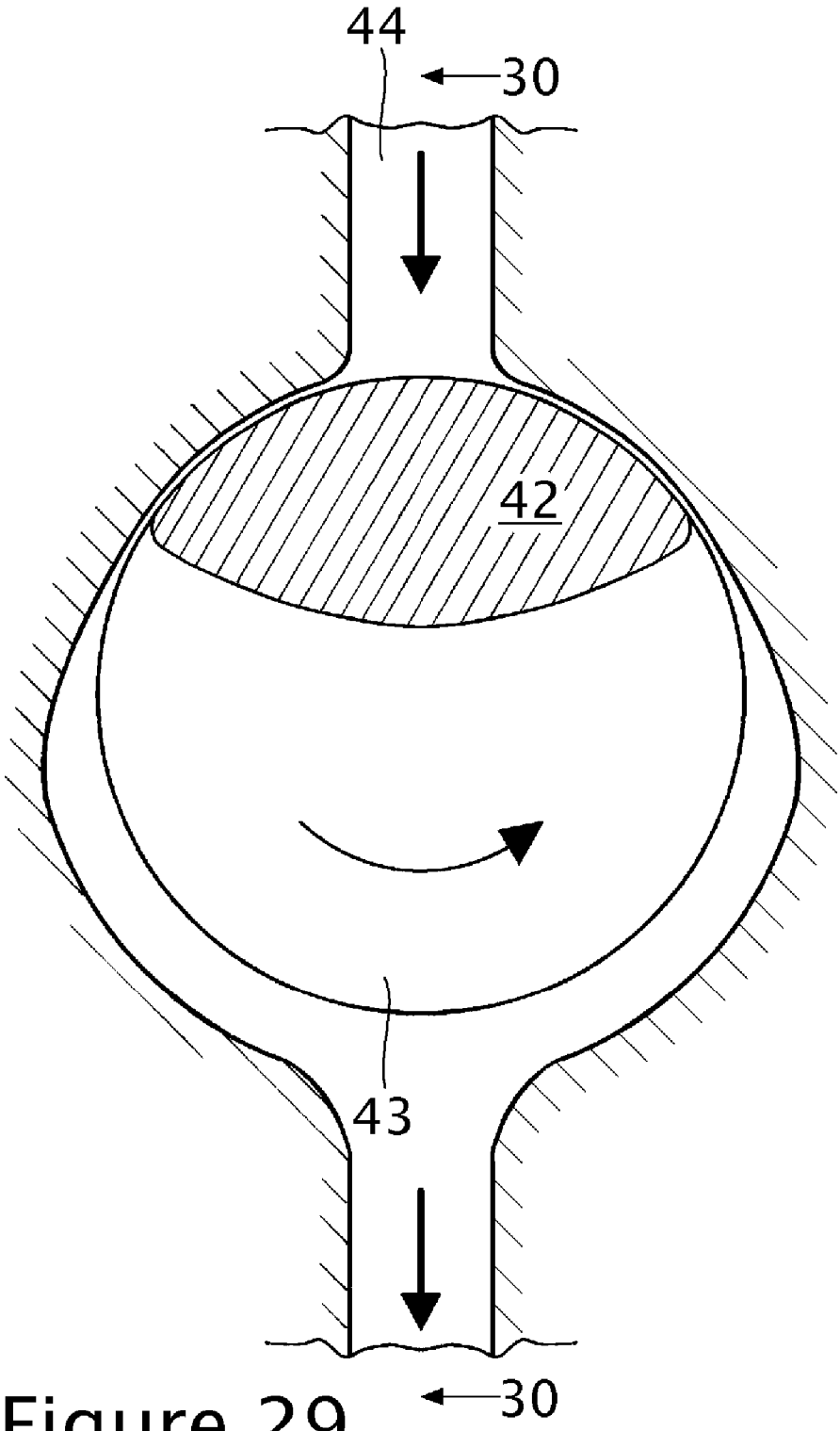
FIG. 29: Sectional view of the rotary control valve along line 29-29 of FIG. 30.
Figure 30:
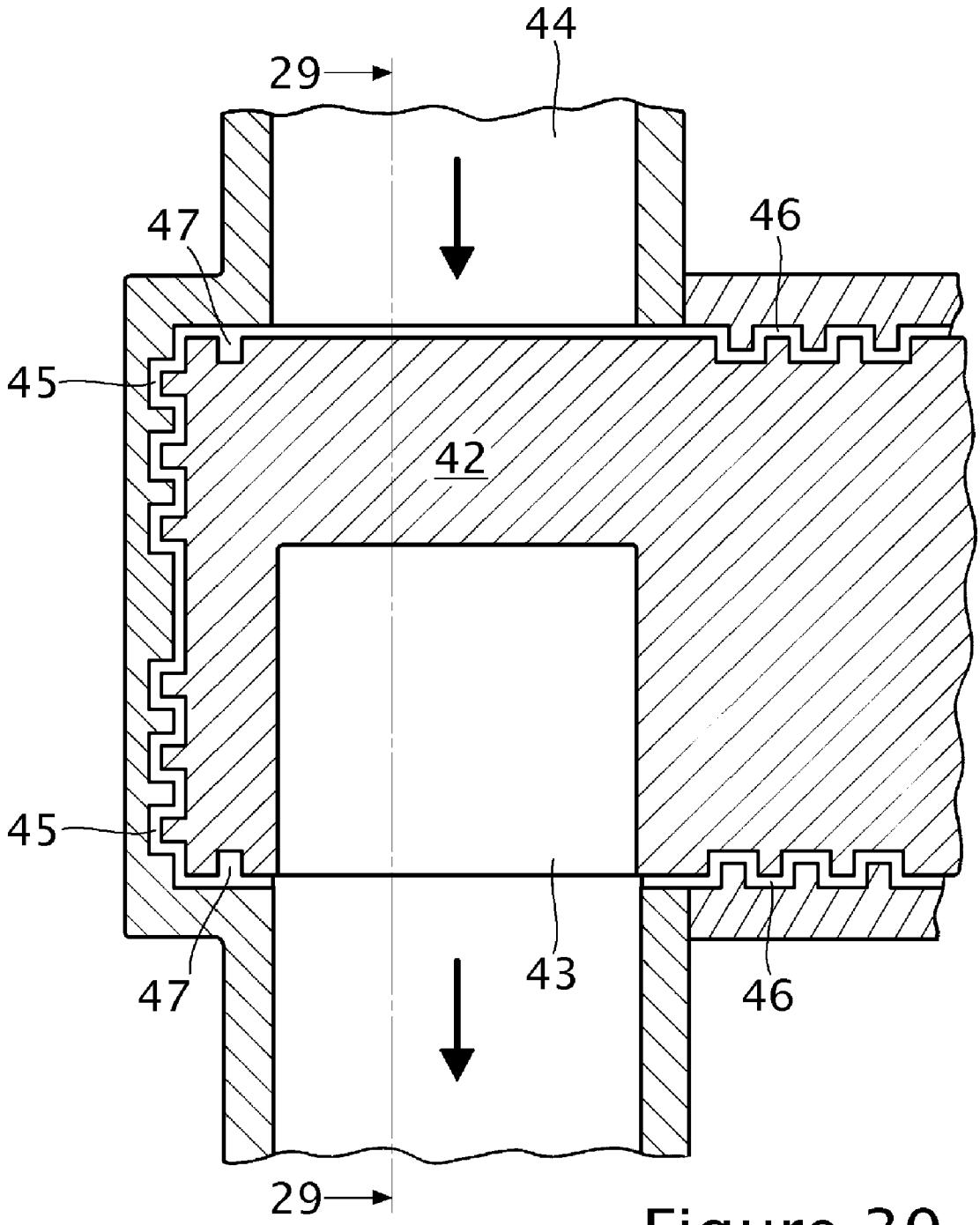
FIG. 30: Sectional view of the rotary control valve along line 30-30 of FIG. 29.

FIGS. 29 and 30 are schematic views of a rotary control valve. Cylindrical rotor 42 runs at the same speed as the engine. Cutout 43 in the rotor allows flow through the valve when passing by inlet port 44 of the valve. Contact seals can be avoided by using labyrinth seals 45 and 46, and groove 47 on the rotor.

FIGS. 31 and 32 schematically show the placement of combustion chamber 32, its inlet pipe 48, outlet pipe 49 and control valve 36. Said valve is driven by shaft 12 through pulleys 50 and 51, and toothed belt 52. A more sophisticated alternative is to drive the control valve with a special computer-controlled servomotor (not shown).

Figure 33:
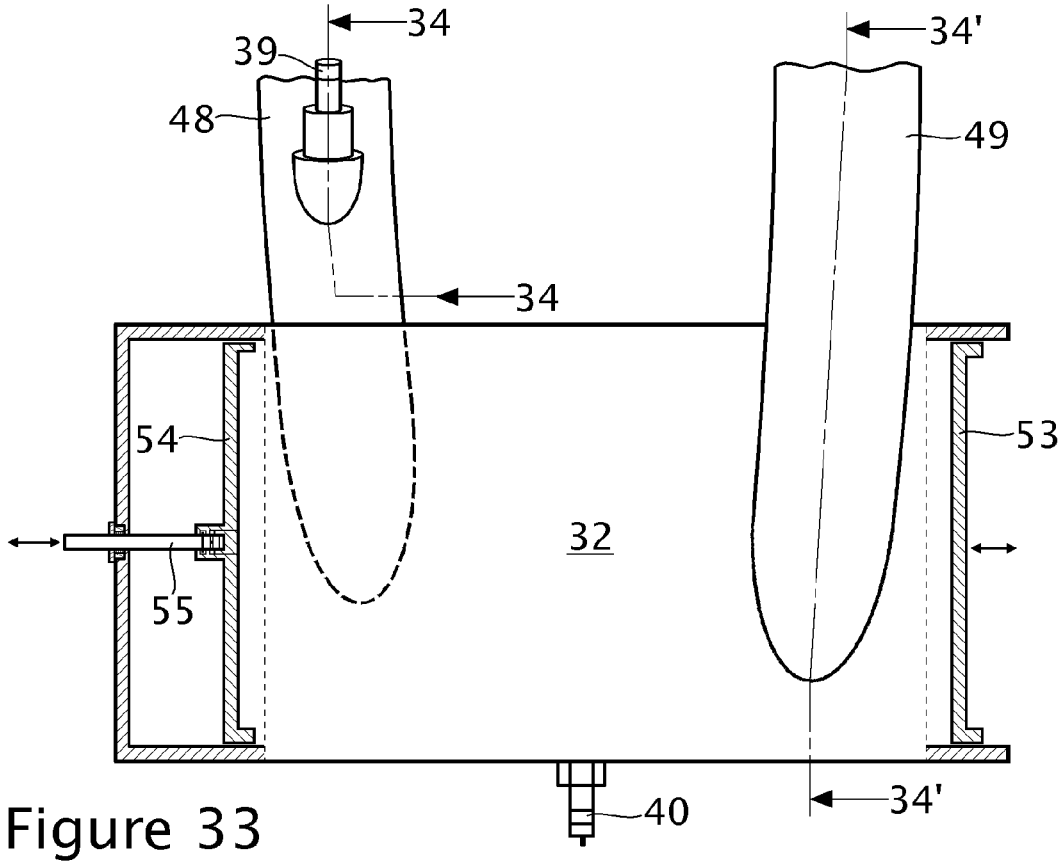
FIG. 33: Sectional view of the combustion chamber showing the injector, spark plug, adjustable side, and variable compression ratio piston and control rod, as seen along line 33-33 of FIG. 34 (BTS dual-rotor engine)
Figure 34:
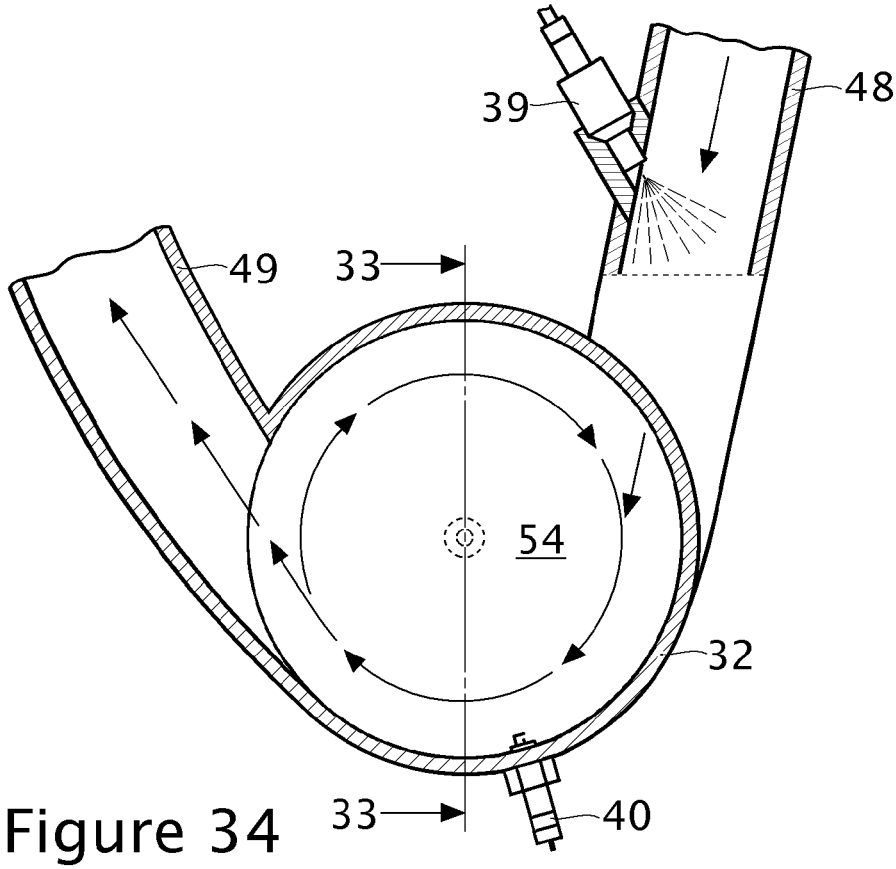
FIG. 34: Sectional view of the combustion chamber showing the injector, spark plug and variable compression ratio piston, as seen along lines 34-34 and 34'-34' of FIG. 33.

The combustion chamber and related components are schematically presented in FIGS. 33 and 34. Compressed air is fed into combustion chamber 32 through inlet pipe 48, after receiving fuel sprayed by injector 39. The inlet pipe connects to the combustion chamber tangentially in order to create a swirl in the way to outlet pipe 49, also connected tangentially to the chamber. The swirl facilitates the vaporization and dispersion of the fuel sprayed into the air stream before reaching spark plug 40. The swirl also helps to achieve good combustion of the mixture after its ignition by the spark plug.

The compression ratio of the engine may be regulated by changing the volume of the combustion chamber (FIG. 33). A simple way is to make side 53 (or both sides) of the chamber moveable in- and outwards; the volume is adjusted with the engine turned off by manually securing the chamber side(s) in the required position.

A more sophisticated system, described below, is intended to change the compression ratio on-demand, during the operation of the engine. Piston 54 in FIG. 33 changes the effective volume of combustion chamber 32 when actuated by control rod 55. The piston fits inside the chamber closely enough to substantially reduce leaks of air/gases around its perimeter, but keeping at the same time its ability to slide smoothly and effortlessly.

Figure 35:
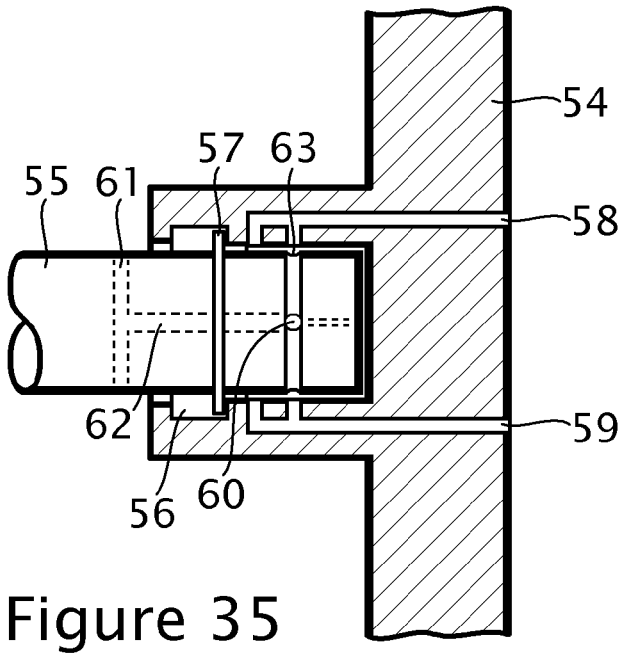
FIGS. 35 and 36: Sectional view of the variable compression ratio piston and control rod in two different relative positions.
Figure 36:
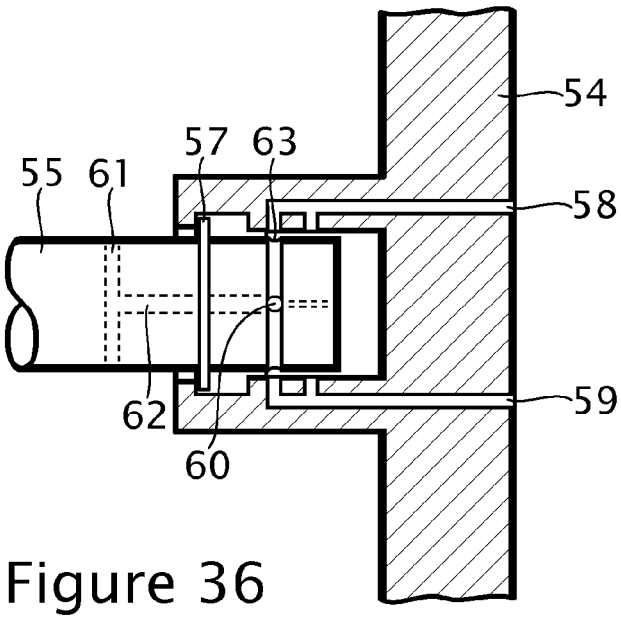
Figure 37:
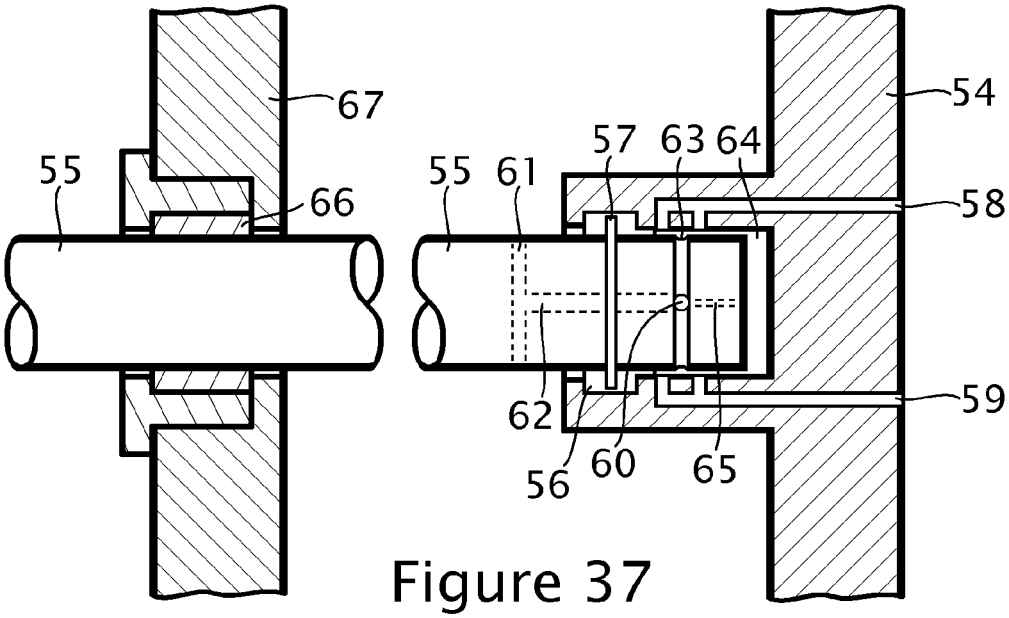
FIG. 37: Sectional view of the variable compression ratio piston, control rod and seal.

FIGS. 35 to 37 present a closer sectional view of the piston and control rod. Piston 54 has a bore for receiving the end of control rod 55; both the bore and the rod end are manufactured to close tolerance. The rod can slide in or out of the bore within the limits set by chamber 56 and ring clip 57 fixed to the rod. Radial passages 60 and 61 connect to passage 62, drilled along the axis of the rod.

When control rod 55 is pushed inwards (FIG. 35), air/gases can flow from one side of piston 54 to the other through passages 58 to 62 and cutout 63, equalizing the pressure and thus facilitating the movement of the piston by the rod. The same happens when the rod is pulled outwards, as illustrated in FIG. 36.

When the control rod stops, and as a result of the cyclic pressure changes in the combustion chamber, the piston tends to adopt the central position relative to the rod, shown in FIG. 37; in this position the flow of air/gases through the passages is blocked by the rod.

Chamber 64 (FIG. 37) is used as pneumatic damper to inhibit the oscillation of piston 54 caused by the cyclic pressure variations in the combustion chamber. The diameter of axial passage 65 is small enough to produce said damping effect but sufficient for a good response to control rod 55.

A contact seal 66 (FIG. 37) is necessary to avoid leaks between the control rod and side 67 of the combustion chamber.

Figure 38:
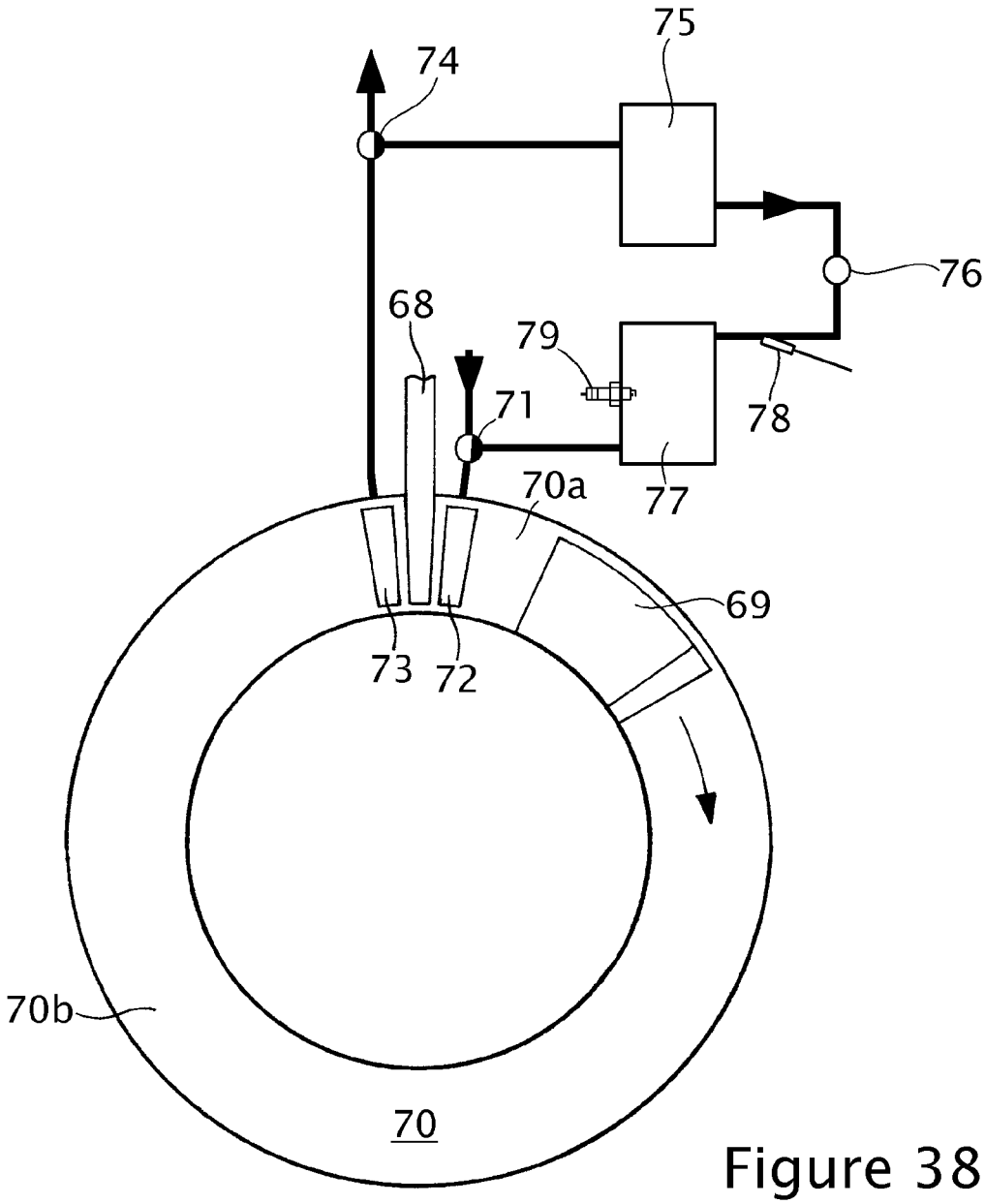
FIGS. 38 to 41: Sectional front view of four different stages of the intake/compression and expansion/exhaust strokes (BTS single-rotor engine)
Figure 39:
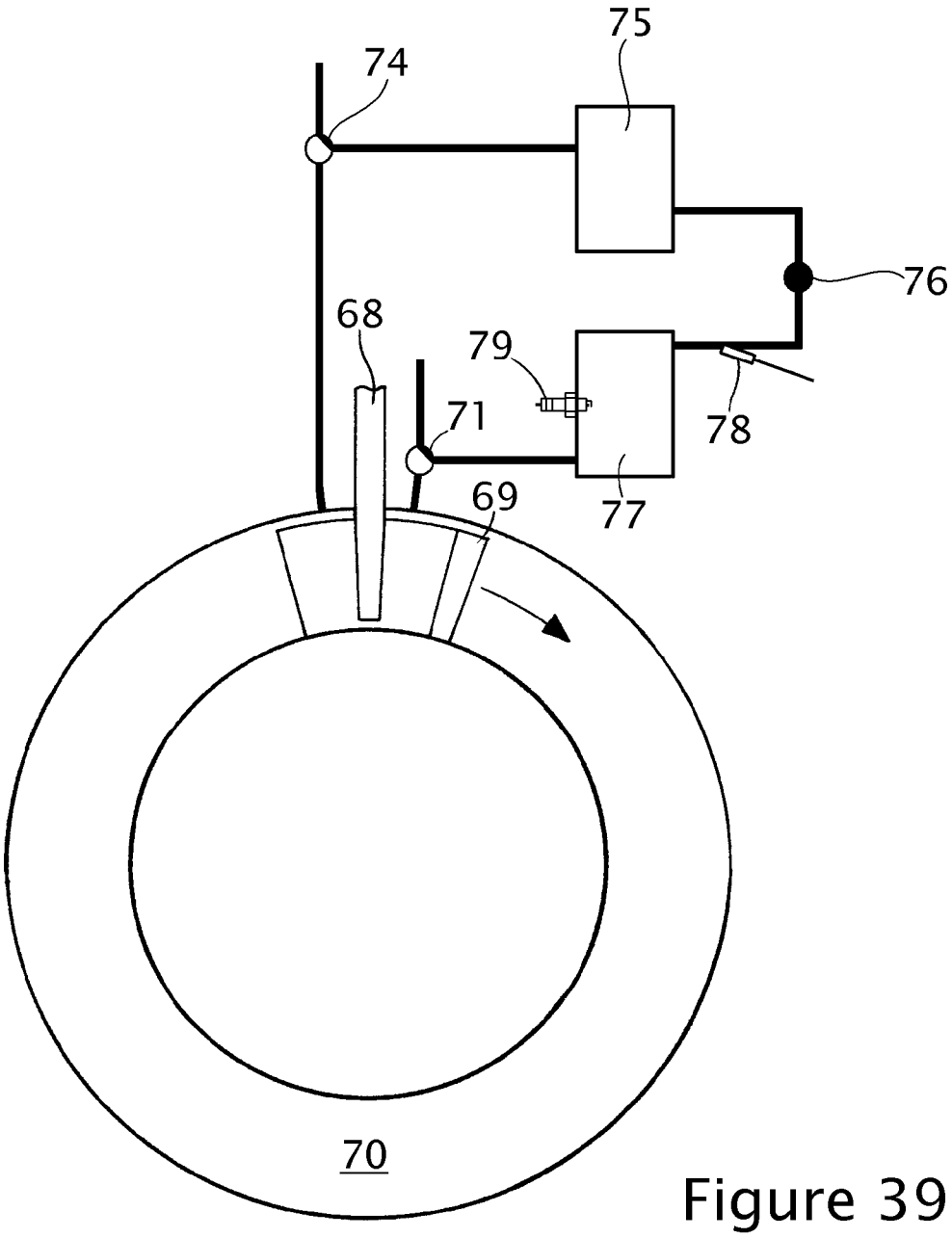
Figure 40:
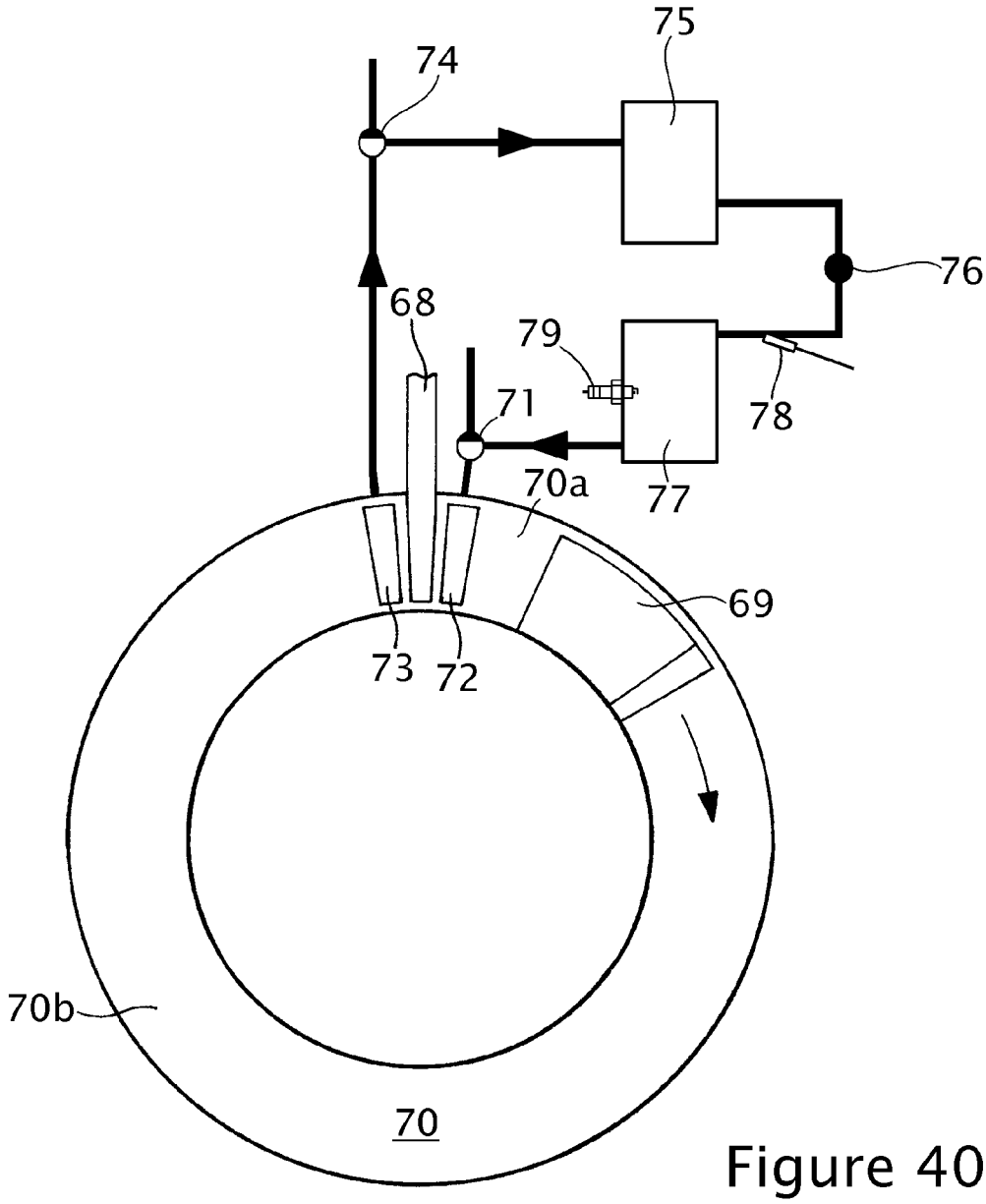

In the single-rotor implementation, the BTS engine consecutively performs an intake/exhaust stroke and a compression/expansion stroke, as schematically presented in FIGS. 38 to 40. Most elements are common to the already explained double-rotor engine, but some modifications and new elements are necessary.

After traversing slot valve 68 (FIG. 38), advancing blade 69 aspires air into sub-chamber 70*a* through inlet control valve 71 and inlet port 72. At the same time the other side of the blade expels the gases left in sub-chamber 70*b* by the previous expansion stroke; such gases pass through outlet port 73 and are directed by outlet control valve 74 to the exhaust pipe. In the meantime compressed air, pumped into storage chamber 75 by the previous compression stroke, is released by transfer valve 76 into combustion chamber 77, and fuel is sprayed into the air stream by injector 78. As pressure equalizes in both chambers, transfer valve 76 closes and spark plug 79 ignites the air-fuel mixture.

FIG. 39 shows the transition from the intake/exhaust stroke to the compression/expansion stroke. Outlet control valve 74 is in the process of closing the outlet flow to the exhaust pipe and redirecting it to storage chamber 75. At the same time, combustion in chamber 77 is in the final stage.

Inlet control valve 71 is closing the inlet flow from the intake pipe and ready to releasing the combustion gases to inlet port 72 (not shown). The blade is seen traversing the slot valve.

Figure 41:
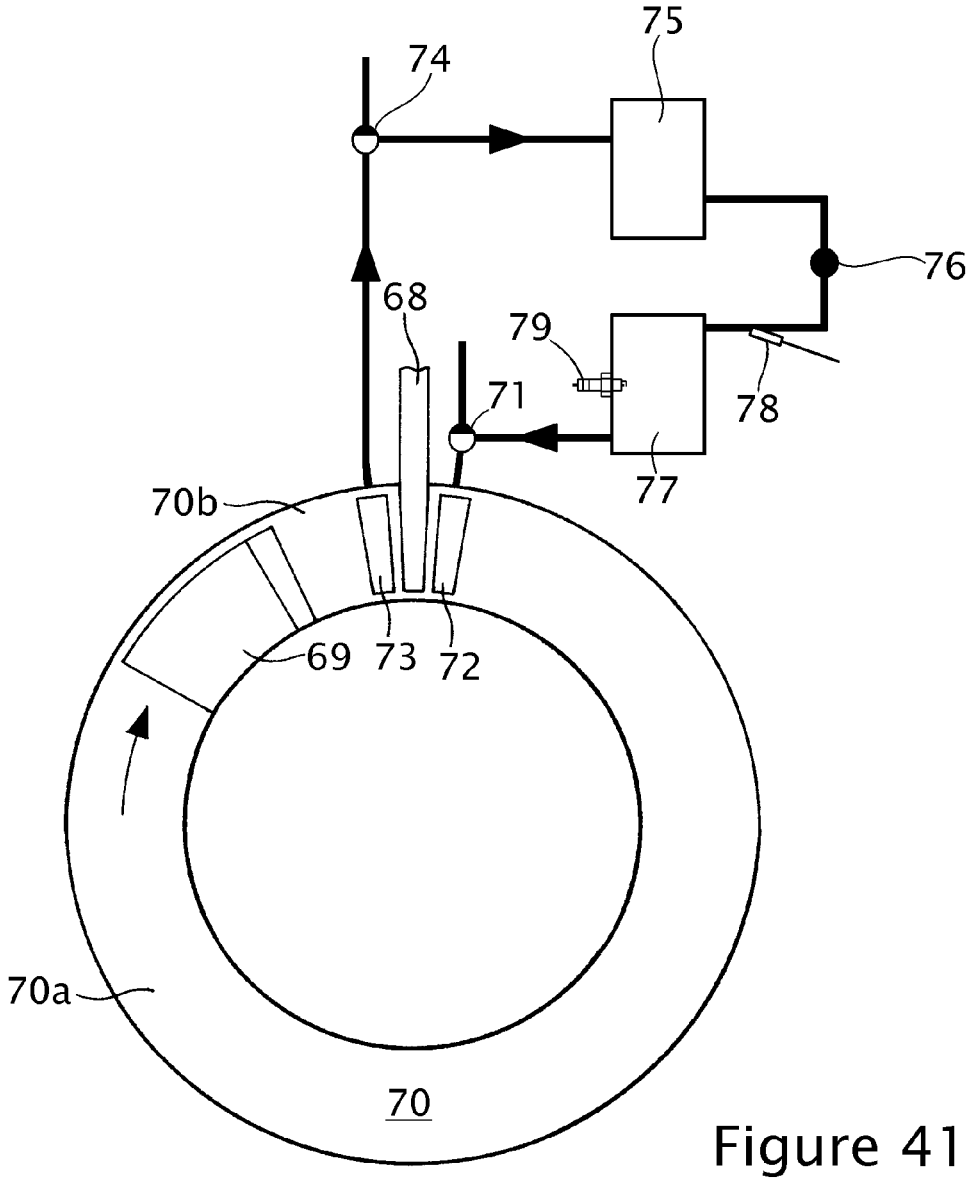

In FIG. 40 the combustion gases expand in sub-chamber 70*a*, pushing blade 69 forward. The other side of the blade compresses the air from the previous intake stroke and pumps it through outlet 73 and outlet control valve 74 into storage sub-chamber 75. FIG. 41 shows the expansion/compression stroke close to its completion; the blade will soon traverse the slot valve again and start a new intake/exhaust stroke as shown in FIG. 39.

Transfer valve 76 is in fact the same control valve 30 used in the double-rotor engine, thus the rotary design presented in FIGS. 29 and 30 is also applicable here.

Figure 42:
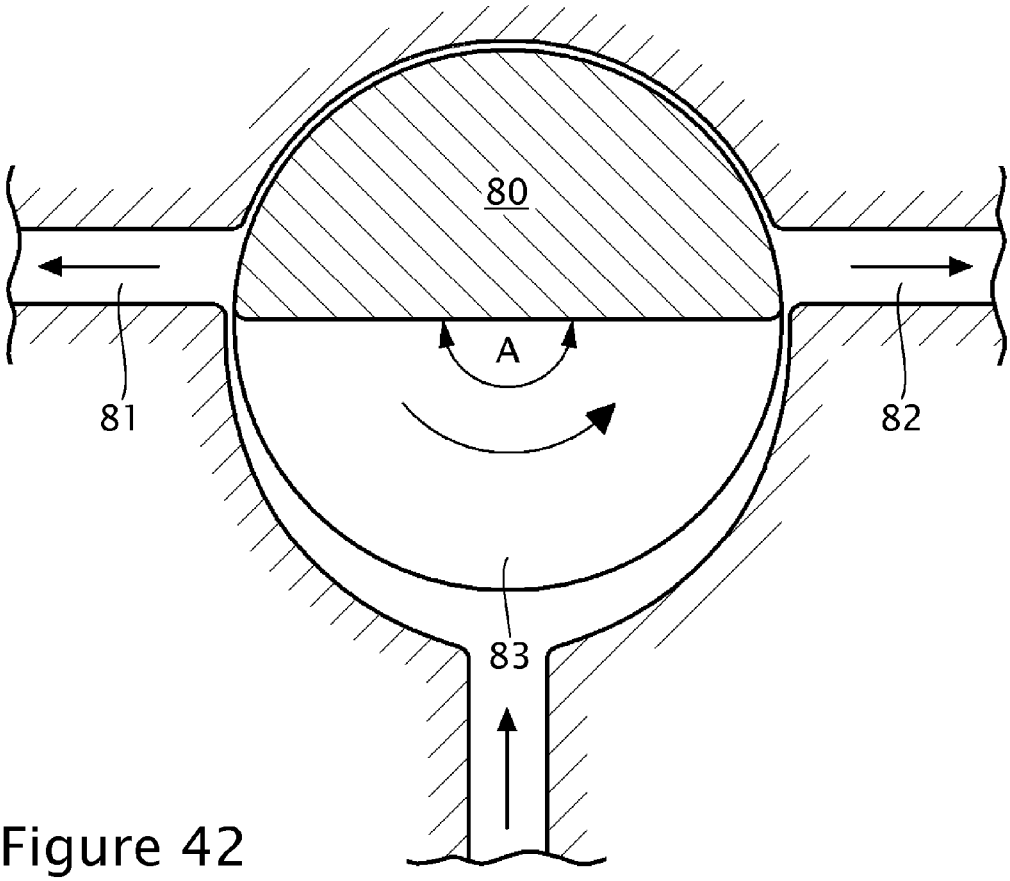
FIG. 42: Sectional view of the rotary inlet/outlet control valve (BTS single-rotor engine).

In the case of inlet/outlet control valves 71 and 74, some modifications to the above mentioned design are required (FIG. 42). Cylindrical rotor 80 must run at half of the engine's speed. Fine adjustments in flow timings can be achieved by changing angle A and the position of outlet ports 81 and 82 relative to cutout 83.

The compression ratio of the single-rotor engine may be regulated in the same way as the double-rotor engine (FIGS. 33 and 35 to 37). The only difference is that the volume changes are made in the storage chamber and not in the combustion chamber.

The power output of BTS Otto-cycle engines may be controlled by regulating the air intake with a conventional throttle valve in the inlet pipe, and by adjusting the fuel injection rate. The management of the entire combustion process—which may also include injection timing, spark timing, and oxygen monitoring in exhaust gases—may be performed by a conventional engine control unit and associated sensors. The control unit's algorithms and lookup tables must of course be specifically developed for each particular family of BTS engines. Additional functions could be built in said engine control unit, such as controlling the servomotors that drive the rotary slot and control valves.

The flow of air intake, and thus the fuel injection rate and power output of BTS internal combustion engines may be increased by attaching a conventional supercharger or turbocharger.

BTS compressors and combustion engines normally will require water and/or air cooling, unless ceramic materials are used. Cooling may be provided through conventional water jackets and air fins on the housing and external combustion/storage chambers, as appropriate.

The above description of BTS rotary machines includes many details that should not be considered as limitations of this invention, but rather as examples of a number of possible variations. Thus, the scope of the present invention should be determined by the appended claims and their legal equivalents, and not by the above described embodiments.

What is claimed is:

1. A method for providing non-contact sealing between a first and a second body, which bodies separate spaces with fluids at different pressures, whereby a sealing surface on said first body moves as close as practicable over a matching surface on said second body, said sealing surface having grooves of generally rectangular cross section cut transversally to the direction of said relative movement, such that fluid escaping through the gap between said sealing surface and said matching surface is forced to consecutively compress and expand when passing around every said groove, with the consequent disruption in fluid leakage; said grooves on said first body being also able to move as close as practicable over and along cooperating ridges placed on a matching surface of a third body, such that said grooves and ridges form a labyrinth seal.

2. A method for leakproof traversal of a first body through a second body, said bodies moving in intercepting trajectories to each other; where the sealing means at any given instant of said traversal is a line segment geometrically defined by the intersection between a curved surface within said first body and a plane within said second body; where said first and second bodies are driven such that the relative velocity between said line segment on said first body and said line segment on said second body has no component along said plane within said second body; where the trace of said consecutive instantaneous curved surfaces over the period of said traversal defines the blade-alike shape of said first body, the corresponding trace of said consecutive instantaneous planes over said period defines the planar shape of said second body, and the corresponding trace of said consecutive line segments over said period, as seen by an observer stationed in said second body, defines the shape of the slot in said second body through which said first body traverses in leakproof fashion.

3. A rotary compressor/pump comprising:

a) a generally cylindrical rotor with its cylindrical surface curved outwards over a circular arc of radius R, said rotor being rotatably mounted on a main shaft, said shaft receiving driving torque at one of its ends;

b) a planar disk-shaped rotary slot valve of radius substantially equal to said radius R, having a radial slot; said slot valve being mounted radially to said rotor, and rotatably on a shaft perpendicular to but not intersecting said main shaft, with drive means to rotate said slot valve synchronously with said rotor;

c) a blade mounted radially on the periphery of said rotor, which traverses in quasi-leakproof fashion said slot in said rotary slot valve; the leading face of said blade being generated by a first line segment rotating about a center external to but aligned with said first segment, at the angular speed of said rotary slot valve, within a first plane that radially intersects the axis of said main shaft, said first plane rotating about said axis at the angular speed of said rotor; said first segment corresponding to the geometric intersection between the first side of said slot valve and the leading face of said blade at any instant of said traversal; the trailing face of said blade being generated by a second line segment aligned with and rotating about the aforementioned center, at the angular speed of said rotary slot valve, within a second plane that radially intersects the axis of said main shaft, said second plane rotating about said axis at the angular speed of said rotor; said second segment corresponding to the geometric intersection between the second side of said slot valve and the trailing face of said blade at any instant of said traversal; the first side of said slot being defined by the trajectory of said first segment during said traversal, as seen by an observer stationed in said slot valve; the second side of said slot being defined by the trajectory of said second segment during said traversal, as seen by an observer stationed in said slot valve;

d) a toroidal chamber having a radial cross section defined by the trajectory of said slot in said slot valve during said traversal; the volume of said chamber being generated by said blade when rotating about said main shaft; said chamber being radially and sealingly intersected by said slot valve as to form an intake subchamber between said slot valve and the trailing face of said blade, and a compression sub-chamber between the leading face of said blade and the other side of said slot valve;

e) a stationary housing sealingly enclosing said rotor, blade and slot valve into said chamber; said sealing being provided by non-contact seals comprising:
labyrinth seals circumferentially placed on the sides of said rotor and on the facing surface of said housing;
labyrinth seals circumferentially placed on the sides of said rotary slot valve and on the facing surface of said housing;
grooves cut along the outer edge of said rotary slot valve, cooperating with matching ridges placed on the facing surface of said housing to form a labyrinth seal, and operating per se over the curved cylindrical surface of said rotor; and
grooves cut along the sides and outer edge of said blade, operating per se over the surface of said chamber;

said sealing being alternatively provided by mechanical contact seals;

f) an inlet port in said intake sub-chamber, located as close as practicable to the intersection with said rotary slot valve; said inlet port facing the side, of said blade, that traverses said slot valve first; said inlet port having the same shape as said blade side, such that said blade side temporally covers said inlet port with sufficient overlap as to prevent return of working fluid from said intake sub-chamber back to said inlet port, during the transition between the end of an intake stroke and the staff of the next stroke;

g) an outlet port in said compression sub-chamber, located as close as practicable to the intersection with said rotary slot valve; said outlet port facing the side, of said blade, that traverses said slot valve last; said outlet port having the same shape as said blade side, such that said blade side temporally covers said outlet port with sufficient overlap as to prevent return of working fluid from said outlet port back to said compression sub-chamber, during the transition between the end of a compression stroke and the start of the next stroke; and h) a flap valve located at said outlet port to prevent return of pressurized fluid through said port; said flap valve consisting of a generally rectangular sheet spring with two partial parallel cuts that allow the inner rectangle thus formed to deflect independently from the rest of said sheet; said spring being secured between said outlet port and the corresponding outlet pipe such that said inner rectangle covers said outlet port with sufficient overlap as to provide effective sealing when the pressure in said outlet pipe is higher than in said compression sub-chamber, and such that said inner rectangle deflects outwards into said outlet pipe as to allow unrestricted flow of working fluid out of said compression sub-chamber when the pressure therein is higher than in said outlet pipe.

4. The rotary compressor/pump according to claim 3 having a plurality of N blades mounted on the rotor, further comprising said number N of rotary slot valves, intake sub-chambers, compression sub-chambers, inlet ports, outlet ports, and flap valves, for each aforesaid item.

5. A rotary compressor/pump comprising:

a) a substantially cylindrical rotor rotatably mounted on a main shaft, said shaft receiving driving torque at one of its ends;

b) two planar rectangular sliding slot valves, each having a linear slot transversal to its direction of movement; said slot valves being placed equiangularly and radially around said rotor, and slidably mounted on guides as to provide a linear trajectory parallel to the axis of said main shaft;

c) drive means to move said slot valves in reciprocating fashion and synchronously with said rotor; said reciprocating movement being provided by two identical cams, acting on two opposite sides of each said slot valve and rotating at the speed of said main shaft, each cam comprising eight consecutive profile sectors: the first sector having constant radius, the second sector featuring an increase in radius overproportional to the cam angular advance, the third sector having an increase in radius proportional to the cam angular advance, the fourth sector featuring an increase in radius underproportional to the cam angular advance; said four sectors driving said slot valve through the forward stroke of its reciprocating movement; the fifth, sixth, seventh and eight sectors being similar to the first, second, third and fourth sectors, but with decreasing sector radius, as to drive said slot valve through the backward stroke of its reciprocating movement; the sides of each said slot valve in contact with said cams protruding from the rectangular body of each said slot valve as to provide complete contact with the most eccentric part of said cams; said reciprocating movement being alternatively provided by only one of said cams, acting on one side of said slot valve against an helical spring fixed at the opposite side of said slot valve;

d) two blades mounted radially and equiangularly on the periphery of said rotor, which traverse in quasi-leakproof fashion said slots in said sliding slot valves; the leading face of each said blade being generated by a first line segment moving at the linear speed of any said slot valve, along a first plane that radially intersects the axis of said main shaft, said first plane rotating about said axis at the angular speed of said rotor; said first segment corresponding to the geometric intersection between the first side of any said slot valve and said leading face of any said blade at any instant of said traversal; the trailing face of each said blade being generated by a second line segment moving at the linear speed of any said slot valve, along a second plane that radially intersects the axis of said main shaft, said second plane rotating about said axis at the angular speed of said rotor; said second segment corresponding to the geometric intersection between the second side of any said slot valve and said trailing face of any said blade at any instant of said traversal; the first side of said slot in each said slot valve being defined by the trajectory of said first segment during said traversal, as seen by an observer stationed in said slot valve; the second side of said slot in each said slot valve being defined by the trajectory of said second segment during said traversal, as seen by an observer stationed in said slot valve;

e) a toroidal chamber having a radial cross section defined by the trajectory of said slot in any said slot valve during said traversal; the volume of said chamber being generated by said blades when rotating about said main shaft; said chamber being radially, equiangularly and sealingly intersected by said slot valves as to form an intake sub-chamber between the trailing face of each said blade and the slot valve located immediately behind, and a compression sub-chamber between the leading face of each said blade and the slot valve located immediately ahead;

f) a stationary housing sealingly enclosing said rotor, blades and slot valves into said chamber; said sealing being provided by non-contact seals comprising:

labyrinth seals circumferentially placed on the sides of said rotor and on the facing surface of said housing;

grooves cut along the lips of said housing facing said slot valves, those grooves aligned longitudinally to the direction of movement of said slot valves cooperating with matching ridges placed on said slot valves to form labyrinth seals, and those grooves aligned otherwise operating per se over the surface of said slot valves;

grooves cut along the sliding-wise longitudinal inner side of said slot valves, operating per se over the cylindrical surface of said rotor; and grooves cut along the sides and outer edge of said blades, operating per se over the surface of said chamber;

said sealing being alternatively provided by mechanical contact seals;

g) an inlet port in every said intake sub-chamber, located as close as practicable to the intersection with the corresponding slot valve; said inlet port facing the side, of any said blade, that traverses said slot valve first; said inlet port having the same shape as said blade side, such that said blade side temporally covers said inlet port with sufficient overlap as to prevent return of working fluid from said intake sub-chamber back to said inlet port, during the transition between the end of an intake stroke and the start of the next stroke;

h) an outlet port in every said compression sub-chamber, located as close as practicable to the intersection with the corresponding slot valve; said outlet port facing the side, of any said blade, that traverses said slot valve last; said outlet port having the same shape as said blade side, such that said blade side temporally covers said outlet port with sufficient overlap as to prevent return of working fluid from said outlet port back to said compression sub-chamber, during the transition between the end of a compression stroke and the staff of the next stroke; and i) a flap valve located at every said outlet port to prevent return of pressurized fluid through said port; said flap valve consisting of a generally rectangular sheet spring with two partial parallel cuts that allow the inner rectangle thus formed to deflect independently from the rest of said sheet; said spring being secured between every said outlet port and the corresponding outlet pipe such that said inner rectangle covers said outlet port with sufficient overlap as to provide effective sealing when the pressure in said outlet pipe is higher than in said compression sub-chamber, and such that said inner rectangle deflects outwards into said outlet pipe as to allow unrestricted flow of working fluid out of said compression sub-chamber when the pressure therein is higher than in said outlet pipe.

6. A rotary motor comprising:

a) a generally cylindrical rotor with its cylindrical surface curved outwards over a circular arc of radius R, said rotor being rotatably mounted on a main shaft, said shaft transmitting the power produced at one of its ends;

b) a planar disk-shaped rotary slot valve of radius substantially equal to said radius R, having a radial slot; said slot valve being mounted radially to said rotor, and rotatably on a shaft perpendicular to but not intersecting said main shaft, with drive means to rotate said slot valve synchronously with said rotor;

c) a blade mounted radially on the periphery of said rotor, which traverses in quasi-leakproof fashion said slot in said rotary slot valve; the leading face of said blade being generated by a first line segment rotating about a center external to but aligned with said first segment, at the angular speed of said rotary slot valve, within a first plane that radially intersects the axis of said main shaft, said first plane rotating about said axis at the angular speed of said rotor; said first segment corresponding to the geometric intersection between the first side of said slot valve and the leading face of said blade at any instant of said traversal; the trailing face of said blade being generated by a second line segment aligned with and rotating about the aforementioned center, at the angular speed of said rotary slot valve, within a second plane that radially intersects the axis of said main shaft, said second plane rotating about said axis at the angular speed of said rotor; said second segment corresponding to the geometric intersection between the second side of said slot valve and the trailing face of said blade at any instant of said traversal; the first side of said slot being defined by the trajectory of said first segment during said traversal, as seen by an observer stationed in said slot valve; the second side of said slot being defined by the trajectory of said second segment during said traversal, as seen by an observer stationed in said slot valve;

d) a toroidal chamber having a radial cross section defined by the trajectory of said slot in said slot valve during said traversal; the volume of said chamber being generated by said blade when rotating about said main shaft; said chamber being radially and sealingly intersected by said slot valve as to form an expansion sub-chamber between said slot valve and the trailing face of said blade, and an exhaust sub-chamber between the leading face of said blade and the other side of said slot valve;

e) a stationary housing sealingly enclosing said rotor, blade and slot valve into said chamber; said sealing being provided by non-contact seals comprising:

labyrinth seals circumferentially placed on the sides of said rotor and on the facing surface of said housing;

labyrinth seals circumferentially placed on the sides of said rotary slot valve and on the facing surface of said housing;

grooves cut along the outer edge of said rotary slot valve, cooperating with matching ridges placed on the facing surface of said housing to form a labyrinth seal, and operating per se over the curved cylindrical surface of said rotor; and grooves cut along the sides and outer edge of said blade, operating per se over the surface of said chamber;

said sealing being alternatively provided by mechanical contact seals;

f) an inlet port in said expansion sub-chamber, located as close as practicable to the intersection with said rotary slot valve; said inlet port facing the side, of said blade, that traverses said slot valve first; said inlet port having substantially the same size and shape as said blade side, such that said blade side completely covers said inlet port at the beginning of the expansion stroke as to prevent escape of pressurized fluid from said inlet port around said blade side into said exhaust sub-chamber;

g) an outlet port in said exhaust sub-chamber, located as close as practicable to the intersection with said rotary slot valve; said outlet port facing the side, of said blade, that traverses said slot valve last; said outlet port having substantially the same size and shape as said blade side, such that said side completely covers said outlet port at the end of the exhaust stroke as to prevent escape of working fluid from said expansion sub-chamber around said blade side into said outlet port; and h) a control valve, mounted in the inlet pipe connected to said inlet port, to regulate the flow and pressure of working fluid entering said expansion sub-chamber according to the desired power output of the motor.

7. The rotary motor according to claim 6 having a plurality of N blades mounted on the rotor, further comprising said number N of rotary slot valves, expansion sub-chambers, exhaust sub-chambers, inlet ports, and outlet ports, for each aforesaid item.

8. A rotary motor comprising:

a) a substantially cylindrical rotor rotatably mounted on a main shaft, said shaft transmitting the power produced at one of its ends;

b) two planar rectangular sliding slot valves, each having a linear slot transversal to its direction of movement; said slot valves being placed equiangularly and radially around said rotor, and slidably mounted on guides as to provide a linear trajectory parallel to the axis of said main shaft;

c) drive means to move said slot valves in reciprocating fashion and synchronously with said rotor; said reciprocating movement being provided by two identical cams, acting on two opposite sides of each said slot valve and rotating at the speed of said main shaft, each cam comprising eight consecutive profile sectors: the first sector having constant radius, the second sector featuring an increase in radius overproportional to the cam angular advance, the third sector having an increase in radius proportional to the cam angular advance, the fourth sector featuring an increase in radius underproportional to the cam angular advance; said four sectors driving said slot valve through the forward stroke of its reciprocating movement; the fifth, sixth, seventh and eight sectors being similar to the first, second, third and fourth sectors, but with decreasing sector radius, as to drive said slot valve through the backward stroke of its reciprocating movement; the sides of each said slot valve in contact with said cams protruding from the rectangular body of each said slot valve as to provide complete contact with the most eccentric part of said cams; said reciprocating movement being alternatively provided by only one of said cams, acting on one side of said slot valve against an helical spring fixed at the opposite side of said slot valve;

d) two blades mounted radially and equiangularly on the periphery of said rotor, which traverse in quasi-leak-proof fashion said slots in said sliding slot valves; the leading face of each said blade being generated by a first line segment moving at the linear speed of any said slot valve, along a first plane that radially intersects the axis of said main shaft, said first plane rotating about said axis at the angular speed of said rotor; said first segment corresponding to the geometric intersection between the first side of any said slot valve and said leading face of any said blade at any instant of said traversal; the trailing face of each said blade being generated by a second line segment moving at the linear speed of any said slot valve, along a second plane that radially intersects the axis of said main shaft, said second plane rotating about said axis at the angular speed of said rotor; said second segment corresponding to the geometric intersection between the second side of any said slot valve and said trailing face of any said blade at any instant of said traversal; the first side of said slot in each said slot valve being defined by the trajectory of said first segment during said traversal, as seen by an observer stationed in said slot valve; the second side of said slot in each said slot valve being defined by the trajectory of said second segment during said traversal, as seen by an observer stationed in said slot valve;

e) a toroidal chamber having a radial cross section defined by the trajectory of said slot in any said slot valve during said traversal; the volume of said chamber being generated by said blades when rotating about said main shaft; said chamber being radially, equiangularly and sealingly intersected by said slot valves as to form an expansion sub-chamber between the trailing face of each said blade and the slot valve located immediately behind, and an exhaust sub-chamber between the leading face of each said blade and the slot valve located immediately ahead;

f) a stationary housing sealingly enclosing said rotor, blades and slot valves into said chamber; said sealing being provided by non-contact seals comprising:

labyrinth seals circumferentially placed on the sides of said rotor and on the facing surface of said housing;

grooves cut along the lips of said housing facing said slot valves, those grooves aligned longitudinally to the direction of movement of said slot valves cooperating with matching ridges placed on said slot valves to form labyrinth seals, and those grooves aligned otherwise operating per se over the surface of said slot valves;

grooves cut along the sliding-wise longitudinal inner side of said slot valves, operating per se over the cylindrical surface of said rotor; and grooves cut along the sides and outer edge of said blades, operating per se over the surface of said chamber;

said sealing being alternatively provided by mechanical contact seals;

g) an inlet port in every said expansion sub-chamber, located as close as practicable to the intersection with the corresponding slot valve; said inlet port facing the side, of any said blade, that traverses said slot valve first; said inlet port having substantially the same size and shape as said blade side, such that said blade side completely covers said inlet port at the beginning of the expansion stroke as to prevent escape of pressurized fluid from said inlet port around said blade side into said exhaust sub-chamber;

h) an outlet port in every said exhaust sub-chamber, located as close as practicable to the intersection with the corresponding slot valve; said outlet port facing the side, of any said blade, that traverses said slot valve last; said outlet port having substantially the same size and shape as said blade side, such that said blade side completely covers said outlet port at the end of the exhaust stroke as to prevent escape of working fluid from said expansion sub-chamber around said blade side into said outlet port; and i) a control valve, mounted in the inlet pipe connected to every said inlet port, to regulate the flow and pressure of working fluid entering said expansion sub-chamber according to the desired power output of the motor.

9. A rotary combustion engine comprising:

a) a main shaft transmitting the power produced at one of its ends;

b) a compression assembly further comprising:

a substantially cylindrical rotor rotatably mounted on said main shaft;

two planar rectangular sliding slot valves, each having a linear slot transversal to its direction of movement; said slot valves being placed equiangularly and radially around said rotor, and slidably mounted on guides as to provide a linear trajectory parallel to the axis of said main shaft;

drive means to move said slot valves in reciprocating fashion and synchronously with said rotor; said reciprocating movement being provided by two identical cams, acting on two opposite sides of each said slot valve and rotating at the speed of said main shaft, each cam comprising eight consecutive profile sectors: the first sector having constant radius, the second sector featuring an increase in radius overproportional to the cam angular advance, the third sector having an increase in radius proportional to the cam angular advance, the fourth sector featuring an increase in radius underproportional to the cam angular advance; said four sectors driving said slot valve through the forward stroke of its reciprocating movement; the fifth, sixth, seventh and eight sectors being similar to the first, second, third and fourth sectors, but with decreasing sector radius, as to drive said slot valve through the backward stroke of its reciprocating movement; the sides of each said slot valve in contact with said cams protruding from the rectangular body of each said slot valve as to provide complete contact with the most eccentric part of said cams; said reciprocating movement being alternatively provided by only one of said cams, acting on one side of said slot valve against an helical spring fixed at the opposite side of said slot valve;

two blades mounted radially and equiangularly on the periphery of said rotor, which traverse in quasi-leakproof fashion said slots in said sliding slot valves; the leading face of each said blade being generated by a first line segment moving at the linear speed of any said slot valve, along a first plane that radially intersects the axis of said main shaft, said first plane rotating about said axis at the angular speed of said rotor; said first segment corresponding to the geometric intersection between the first side of any said slot valve and said leading face of any said blade at any instant of said traversal; the trailing face of each said blade being generated by a second line segment moving at the linear speed of any said slot valve, along a second plane that radially intersects the axis of said main shaft, said second plane rotating about said axis at the angular speed of said rotor; said second segment corresponding to the geometric intersection between the second side of any said slot valve and said trailing face of any said blade at any instant of said traversal; the first side of said slot in each said slot valve being defined by the trajectory of said first segment during said traversal, as seen by an observer stationed in said slot valve; the second side of said slot in each said slot valve being defined by the trajectory of said second segment during said traversal, as seen by an observer stationed in said slot valve;

a toroidal chamber having a radial cross section defined by the trajectory of said slot in any said slot valve during said traversal; the volume of said chamber being generated by said blades when rotating about said main shaft; said chamber being radially, equiangularly and sealingly intersected by said slot valves as to form an intake sub-chamber between the trailing face of each said blade and the slot valve located immediately behind, and a compression sub-chamber between the leading face of each said blade and the slot valve located immediately ahead;

an inlet port in every said intake sub-chamber, located as close as practicable to the intersection with the corresponding slot valve; said inlet port facing the side, of any said blade, that traverses said slot valve first; said inlet port having the same shape as said blade side, such that said blade side temporally covers said inlet port with sufficient overlap as to prevent return of air charge from said intake sub-chamber back to said inlet port, during the transition between the end of an intake stroke and the start of the next stroke;

an outlet port of triangular shape in every said compression sub-chamber, located in the center of the area last swept by the outer edge of any said blade, just before completing the traversal through the corresponding slot valve, such that said outer edge temporally covers most of said outlet port as to minimize the return of compressed air from said outlet port back to said compression subchamber, during the transition between the end of a compression stroke and the start of the next stroke; and a flap valve located at every said outlet port to prevent return of compressed air through said port; said flap valve consisting of a generally triangular sheet spring with partial cuts parallel to two of its sides that allow the inner triangle thus formed to deflect independently from the rest of said sheet; said spring being secured between every said outlet port and the corresponding outlet pipe such that said inner triangle covers said outlet port with sufficient overlap as to provide effective sealing when the pressure in said outlet pipe is higher than in said compression sub-chamber, and such that said inner triangle deflects outwards into said outlet pipe as to allow unrestricted flow of compressed air out of said compression sub-chamber when the pressure therein is higher than in said outlet pipe;

c) an expansion assembly, mounted side by side with said compression assembly as to share said two sliding slot valves, guides and drive means; said expansion assembly further comprising:

a substantially cylindrical rotor rotatably mounted on said main shaft;

two blades mounted radially and equiangularly on the periphery of said rotor, which traverse in quasi-leakproof fashion said slots in said sliding slot valves; the leading face of each said blade being generated by a first line segment moving at the linear speed of any said slot valve, along a first plane that radially intersects the axis of said main shaft, said first plane rotating about said axis at the angular speed of said rotor; said first segment corresponding to the geometric intersection between the first side of any said slot valve and said leading face of any said blade at any instant of said traversal; the trailing face of each said blade being generated by a second line segment moving at the linear speed of any said slot valve, along a second plane that radially intersects the axis of said main shaft, said second plane rotating about said axis at the angular speed of said rotor; said second segment corresponding to the geometric intersection between the second side of any said slot valve and said trailing face of any said blade at any instant of said traversal; the first side of said slot in each said slot valve being defined by the trajectory of said first segment during said traversal, as seen by an observer stationed in said slot valve; the second side of said slot in each said slot valve being defined by the trajectory of said second segment during said traversal, as seen by an observer stationed in said slot valve;

a toroidal chamber having a radial cross section defined by the trajectory of said slot in any said slot valve during said traversal; the volume of said chamber being generated by said blades when rotating about said main shaft; said chamber being radially, equiangularly and sealingly intersected by said slot valves as to form an expansion sub-chamber between the trailing face of each said blade and the slot valve located immediately behind, and an exhaust sub-chamber between the leading face of each said blade and the slot valve located immediately ahead;

an inlet port of triangular shape in every said expansion sub-chamber, located in the center of the area first swept by the outer edge of any said blade, just after starting the traversal through the corresponding slot valve, such that said outer edge temporally covers most of said inlet port at the beginning of the expansion stroke as to minimize escape of hot combustion gases from said inlet port around said blade edge into said exhaust sub-chamber; and an outlet port in every said exhaust sub-chamber, located as close as practicable to the intersection with the corresponding slot valve; said outlet port facing the side, of any said blade, that traverses said slot valve last; said outlet port having substantially the same size and shape as said blade side, such that said blade side completely covers said outlet port at the end of the exhaust stroke as to prevent escape of gases from said expansion sub-chamber around said blade side into said outlet port;

d) a stationary housing sealingly enclosing said rotors, blades and slot valves into said chambers; said sealing being provided by non-contact seals comprising:

labyrinth seals circumferentially placed on the sides of said rotors and on the facing surface of said housing;

grooves cut along the lips of said housing facing said slot valves, those grooves aligned longitudinally to the direction of movement of said slot valves cooperating with matching ridges placed on said slot valves to form labyrinth seals, and those grooves aligned otherwise operating per se over the surface of said slot valves;

grooves cut along the sliding-wise longitudinal inner side of said slot valves, operating per se over the cylindrical surface of said rotors; and grooves cut along the sides and outer edge of said blades, operating per se over the surface of said chambers;

said sealing being alternatively provided by mechanical contact seals;

e) two generally cylindrical combustion chambers, each having one inlet pipe and one outlet pipe connected tangentially to its cylindrical wall, at opposite sides of said chamber, with means for injecting fuel and igniting the air-fuel mixture; and f) two control valves, each mounted between the outlet pipe of the corresponding combustion chamber and the inlet pipe of the corresponding expansion sub-chamber, every said control valve opening at the beginning of the expansion stroke, and closing when the pressure in said compression sub-chamber equals the pressure in said combustion chamber.

10. The rotary internal combustion engine according to claim 9 wherein every said control valve is a rotary valve comprising: a housing with a cylindrical bore, an inlet port, an outlet port, and a cutout in said bore that merges with said valve outlet port; a matching rotor with a cutout of the same width as said cutout in said valve housing, and a groove cut cylindrically at said rotor end; labyrinth seals placed between the cylindrical side and end face of said valve rotor, and the facing surface of said bore; and means to drive said valve rotor at twice the speed of said main shaft, such that said rotor cutout determines the flow of gases through said rotary control valve according to its position relative to said valve inlet and valve outlet ports.

11. The rotary internal combustion engine according to claim 9, wherein a piston slidably fit inside every said combustion chamber is actuated by a control rod to change the effective volume of said chamber, as to provide on-demand variable compression ratio during the operation of the engine; said piston having a bore for receiving the end of said rod, both said piston and said rod having axial and radial passages that align when said rod is pushed against or pulled away from said piston; said alignment allowing the flow of gases through said passages from one side of said piston to the other, equalizing the pressure and thus facilitating the movement of said piston by said rod.

12. A rotary combustion engine comprising:

a) a substantially cylindrical rotor rotatably mounted on a main shaft, said shaft transmitting the power produced at one of its ends;

b) two planar rectangular sliding slot valves, each having a linear slot transversal to its direction of movement; said slot valves being placed equiangularly and radially around said rotor, and slidably mounted on guides as to provide a linear trajectory parallel to the axis of said main shaft;

c) drive means to move said slot valves in reciprocating fashion and synchronously with said rotor; said reciprocating movement being provided by two identical cams, acting on two opposite sides of each said slot valve and rotating at the speed of said main shaft, each cam comprising eight consecutive profile sectors: the first sector having constant radius, the second sector featuring an increase in radius overproportional to the cam angular advance, the third sector having an increase in radius proportional to the cam angular advance, the fourth sector featuring an increase in radius underproportional to the cam angular advance; said four sectors driving said slot valve through the forward stroke of its reciprocating movement; the fifth, sixth, seventh and eight sectors being similar to the first, second, third and fourth sectors, but with decreasing sector radius, as to drive said slot valve through the backward stroke of its reciprocating movement; the sides of each said slot valve in contact with said cams protruding from the rectangular body of each said slot valve as to provide complete contact with the most eccentric part of said cams; said reciprocating movement being alternatively provided by only one of said cams, acting on one side of said slot valve against an helical spring fixed at the opposite side of said slot valve;

d) two blades mounted radially and equiangularly on the periphery of said rotor, which traverse in quasi-leak-proof fashion said slots in said sliding slot valves; the leading face of each said blade being generated by a first line segment moving at the linear speed of any said slot valve, along a first plane that radially intersects the axis of said main shaft, said first plane rotating about said axis at the angular speed of said rotor; said first segment corresponding to the geometric intersection between the first side of any said slot valve and said leading face of any said blade at any instant of said traversal; the trailing face of each said blade being generated by a second line segment moving at the linear speed of any said slot valve, along a second plane that radially intersects the axis of said main shaft, said second plane rotating about said axis at the angular speed of said rotor; said second segment corresponding to the geometric intersection between the second side of any said slot valve and said trailing face of any said blade at any instant of said traversal; the first side of said slot in each said slot valve being defined by the trajectory of said first segment during said traversal, as seen by an observer stationed in said slot valve; the second side of said slot in each said slot valve being defined by the trajectory of said second segment during said traversal, as seen by an observer stationed in said slot valve;

e) a toroidal chamber having a radial cross section defined by the trajectory of said slot in any said slot valve during said traversal; the volume of said chamber being generated by said blades when rotating about said main shaft; said chamber being radially, equiangularly and sealingly intersected by said slot valves as to form an expanding sub-chamber between the trailing face of each said blade and the slot valve located immediately behind, and a contracting sub-chamber between the leading face of each said blade and the slot valve located immediately ahead; said expanding sub-chambers performing alternately as intake sub-chambers in one stroke and as expansion sub-chambers in the next stroke; said contracting sub-chambers performing alternately as compression sub-chambers in one stroke and as exhaust sub-chambers in the next stroke;

f) a stationary housing sealingly enclosing said rotor, blades and slot valves into said chamber; said sealing being provided by non-contact seals comprising:

labyrinth seals circumferentially placed on the sides of said rotor and on the facing surface of said housing;

grooves cut along the lips of said housing facing said slot valves, those grooves aligned longitudinally to the direction of movement of said slot valves cooperating with matching ridges placed on said slot valves to form labyrinth seals, and those grooves aligned otherwise operating per se over the surface of said slot valves;

grooves cut along the sliding-wise longitudinal inner side of said slot valves, operating per se over the cylindrical surface of said rotor; and grooves cut along the sides and outer edge of said blades, operating per se over the surface of said chamber;

said sealing being alternatively provided by mechanical contact seals;

g) an inlet port in every said intake/expansion sub-chamber, located as close as practicable to the intersection with the corresponding slot valve; said inlet port facing the side, of any said blade, that traverses said slot valve first; said inlet port having the same shape as said blade side, such that said blade side temporally covers said inlet port with sufficient overlap as to prevent return of air charge from said intake/expansion sub-chamber back to said inlet port during the transition between the end of an intake stroke and the start of the next stroke, and as to prevent escape of hot combustion gases from said inlet port around said blade side into said compression/exhaust sub-chamber at the beginning of the expansion stroke;

h) an outlet port in every said compression/exhaust sub-chamber, located as close as practicable to the intersection with the corresponding slot valve; said outlet port facing the side, of any said blade, that traverses said slot valve last; said outlet port having the same shape as said blade side, such that said blade side temporally covers said outlet port with sufficient overlap as to prevent return of compressed air from said outlet port back to said compression/exhaust sub-chamber during the transition between the end of a compression stroke and the start of the next stroke, and as to prevent escape of gases from said intake/expansion sub-chamber around said blade side into said outlet port at the end of the exhaust stroke;

i) two storage chambers to temporally store the air being compressed by the compression strokes while the expansion strokes proceed; each chamber having one inlet pipe and one outlet pipe;

j) two generally cylindrical combustion chambers, each having one inlet pipe and one outlet pipe connected tangentially to its cylindrical wall, at opposite sides of said chamber, with means for injecting fuel and igniting the air-fuel mixture;

k) two inlet control valves, each having its first inlet connected to the corresponding fresh air inlet pipe of the engine, its second inlet connected to the outlet pipe of the corresponding combustion chamber, and its outlet connected to the inlet pipe of the corresponding intake/expansion sub-chamber; said control valves directing alternately fresh air and hot combustion gases to said intake/expansion sub-chambers during said intake and expansion strokes, respectively;

l) two outlet control valves, each having its inlet connected to the outlet pipe of the corresponding compression/exhaust sub-chamber, its first outlet connected to the inlet pipe of the corresponding storage chamber, and its second outlet connected to the corresponding exhaust pipe of the engine; said control valves releasing alternately compressed air from said compression/exhaust sub-chambers to said storage chambers during said compression strokes, and exhaust gases from said compression/exhaust sub-chambers to said exhaust pipes during said exhaust strokes; and m) two transfer valves, each mounted between the outlet pipe of the corresponding storage chamber and the inlet pipe of the corresponding combustion chamber, every said transfer valve opening at the beginning of the corresponding intake stroke, and closing when the pressure in the corresponding storage chamber equals the pressure in the corresponding combustion chamber.

13. The rotary internal combustion engine according to claim 12 wherein:

every said inlet control valve is a rotary valve comprising: a housing with a cylindrical bore, two inlet ports, one outlet port, and a cutout in said bore that merges with said valve outlet port; a matching rotor with a cutout of the same width as said cutout in said valve housing, and a groove cut cylindrically at said rotor end; labyrinth seals placed between the cylindrical side and end face of said valve rotor, and the facing surface of said bore; and means to drive said valve rotor at the speed of said main shaft, such that said rotor cutout distributes the flow through said rotary control valve according to its position relative to said valve inlet and outlet ports;

every said outlet control valve is a rotary valve comprising: a housing with a cylindrical bore, one inlet port, two outlet ports, and a cutout in said bore that merges with said valve inlet port; a matching rotor with a cutout of the same width as said cutout in said valve housing, and a groove cut cylindrically at said rotor end; labyrinth seals placed between the cylindrical side and end face of said valve rotor, and the facing surface of said bore; and means to drive said valve rotor at the speed of said main shaft, such that said rotor cutout distributes the flow through said rotary control valve according to its position relative to said valve inlet and outlet ports;

every said transfer valve is a rotary valve comprising: a housing with a cylindrical bore, an inlet port, an outlet port, and a cutout in said bore that merges with said valve outlet port; a matching rotor with a cutout of the same width as said cutout in said valve housing, and a groove cut cylindrically at said rotor end; labyrinth seals placed between the cylindrical side and end face of said valve rotor, and the facing surface of said bore; and means to drive said valve rotor at twice the speed of said main shaft, such that said rotor cutout determines the flow of air through said rotary transfer valve according to its position relative to said valve inlet and outlet ports.

14. The rotary internal combustion engine according to claim 12 wherein said storage chambers are generally cylindrical, and wherein a piston slidably fit inside every said storage chamber is actuated by a control rod to change the effective volume of said chamber, as to provide on-demand variable compression ratio during the operation of the engine; said piston having a bore for receiving the end of said rod, both said piston and said rod having axial and radial passages that align when said rod is pushed against or pulled away from said piston; said alignment allowing the flow of gases through said passages from one side of said piston to the other, equalizing the pressure and thus facilitating the movement of said piston by said rod.

15. A rotary internal combustion engine comprising:

a) a main shaft transmitting the power produced at one of its ends;

b) a compression assembly further comprising:

a generally cylindrical rotor with its cylindrical surface curved outwards over a circular arc of radius R, said rotor being rotatably mounted on said main shaft;

a planar disk-shaped rotary slot valve of radius substantially equal to said radius R, having a radial slot; said slot valve being mounted radially to said rotor, and rotatably on a shaft perpendicular to but not intersecting said main shaft, with drive means to rotate said slot valve synchronously with said rotor;

a blade mounted radially on the periphery of said rotor, which traverses in quasi-leakproof fashion said slot in said rotary slot valve; the leading face of said blade being generated by a first line segment rotating about a center external to but aligned with said first segment, at the angular speed of said rotary slot valve, within a first plane that radially intersects the axis of said main shaft, said first plane rotating about said axis at the angular speed of said rotor; said first segment corresponding to the geometric intersection between the first side of said slot valve and the leading face of said blade at any instant of said traversal; the trailing face of said blade being generated by a second line segment aligned with and rotating about the aforementioned center, at the angular speed of said rotary slot valve, within a second plane that radially intersects the axis of said main shaft, said second plane rotating about said axis at the angular speed of said rotor; said second segment corresponding to the geometric intersection between the second side of said slot valve and the trailing face of said blade at any instant of said traversal; the first side of said slot being defined by the trajectory of said first segment during said traversal, as seen by an observer stationed in said slot valve; the second side of said slot being defined by the trajectory of said second segment during said traversal, as seen by an observer stationed in said slot valve;

a toroidal chamber having a radial cross section defined by the trajectory of said slot in said slot valve during said traversal; the volume of said chamber being generated by said blade when rotating about said main shaft; said chamber being radially and sealingly intersected by said slot valve as to form an intake sub-chamber between said slot valve and the trailing face of said blade, and a compression sub-chamber between the leading face of said blade and the other side of said slot valve;

an inlet port in said intake sub-chamber, located as close as practicable to the intersection with said rotary slot valve; said inlet port facing the side, of said blade, that traverses said slot valve first; said inlet port having the same shape as said blade side, such that said blade side temporally covers said inlet port with sufficient overlap as to prevent return of air charge from said intake sub-chamber back to said inlet port, during the transition between the end of an intake stroke and the start of the next stroke;

an outlet port of triangular shape in said compression sub-chamber, located in the corner last swept by the outer edge of said blade, just before completing the traversal through said slot valve, such that said outer edge temporally covers most of said outlet port as to minimize the return of compressed air from said outlet port back to said compression sub-chamber, during the transition between the end of a compression stroke and the start of the next stroke; and a flap valve located at said outlet port to prevent return of compressed air through said port; said flap valve consisting of a generally triangular sheet spring with partial cuts parallel to two of its sides that allow the inner triangle thus formed to deflect independently from the rest of said sheet; said spring being secured between said outlet port and the corresponding outlet pipe such that said inner triangle covers said outlet port with sufficient overlap as to provide effective sealing when the pressure in said outlet pipe is higher than in said compression sub-chamber, and such that said inner triangle deflects outwards into said outlet pipe as to allow unrestricted flow of compressed air out of said compression sub-chamber when the pressure therein is higher than in said outlet pipe;

c) an expansion assembly, mounted side by side with said compression assembly as to share said rotary slot valve, corresponding shaft and drive means; said expansion assembly further comprising:

a generally cylindrical rotor with its cylindrical surface curved outwards over a circular arc of radius R, said rotor being rotatably mounted on said main shaft;

a blade mounted radially on the periphery of said rotor, which traverses in quasi-leakproof fashion said slot in said rotary slot valve; the leading face of said blade being generated by a first line segment rotating about a center external to but aligned with said first segment, at the angular speed of said rotary slot valve, within a first plane that radially intersects the axis of said main shaft, said first plane rotating about said axis at the angular speed of said rotor; said first segment corresponding to the geometric intersection between the first side of said slot valve and the leading face of said blade at any instant of said traversal; the trailing face of said blade being generated by a second line segment aligned with and rotating about the aforementioned center, at the angular speed of said rotary slot valve, within a second plane that radially intersects the axis of said main shaft, said second plane rotating about said axis at the angular speed of said rotor; said second segment corresponding to the geometric intersection between the second side of said slot valve and the trailing face of said blade at any instant of said traversal; the first side of said slot being defined by the trajectory of said first segment during said traversal, as seen by an observer stationed in said slot valve; the second side of said slot being defined by the trajectory of said second segment during said traversal, as seen by an observer stationed in said slot valve;

a toroidal chamber having a radial cross section defined by the trajectory of said slot in said slot valve during said traversal; the volume of said chamber being generated by said blade when rotating about said main shaft; said chamber being radially and sealingly intersected by said slot valve as to form an expansion sub-chamber between said slot valve and the trailing face of said blade, and an exhaust sub-chamber between the leading face of said blade and the other side of said slot valve;

an inlet port of triangular shape in said expansion sub-chamber, located in the corner first swept by the outer edge of said blade, just after starting the traversal through said slot valve, such that said edge temporally covers most of said inlet port at the beginning of the expansion stroke as to minimize escape of hot combustion gases from said inlet port around said blade edge into said exhaust sub-chamber; and an outlet port in said exhaust sub-chamber, located as close as practicable to the intersection with said rotary slot valve; said outlet port facing the side, of said blade, that traverses said slot valve last; said outlet port having substantially the same size and shape as said blade side, such that said blade side completely covers said outlet port at the end of the exhaust stroke as to prevent escape of gases from said expansion sub-chamber around said blade edge into said outlet port;

d) a stationary housing sealingly enclosing said rotors, blades and slot valve into said chambers, said sealing being provided by non-contact seals comprising:

labyrinth seals circumferentially placed on the sides of said rotors and on the facing surface of said housing;

labyrinth seals circumferentially placed on the sides of said rotary slot valve and on the facing surface of said housing;

grooves cut along the outer edge of said rotary slot valve, cooperating with matching ridges placed on the facing surface of said housing to form a labyrinth seal, and operating per se over the curved cylindrical surface of said rotor; and grooves cut along the sides and outer edge of said blades, operating per se over the surface of said chambers;

said sealing being alternatively provided by mechanical contact seals;

e) a generally cylindrical combustion chamber having one inlet pipe and one outlet pipe connected tangentially to its cylindrical wall, at opposite sides of said chamber, with means for injecting fuel and igniting the air-fuel mixture; and f) a control valve, mounted between the outlet pipe of said combustion chamber and the inlet pipe of said expansion sub-chamber, opening at the beginning of the expansion stroke, and closing when the pressure in said compression sub-chamber equals the pressure in said combustion chamber.

16. The rotary internal combustion engine according to claim 15 wherein said control valve is a rotary valve comprising: a housing with a cylindrical bore, an inlet port, an outlet port, and a cutout in said bore that merges with said valve outlet port; a matching rotor with a cutout of the same width as said cutout in said valve housing, and a groove cut cylindrically at said rotor end; labyrinth seals placed between the cylindrical side and end face of said valve rotor, and the facing surface of said bore; and means to drive said valve rotor at the speed of said main shaft, such that said rotor cutout determines the flow of gases through said rotary control valve according to its position relative to said valve inlet and valve outlet ports.

17. The rotary internal combustion engine according to claim 15, wherein a piston slidably fit inside said combustion chamber is actuated by a control rod to change the effective volume of said chamber, as to provide on-demand variable compression ratio during the operation of the engine; said piston having a bore for receiving the end of said rod, both said piston and said rod having axial and radial passages that align when said rod is pushed against or pulled away from said piston; said alignment allowing the flow of gases through said passages from one side of said piston to the other, equalizing the pressure and thus facilitating the movement of said piston by said rod.

18. The rotary internal combustion engine according to claim 15, having a plurality of N blades mounted on the compression assembly rotor, and the same number N of blades mounted on the expansion assembly rotor, further comprising: said number N of rotary slot valves, intake sub-chambers, compression sub-chambers, flap valves, expansion sub-chambers, exhaust sub-chambers, combustion chambers, and control valves, for each aforesaid item; twice said number N of inlet ports, and twice said number N of outlet ports.

19. A rotary internal combustion engine comprising:

a) a generally cylindrical rotor with its cylindrical surface curved outwards over a circular arc of radius R, said rotor being rotatably mounted on a main shaft, said shaft transmitting the power produced at one of its ends;

b) a planar disk-shaped rotary slot valve of radius substantially equal to said radius R, having a radial slot; said slot valve being mounted radially to said rotor, and rotatably on a shaft perpendicular to but not intersecting said main shaft, with drive means to rotate said slot valve synchronously with said rotor;

c) a blade mounted radially on the periphery of said rotor, which traverses in quasi-leakproof fashion said slot in said rotary slot valve; the leading face of said blade being generated by a first line segment rotating about a center external to but aligned with said first segment, at the angular speed of said rotary slot valve, within a first plane that radially intersects the axis of said main shaft, said first plane rotating about said axis at the angular speed of said rotor; said first segment corresponding to the geometric intersection between the first side of said slot valve and the leading face of said blade at any instant of said traversal; the trailing face of said blade being generated by a second line segment aligned with and rotating about the aforementioned center, at the angular speed of said rotary slot valve, within a second plane that radially intersects the axis of said main shaft, said second plane rotating about said axis at the angular speed of said rotor; said second segment corresponding to the geometric intersection between the second side of said slot valve and the trailing face of said blade at any instant of said traversal; the first side of said slot being defined by the trajectory of said first segment during said traversal, as seen by an observer stationed in said slot valve; the second side of said slot being defined by the trajectory of said second segment during said traversal, as seen by an observer stationed in said slot valve;

d) a toroidal chamber having a radial cross section defined by the trajectory of said slot in said slot valve during said traversal; the volume of said chamber being generated by said blade when rotating about said main shaft; said chamber being radially and sealingly intersected by said slot valve as to form an expanding sub-chamber between said slot valve and the trailing face of said blade, and a contracting sub-chamber between the leading face of said blade and the other side of said slot valve; said expanding sub-chamber performing alternately as intake sub-chamber in one stroke and as expansion sub-chamber in the next stroke; said contracting sub-chamber performing alternately as compression sub-chamber in one stroke and as exhaust sub-chamber in the next stroke;

e) a stationary housing sealingly enclosing said rotor, blade and slot valve into said chamber; said sealing being provided by non-contact seals comprising:

labyrinth seals circumferentially placed on the sides of said rotor and on the facing surface of said housing;

labyrinth seals circumferentially placed on the sides of said rotary slot valve and on the facing surface of said housing;

grooves cut along the outer edge of said rotary slot valve, cooperating with matching ridges placed on the facing surface of said housing to form a labyrinth seal, and operating per se over the curved cylindrical surface of said rotor; and grooves cut along the sides and outer edge of said blade, operating per se over the surface of said chamber;

said sealing being alternatively provided by mechanical contact seals;

f) an inlet port in said intake/expansion sub-chamber, located as close as practicable to the intersection with said rotary slot valve; said inlet port facing the side, of said blade, that traverses said slot valve first; said inlet port having the same shape as said blade side, such that said blade side temporally covers said inlet port with sufficient overlap as to prevent return of air charge from said intake/expansion sub-chamber back to said inlet port during the transition between the end of an intake stroke and the start of the next stroke, and as to prevent escape of hot combustion gases from said inlet port around said blade side into said compression/exhaust chamber at the beginning of the expansion stroke;

g) an outlet port in said compression/exhaust sub-chamber, located as close as practicable to the intersection with said rotary slot valve; said outlet port facing the side, of said blade, that traverses said slot valve last; said outlet port having the same shape as said blade side, such that said blade side temporally covers said outlet port with sufficient overlap as to prevent return of compressed air from said outlet port back to said compression/exhaust sub-chamber during the transition between the end of a compression stroke and the start of the next stroke, and as to prevent escape of gases from said intake/expansion sub-chamber around said blade side into said outlet port at the end of the exhaust stroke;

h) a storage chamber to temporally store the air being compressed by the compression stroke while the expansion stroke proceeds; said storage chamber having one inlet pipe and one outlet pipe;

i) a generally cylindrical combustion chamber having one inlet pipe and one outlet pipe connected tangentially to its cylindrical wall, at opposite sides of said chamber, with means for injecting fuel and igniting the air-fuel mixture;

j) an inlet control valve, having its first inlet connected to the fresh air inlet pipe of the engine, its second inlet connected to said outlet pipe of said combustion chamber, and its outlet connected to the inlet pipe of said intake/expansion sub-chamber; said control valve directing alternately fresh air and hot combustion gases to said intake/expansion sub-chamber, during said intake and expansion strokes, respectively;

k) an outlet control valve, having its inlet connected to the outlet pipe of said compression/exhaust sub-chamber, its first outlet connected to said inlet pipe of said storage chamber, and its second outlet connected to the exhaust pipe of the engine; said control valve releasing alternately compressed air from said compression/exhaust chamber to said storage chamber during said compression stroke, and exhaust gases from said compression/exhaust sub-chamber to said exhaust pipe during said exhaust stroke; and l) a transfer valve, mounted between said outlet pipe of said storage chamber and the inlet pipe of said combustion chamber, opening at the beginning of said intake stroke, and closing when the pressure in said storage chamber equals the pressure in said combustion chamber.

20. The rotary internal combustion engine according to claim 19 wherein:

said inlet control valve is a rotary valve comprising: a housing with a cylindrical bore, two inlet ports, one outlet port, and a cutout in said bore that merges with said valve outlet port; a matching rotor with a cutout of the same width as said cutout in said valve housing, and a groove cut cylindrically at said rotor end; labyrinth seals placed between the cylindrical side and end face of said valve rotor, and the facing surface of said bore; and means to drive said valve rotor at half the speed of said main shaft, such that said rotor cutout distributes the flow through said rotary control valve according to its position relative to said valve inlet and outlet ports;

said outlet control valve is a rotary valve comprising: a housing with a cylindrical bore, one inlet port, two outlet ports, and a cutout in said bore that merges with said valve inlet port; a matching rotor with a cutout of the same width as said cutout in said valve housing, and a groove cut cylindrically at said rotor end; labyrinth seals placed between the cylindrical side and end face of said valve rotor, and the facing surface of said bore; and means to drive said valve rotor at half the speed of said main shaft, such that said rotor cutout distributes the flow through said rotary control valve according to its position relative to said valve inlet and outlet ports;

said transfer valve is a rotary valve comprising: a housing with a cylindrical bore, an inlet port, an outlet port, and a cutout in said bore that merges with said valve outlet port; a matching rotor with a cutout of the same width as said cutout in said valve housing, and a groove cut cylindrically at said rotor end; labyrinth seals placed between the cylindrical side and end face of said valve rotor, and the facing surface of said bore; and means to drive said valve rotor at the speed of said main shaft, such that said rotor cutout determines the flow of air through said rotary transfer valve according to its position relative to said valve inlet and outlet ports.

21. The rotary internal combustion engine according to claim 19 wherein said storage chamber is generally cylindrical, and wherein a piston slidably fit inside said storage chamber is actuated by a control rod to change the effective volume of said chamber, as to provide on-demand variable compression ratio during the operation of the engine; said piston having a bore for receiving the end of said rod, both said piston and said rod having axial and radial passages that align when said rod is pushed against or pulled away from said piston; said alignment allowing the flow of gases through said passages from one side of said piston to the other, equalizing the pressure and thus facilitating the movement of said piston by said rod.

22. The rotary internal combustion engine according to claim 19 having a plurality of N blades mounted on the rotor, further comprising said number N of rotary slot valves, intake/expansion sub-chambers, compression/exhaust sub-chambers, inlet ports, outlet ports, storage chambers, combustion chambers, inlet control valves, outlet control valves, and transfer valves, for each aforesaid item.

* * * * *

UNITED STATES PATENT AND TRADEMARK OFFICE

CERTIFICATE OF CORRECTION

PATENT NO. : 7,305,963 B2
APPLICATION NO. : 10/908476
DATED : December 11, 2007
INVENTOR(S) : Zak It is certified that error appears in the above-identified patent and that said Letters Patent is hereby corrected as shown below:

In Column 4, line 65, replace “show)” with --shown)--.
In Column 5, line 11, replace “111” with --11--.
In Column 11, line 30, replace “staff” with --start--.
In Column 18, line 33, replace “subchamber,” with --sub-chamber,--.

Signed and Sealed this

Eighth Day of April, 2008

JON W. DUDAS
*Director of the United States Patent and Trademark Office*